US010589236B2

(12) United States Patent
Mochizuki

(10) Patent No.: US 10,589,236 B2
(45) **Date of Patent: *Mar. 17, 2020**

(54) MIXING UNIT AND DEVICE, AND FLUID MIXING METHOD

(71) Applicant: ISEL CO., LTD., Osaka (JP)

(72) Inventor: Noboru Mochizuki, Osaka (JP)

(73) Assignee: ISEL CO., LTD., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/051,577

(22) Filed: Aug. 1, 2018

(65) Prior Publication Data

US 2018/0339277 A1 Nov. 29, 2018

Related U.S. Application Data

(63) Continuation-in-part of application No. 15/484,352, filed on Apr. 11, 2017, now Pat. No. 10,376,851, (Continued)

(30) Foreign Application Priority Data

Jun. 16, 2008 (JP) ..... 2008-157237
Oct. 22, 2008 (JP) ..... 2008-272394
(Continued)

(51) Int. Cl.
*B01F 5/00* (2006.01)
*B01F 5/06* (2006.01)
(Continued)

(52) U.S. Cl.
CPC ..... *B01F 5/0604* (2013.01); *B01F 5/0688* (2013.01); *B01F 5/0694* (2013.01);
(Continued)

(58) Field of Classification Search
CPC .. B01F 5/00; B01F 5/06–0604; B01F 5/0682; B01F 5/0687; B01F 5/0688;
(Continued)

(56) References Cited

U.S. PATENT DOCUMENTS 6,568,845 B1 * 5/2003 Harada ..... B01F 5/0603 366/340
8,715,585 B2 * 5/2014 Mochizuki ..... B01F 5/0604 422/225
9,656,223 B2 * 5/2017 Mochizuki ..... B01F 5/12

FOREIGN PATENT DOCUMENTS

JP 10216495 A * 8/1998
JP 10314563 A * 12/1998 ..... B01F 5/0682
(Continued)

OTHER PUBLICATIONS

Machine translation of JP 11-114396 A, which was published Jun. 1999. (Year: 1999).*
(Continued)

*Primary Examiner* — Natasha E Young
(74) *Attorney, Agent, or Firm* — Nakanishi IP Associates, LLC

(57) ABSTRACT

A mixing unit includes a mixing body having mixing elements that are stacked in a stacking direction and that extend in an extending direction in which the extending direction is perpendicular to the stacking direction. The mixing elements have a plurality of through holes to form a flow path therein, and are arranged such that part or all of the through holes in one of the mixing elements communicate with through holes in the adjacent mixing elements to allow fluid to be passed in the extending direction in which the mixing elements extend. The mixing unit may be employed in an agitation impeller or an adhesive dispensing unit.

20 Claims, 59 Drawing Sheets

Related U.S. Application Data which is a continuation-in-part of application No. 14/203,188, filed on Mar. 10, 2014, now Pat. No. 9,656,223, which is a continuation-in-part of application No. PCT/JP2013/056439, filed on Mar. 8, 2013, said application No. 15/484,352 is a continuation-in-part of application No. 14/203,188, filed on Mar. 10, 2014, now Pat. No. 9,656,223, which is a continuation-in-part of application No. 12/999,102, filed as application No. PCT/JP2009/060922 on Jun. 16, 2009, now Pat. No. 8,715,585.

(60) Provisional application No. 61/610,290, filed on Mar. 13, 2012.

(30) Foreign Application Priority Data

| | | |
|---|---|---|
| Feb. 27, 2009 | (JP) | 2009-045414 |
| Jun. 2, 2009 | (JP) | 2009-132802 |
| Apr. 18, 2018 | (JP) | 2018-079584 |

(51) Int. Cl.

| | |
|---|---|
| ***B01F 5/10*** | (2006.01) |
| ***B01F 5/12*** | (2006.01) |
| ***B01F 7/00*** | (2006.01) |
| ***B01F 7/16*** | (2006.01) |

(52) U.S. Cl.

CPC ..... *B01F 5/104* (2013.01); *B01F 5/12* (2013.01); *B01F 7/0035* (2013.01); *B01F 7/00241* (2013.01); *B01F 7/00458* (2013.01); *B01F 7/00491* (2013.01); *B01F 7/00633* (2013.01); *B01F 7/1625* (2013.01); *B01F 2215/0036* (2013.01); *Y10T 29/49885* (2015.01)

(58) Field of Classification Search

CPC ..... B01F 5/0693; B01F 5/0694; B01F 5/10; B01F 5/104; B01F 5/12; B01F 7/00; B01F 7/002; B01F 7/00233; B01F 7/00241; B01F 7/025; B01F 7/00341; B01F 7/0035; B01F 7/0045; B01F 7/00458; B01F 7/00491; B01F 7/00625; B01F 7/00633; B01F 7/16; B01F 7/1625; B01F 2215/00; B01F 2215/0001; B01F 2215/0036

See application file for complete search history.

(56) References Cited

FOREIGN PATENT DOCUMENTS

| | | | |
|---|---|---|---|
| JP | 11009980 A | * | 1/1999 |
| JP | 11114396 A | * | 4/1999 |

OTHER PUBLICATIONS

Machine translation of JP 11-009980 A, which was published Jan. 1999. (Year: 1999).*

Machine translation of JP 10-216495 A, which was published Aug. 1998. (Year: 1998).*

* cited by examiner

MIXING UNIT AND DEVICE, AND FLUID MIXING METHOD

This application is a continuation-in-part application of Ser. No. 15/484,352 (filed on Apr. 11, 2017) which is a continuation-in-part application of Ser. No. 14/203,118 (filed on Mar. 10, 2014 and now issued as U.S. Pat. No. 9,656,223) which is a continuation-in-part application of Ser. No. 12/999,102 (filed on Dec. 15, 2010 and now issued as U.S. Pat. No. 8,715,585), which claims the benefit of priority from International Patent Application No. PCT/JP2009/060922 (filed on Jun. 16, 2009) which further claims the benefit of priority from Japanese Patent Application Nos. 2009-132802 (filed on Jun. 2, 2009), 2009-045414 (filed on Feb. 27, 2009), 2008-272394 (filed on Oct. 22, 2008), and 2008-157237 (filed on Jun. 16, 2008).

Also, the application Ser. No. 14/203,188 is a continuation-in-part application of International Patent Application No. PCT/JP2013/056439 (filed on Mar. 8, 2013), which claims the benefit of priority from U.S. Provisional Application No. 61/610,290 (filed on Mar. 13, 2012 and now abandoned).

This application claims the benefit of priority from Japanese Patent Application No. 2018-079584 (filed on Apr. 18, 2018).

The entire contents of the above applications, which the present application is based on, are incorporated herein by reference.

BACKGROUND OF THE INVENTION

1. Field of the Invention

The present invention relates to a mixing unit for mixing a fluid such as a liquid or a gas and a device using such a mixing unit, and, more particularly, relates to a mixing unit that can be suitably utilized for static mixing where a fluid is mixed by being passed, dynamic mixing where a fluid is mixed by rotation within the fluid, and to a device and a method using such a mixing unit.

2. Description of the Related Art

As a static mixing device for mixing a fluid, a Kenics-type static mixer or the like is widely used. Since this type of static mixing device generally does not include a movable component, the static mixing device is widely used in fields, such as the chemical industry and the food industry, in which fluids are required to be mixed in piping. On the other hand, as a dynamic mixing device, a product is widely used in which an agitation impeller is provided in a fluid within an agitation vessel and which rotates the agitation impeller to mix the fluid.

As a conventional static fluid mixing device, there is a static fluid mixing device which includes a tubular case body and a plurality of types of disc-shaped elements where a plurality of holes are drilled a predetermined space apart within the tubular case body, and in which the elements are sequentially combined in the direction of thickness thereof, are fitted and are fixed with connection hardware.

In the fluid mixing device described above, a plurality of types of elements are sequentially combined, and thus static mixing agitation caused by the division and combination of a fluid is performed, and mixing agitation is also performed such as by eddies and disturbance resulting from enlarged and reduced cross sections and shearing stress.

However, in the fluid mixing device described above, since the direction from the inlet to the outlet of the mixing device is the same as the direction of the division and aggregation of the fluid, its static mixing effect is low.

Although the cross sections of holes are enlarged and reduced to increase its flow resistance and thus the mixing effect is improved, the loss of pressure in the entire device is increased. Since the holes are trapezoidal and have a flow reduction portion, it is difficult to process the holes.

As a conventional agitation device for dynamic mixing, there is an agitation device in which a propeller-like agitation blade provided on a rotation shaft and a plate-like auxiliary blade provided below the agitation blade. In the conventional agitation device, if only one auxiliary blade is provided, or in the case where a plurality of auxiliary blades are provided, at least one auxiliary blade is disposed so that the center angle is shifted from the equiangular position, or is formed in a shorter than the other auxiliary blade, whereby a low speed region formed at a bottom of an agitation vessel is not staid in the same region and the adhesion of an object to be agitated to the bottom part of the agitation vessel is suppressed.

According to the conventional agitation device, however, although the position of the low speed region at the bottom of the agitation vessel can be displaced from the center by the auxiliary blade and particles are liable to accumulate in the low speed region, the propeller-like agitation blade or the plate-like auxiliary blade roles up the particles accumulated in the low-speed region in the liquid and has been difficult to highly mix the fluid.

As a conventional adhesive dispensing unit for mixing fluids and dispensing the mixed fluid, there is a dispensing unit having a storage container for storing a main agent and a curing agent of a two-component curing type adhesive, a nozzle in which mixing blades are disposed, an extruder for extruding the main agent and the curing agent from the storage container to the nozzle, and an operating lever for driving the extruder. When an operator operates the operating lever, the main agent and the curing agent pass through the mixing blades in the nozzle from the storage container to be mixed, and are dispensed from a tip portion of the nozzle.

In the conventional adhesive dispensing unit, the mixing blades are formed such that spirally twisted blades are continuously formed while changing the twist direction of the blades. The mixing blades mix a liquid (fluid) such as a main agent and a curing agent by spirally flowing the liquid. In the case of the two-component curing type adhesive, even if the main agent and the curing agent are mixed at a predetermined ratio, if the mixing is insufficient, appropriate adhesive strength may not be obtained in some cases. Therefore, it is necessary to form the mixing blades long in order to sufficiently mix the liquid, and the nozzles in which the long mixing blades are arranged are also necessary to be long. If the nozzle becomes long, it becomes difficult to position the nozzle with respect to the object to be ejected and to operate making coating. In addition, the amount of fluid remaining in the nozzle to be discarded after application and use is liable to be large, which wastefully consumes the fluid. Further, due to the long nozzle, the total length of the adhesive dispensing unit also becomes long, and also handling of the adhesive dispensing unit is inconvenient.

SUMMARY OF THE INVENTION

One or more embodiments of the present invention provides a mixing unit or device, an agitation impeller, or an adhesive dispensing unit using such a mixing unit, which has a simple structure and is easy to be made, applicable to versatile use according to desired mixing degrees.

According to one or more embodiments of the present invention, there is provided a mixing unit including a mixing body having a plurality of mixing elements that are stacked are stacked in a stacking direction and that extend in an extending direction; wherein the mixing elements include a plurality of through holes to form a flow path therein and are arranged such that part or all of the through holes in one of the mixing elements, whose upper surface is in contact with another mixing element and whose lower surface is in contact with another mixing element, communicate with through holes in the adjacent mixing elements to allow fluid to be passed and divided in the extending direction in which the mixing elements extend; and wherein the extending direction is perpendicular to the stacking direction.

According to one or more embodiments of the present invention, there is provided an agitation impeller including the mixing unit having a plurality of mixing elements, wherein one of through holes of each of the mixing elements constitutes a hollow portion by stacking the mixing elements, the mixing unit is connected to a rotation shaft and provided with a suction port and a discharge port for a fluid, the flow path is connected with the suction port and the discharge port through the hollow portion within the mixing unit, the suction port is disposed at a position on a rotation axis of the rotation shaft or at a position close to the rotation axis, and the discharge port is disposed at a position more outside than the suction port relative to the rotation axis.

According to one or more embodiments of the present invention, there is provided an agitation impeller including a mixing unit connected to a rotation shaft provided with a suction port and a discharge port for a fluid, wherein a flow path connecting the suction port and the discharge port is provided within the mixing unit, the suction port is disposed at a position on a rotation axis of the rotation shaft or at a position close to the rotation axis, and the discharge port is disposed at a position more outside than the suction port relative to the rotation axis, and a nozzle for sucking the fluid is disposed at the suction port.

According to one or more embodiments of the present invention, there is provided a method for agitating a fluid by the agitation impeller including the steps of: flowing out the fluid within the mixing unit from the discharge port to outside of the mixing unit by rotational motion of the agitation impeller to generate a suction force at the suction port, and sucking the fluid outside the mixing unit from the suction port to flow the fluid into the mixing unit.

According to one or more embodiments of the present invention, there is provided an adhesive dispensing unit including the mixing unit including a storage container in which two or more kinds of fluids are stored, and a nozzle for dispensing a mixed fluid of the two or more kinds of fluids supplied from the storage container, wherein the mixing unit is disposed to mix the two or more kinds of fluids supplied from the storage container disposed in the nozzle.

According to one or more embodiments of the present invention, there is provided a method for dispensing a fluid by the adhesive dispensing unit including the steps of accommodating two or more kinds of fluids in the storage container, simultaneously supplying the two or more types of fluids from the storage container into the nozzle, mixing the two or more kinds of fluids with a mixing unit within the nozzle, and dispensing a mixed fluid obtained by mixing the two or more fluids from the nozzle.

DETAILED DESCRIPTION

Embodiments of the present invention will be described below with reference to the drawings. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

First Embodiment

Returning to FIG. 1 there is shown an exploded perspective view of a cylindrical-shaped mixing unit 1*a* in accordance with a first embodiment of the present invention. Mixing unit 1*a* includes a mixing body or staked member 2 having a plurality of mixing elements 21 (21*a* and 21*b*; here exemplary, three mixing elements) which are alternately stacked, a first plate 3 serving as a first layer, and a second plate 4 serving as a second layer. FIG. 2 is a plan view showing two types of mixing elements 21*a* and 21*b* (exemplary, a pair of mixing elements) of mixing unit 1*a* and a state of mixing elements 21*a* and 21*b* stacked. FIG. 3A is a partial plan view of the mixing elements (exemplary, three mixing elements) and FIG. 3B is a cross-sectional view showing a state of flow of a fluid A within mixing unit 1*a*.

Figure 1:
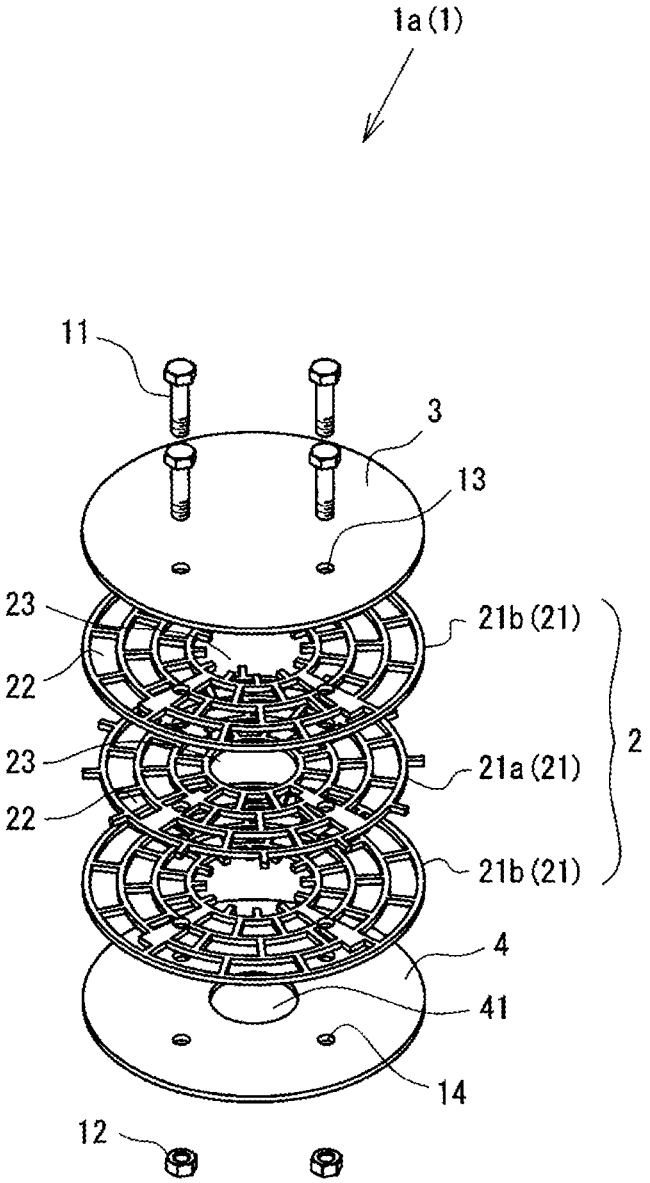
FIG. 1 is an exploded perspective view of a mixing unit in accordance with a first embodiment of the present invention.
Figure 2:
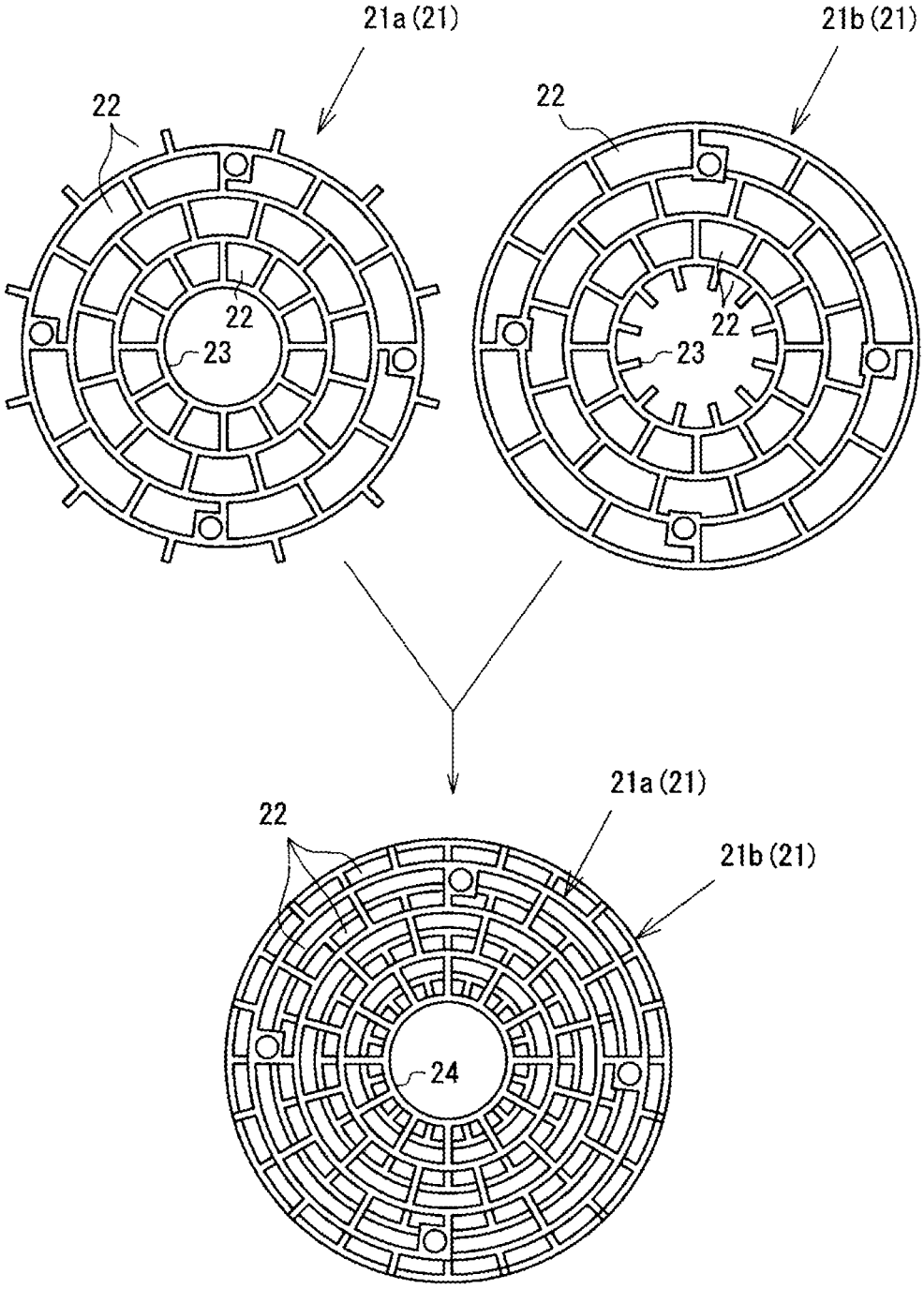
FIG. 2 is a plan view of mixing elements employed by the mixing unit of FIG. 1.
Figure 3A:
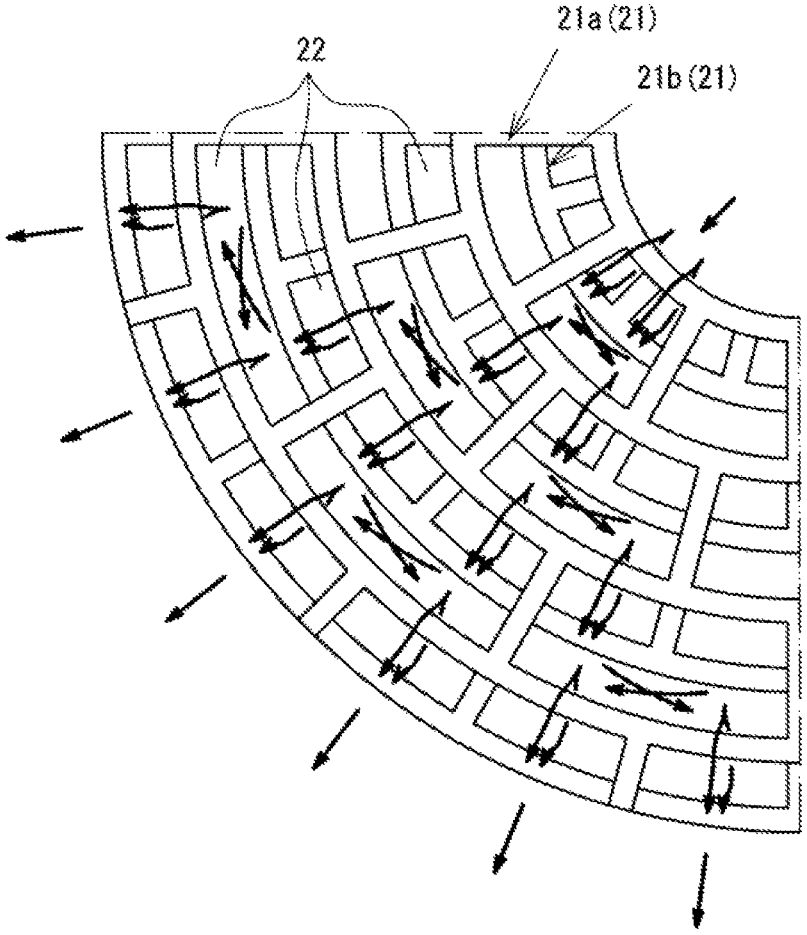
FIG. 3A is a partial plan view of the mixing elements and FIG. 3B is a cross-sectional view showing a state of flow of a fluid within the mixing unit of FIG. 1.
Figure 3B:
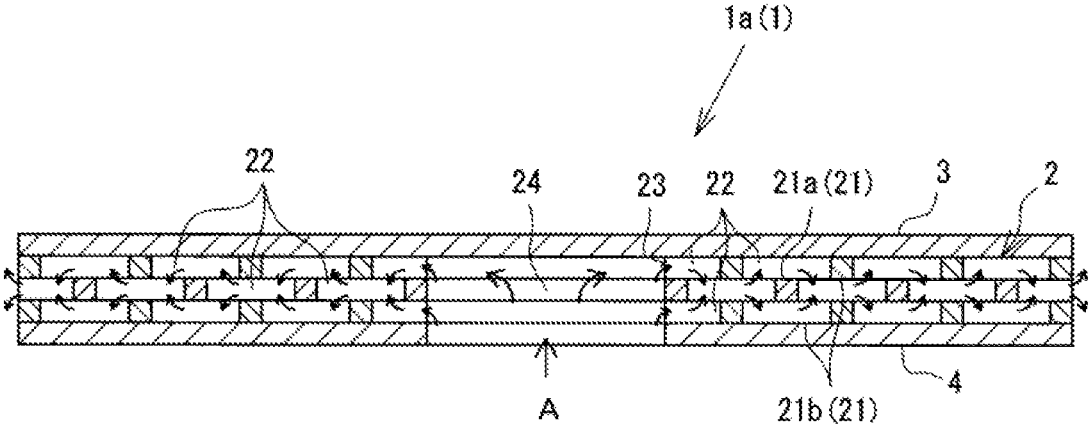

As shown in FIGS. 1 and 2, mixing unit 1*a* is configured by sandwiching a mixing body 2, in which a plurality of two types of disc-shaped mixing elements 21*a* and 21*b* are alternately stacked, between first plate 3 and second plate 4, for example, fixed with four bolts 11 and nuts 12 appropriately arranged. Although here, three mixing elements are stacked, according to one or more embodiments of the present invention, more than three mixing elements may be employed. Mixing elements 21*a* and 21*b* and first and second plates 3 and 4 can be separated from each other; thus, mixing unit 1*a* may be disassembled.

First plate 3 is a disc that has holes 13 for the bolts and no other holes. Second plate 4 has not only holes 14 for the bolts but also a circular opening portion 41, in a center portion, through which fluid A flows in and out as shown in FIG. 3B. First plate 3 and second plate 4 are substantially equal in outside diameter to mixing elements 21*a* and 21*b*. An outside shape of first plate 3 is larger than opening portion 41 of second plate 4.

The two types of mixing elements 21*a* and 21*b* each have a plurality of first through holes 22 penetrating in the direction of thickness thereof. In other words, a plurality of first through holes are provided along an extending surface that extends in a direction in which mixing elements 21*a* and 21*b* extend. Moreover, the two types of mixing elements 21*a* and 21*b* each has substantially circular second through holes 23 in the center portion. Second through hole 23 is substantially equal in inside diameter to and is substantially concentric with opening portion 41 of second plate 4. As mixing elements 21*a* and 21*b* are stacked, the second through holes 23 form a hollow portion 24.

Each of the first through holes 22 is substantially rectangular as seen in plan view, and is arranged concentrically with respect to the center of the second through hole 23. The first through holes 22 are staggered; the two types of mixing elements 21*a* and 21*b* differ from each other in the arrangement pattern of the first through holes 22 itself.

First through holes 22 of mixing elements 21*b* and 21*c* are partially displaced and overlapped in a radial direction and in a circumferential direction, and communicate with each other in the direction in which mixing elements 21*b* and 21*c* extend. In other words, among partition walls between first through holes 22, the partition walls that extend in a direction intersecting the direction in which mixing elements 21*a* and 21*b* extend are displaced between their adjacent mixing elements, and are arranged such that a fluid may be sequentially passed through first through holes 22 of the adjacent mixing elements 21*a* and 21*b* in the direction in which mixing elements 21*a* and 21*b* extend.

As shown in FIG. 2, on one hand, in mixing element 21*a*, first through holes 22 arranged along the inner circumferential surface are not open, and on the other hand, in mixing elements 21*b*, first through holes 22 in the inner circumferential surface are open. The size of and the pitch between first through holes 22 are increased as first through holes 22 extend outward in the radial direction. Furthermore, in the state where mixing elements 21*a* and 21*b* are stacked, the areas in which first through holes 22 overlap each other are equal to each other in the circumferential direction.

The mixing body 2 is formed by stacking the mixing elements 21*a* and 21*b* described above.

As shown in FIG. 3B, first through holes 22 of mixing elements 21*a* and 21*b* on both ends of mixing body 2 are closed, in the direction in which they are stacked, by the first plate 3 and the second plate 4 arranged opposite each other on both ends of the mixing body 2 in the stacking direction. In other words, first through holes 22 are blocked. Hence, fluid A within mixing body 2 is prevented from flowing from first through holes 22 of mixing elements 21*a* on both ends of mixing body 2 in the direction in which mixing elements 21*a* and 21*b* are stacked, and is, as shown in FIG. 3A, reliably passed within mixing body 2 in the direction in which mixing elements 21*a* and 21*b* extend. Thus, the direction in which mixing elements 21*a* and 21*b* are stacked is designed to cross the direction in which mixing elements 21*a* and 21*b* extend.

Therefore, fluid A is passed within mixing unit 1*a* from the inner circumferential portion to the outer circumferential portion or vise verse, that is, from the outer circumferential portion to the inner circumferential portion. As described above, a plurality of first through holes 22 are formed to communicate with each other such that fluid A may be passed between first through holes 22 in the direction in which mixing elements 21*a* and 21*b* extend.

In mixing unit 1*a* described above, for example, fluid A flows through the opening portion 41 of the second plate 4 into the hollow portion 24 with appropriate pressure applied by an external pressurizer (not shown in drawings), and then fluid A flows into mixing body 2 through first through holes 22 of mixing elements 21*a* and 21*b* which are open to the inner circumferential surface of the hollow portion 24. Then, fluid A is passed through other first through holes 22 that communicate with the above-mentioned first through holes 22, and is further passed through first through holes 22 that communicate with the above-mentioned other first through holes 22 whereby the division and combination of fluid A may be performed planarly. Finally, fluid A flows out of mixing body 2 through first through holes 22 of mixing elements 21*a* and 21*b* which are open to the outer circumferential surface of mixing body 2.

As described above, fluid A within mixing body 2 substantially radially flows through first through holes 22 communicating with each other within mixing body 2 from the inner circumferential portion to the outer circumferential portion.

A plurality of layers of flow paths along which fluid A flows are provided in the direction in which mixing elements 21*a* and 21*b* are stacked; in the example of FIG. 3B, two layers are provided. Since a plurality of flow paths that divide fluid A in the direction in which mixing elements 21*a* and 21*b* are stacked are provided, when fluid A passes through first through holes 22, as shown in FIG. 3B, fluid A is divided in the direction in which mixing elements 21*a* and 21*b* are stacked, and is thereafter combined (or joined). In other words, the flow of fluid A is performed not only two-dimensionally in the radial direction such that the division and combination are performed planarly but also three-dimensionally while extending in the direction in which mixing elements 21*a* and 21*b* are stacked.

While the flow described above is performed, fluid A is mixed by repeating dispersion, combination, reversal, turbulent flow, eddying flow, collision and the like.

Since first through holes 22 of mixing elements 21*a* and 21*b* are staggered, when the fluid flows from the above-mentioned first through holes 22 to other first through holes 22 on the upper and lower surfaces, the flow is easily divided or easily combined, and thus the fluid is efficiently mixed.

On the contrary to what has been described above, fluid A may be made to flow in through the outer circumferential portion of mixing body 2 of mixing elements 21*a* and 21*b* and flow out through the inner circumferential portion.

Hollow portion 24 is sufficiently larger in size than first through holes 22; second through holes 23 of mixing elements 21*a* and 21*b* constituting hollow portion 24 are substantially equal in inside diameter to each other, and are substantially concentric with each other. Hence, the flow resistance to fluid A flowing through hollow portion 24 is smaller than that of fluid A flowing within mixing body 2, and the loss of pressure is also smaller. Therefore, even when a large number of mixing elements 21*a* and 21*b* are stacked, fluid A substantially uniformly reaches the inner circumferential portion of mixing elements 21*a* and 21*b* regardless of the position in the direction which mixing elements 21*a* and 21*b* are stacked, and substantially uniformly flows within mixing body 2 from the inner circumferential portion to the outer circumferential portion.

Since hollow portion 24 is provided, as compared with a case where there is no hollow portion 24, the fluid is more likely to enter mixing unit 1*a* and to be passed to first through holes 22. Likewise, the fluid entering mixing unit 1*a* through the outer circumferential side thereof and passing through first through holes 22 is made to smoothly flow out without being disturbed. If desired, hollow portion 24 in size may be same as or smaller than first through holes 22, or second through holes 23 constituting hollow portion 24 may be different in inside diameter to each other.

In first through holes 22 of mixing element 21*a* whose upper surface and lower surface are in contact with other mixing elements 21*b* respectively within mixing unit 1*a*, since fluid A flows out from the above-mentioned first through holes 22 to the above-mentioned other first through holes 22 on the upper and lower surfaces, fluid A is dispersed through the above-mentioned other first through holes 22 on the upper and lower surfaces. Moreover, since fluid A flows in from the above-mentioned other first through holes 22 on the upper and lower surfaces to the above-mentioned first through holes 22, fluid A from the above-mentioned other first through holes 22 on the upper and lower surfaces is combined. Therefore, significant mixing effects are acquired and fluid A is mixed.

In particular, when the flow rate is increased and thus the flow state is transferred to the turbulent flow, the effects of the turbulent flow and the eddying flow are increased, and thus the mixing effects of the fluid resulting from the dispersion and the combination described above are further increased. Even when the flow rate is low and thus the flow state is a laminar flow, the fluid is dispersed toward the upper and lower surfaces and is combined, with the result that the fluid is mixed.

Since first through holes 22 on both end surfaces in the stacking direction of mixing body 2 are blocked by the removable first plate 3 and second plate 4, it is possible to separately produce the individual members. For example, it is possible to produce a large number of mixing elements 21*a* and 21*b* for a short period of time by punching holes in a metal plate having a given thickness or the like. Hence, it is possible to easily and inexpensively produce mixing unit 1*a*.

Since mixing elements 21*a* and 21*b* and first plate 3 and second plate 4 may be divided into individual pieces, it is possible to easily perform a washing operation such as the removal of stuff and foreign matter left in first through holes 22 of mixing elements 21*a* and 21*b*. Since the first through holes are holes that penetrate in the direction of thickness, it is easy to clean first through holes 22 by the washing operation.

Since mixing elements 21*a* and 21*b*, first plate 3 and the second plate 4 have simple structures and may be made by plates or layers, it is possible to produce them with any applicable material such as ceramic, resins or the like. Thus, it is possible to apply mixing unit 1*a* to applications in which corrosion resistance and heat resistance are required, and to produce the mixing unit forming a single unit by 3D-printing.

Moreover, when first plate 3 and second plate 4 are appropriately held, it is possible to freely apply mixing unit 1*a* to various portions. Thus, it is possible to apply mixing unit 1*a* to various devices, and it is therefore possible to widely utilize its high mixing capability.

Thus, according to this first embodiment, there is provided a mixing unit including a mixing body including mixing elements that are stacked in a stacking direction and that extend in an extending direction; wherein the mixing elements have a plurality of first through holes to form a flow path therein, and the mixing elements are arranged such that part or all of the first through holes in one of the mixing elements, whose upper surface is in contact with another mixing element and whose lower surface is in contact with another mixing element, communicate with first through holes in the adjacent mixing elements to allow fluid to be passed in the extending direction in which the mixing element extends and to be divided as the fluid passes into the mixing elements.

Further there are provided a first layer and a second layer disposed opposite the first layer, wherein the mixing body is sandwiched between the first layer and the second layer. Though the first and second layers are respectively represented by first plate 3 and second plate 4, they may be any layers made of any applicable materials including sealant.

Second Embodiment

Figure 4A:
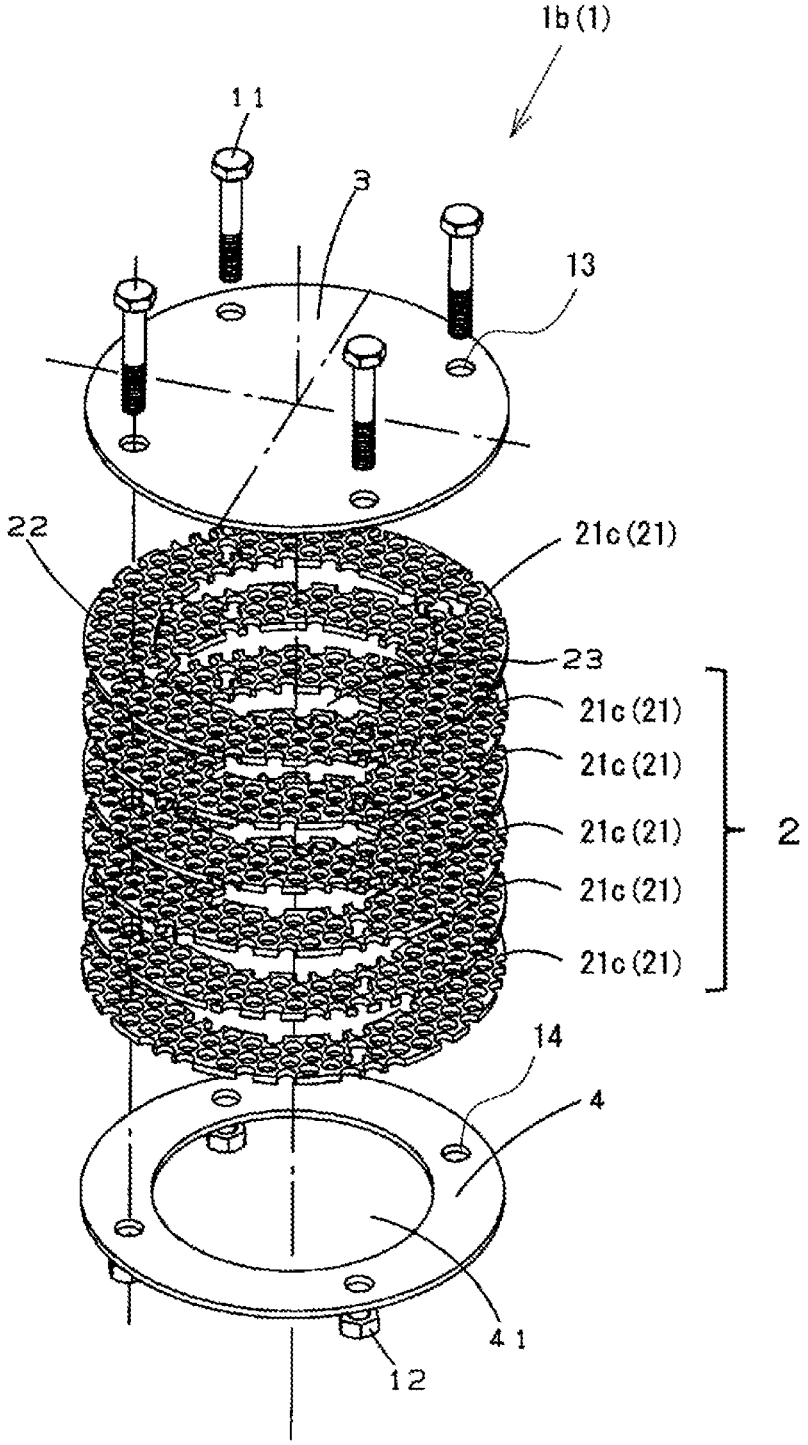
FIG. 4A is an exploded perspective view of a mixing unit in accordance with a second embodiment of the present invention.
Figure 4B:
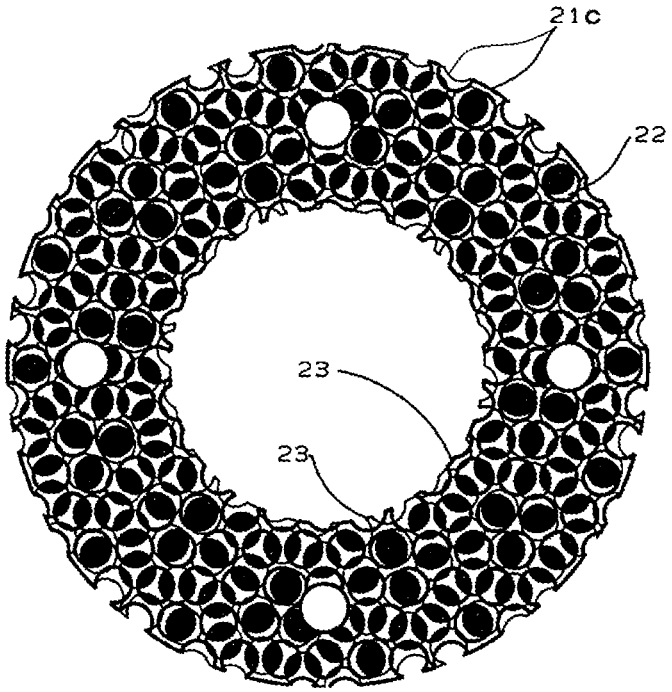
FIG. 4B is a plan view of mixing elements which are stacked to constitute the mixing unit of FIG. 4A.

FIG. 4A is an exploded perspective view of a mixing unit 1*b* including a plurality of mixing elements 21*c* which are designed to be stacked to constitute a mixing body 2 in which each mixing elements 21*c* has first through holes 22 and a second through hole 23 in its center portion in accordance with a second embodiment of the present invention. Mixing unit 1*b* further includes a first plate 3 and a second plate 4 having a circular opening portion 41 in a center portion between which mixing body 2 is sandwiched. FIG. 4B is a plan view of mixing elements 21*c* which are stacked to constitute mixing unit 1*b* of FIG. 4A and shows the overlapping of first through holes 22 in a stacked state of mixing elements 21*c* adjacent to the mixing element 21*c* in the direction in which mixing elements 21*c* are stacked. In FIG. 4B, in order for the overlapping of first through holes 22 to be clearly shown, the portions where first through holes 22 overlap each other are filled with black.

Mixing unit 1*b* of this second embodiment differs from mixing unit 1*a* of the first embodiment in that first through holes 22 are formed to be circular as seen in plan view and that the number of mixing elements 21*c* is changed from three to six. The inside diameter and the pitch of first through holes 22 are substantially equal to each other. As shown in FIG. 4B, parts of first through holes 22 are arranged such that they are displaced with respect to first through holes 22 of mixing elements 21*c* adjacent to each other and are partially overlapped, and spaces formed with first through holes 22 are made to communicate with each other in the direction in which mixing elements 21*c* extend.

Among first through holes 22, first through holes 22 on the inner circumferential edge are open to the inner circumferential surface of mixing elements 21*c*, and first through holes 22 on the outer circumferential edge are open to the outer circumferential surface of mixing elements 21*c*.

Even with the mixing unit 1*b* configured described above, fluid A made to flow into the mixing unit 1*b* with appropriate pressure flows into mixing body 2 through opening portion 41 of second plate 4 and first through holes 22 open to the inner circumferential surface of mixing elements 21*c*. Then, while fluid A is being passed radially within mixing body 2, fluid A is passed through first through holes 22 communicating with mixing elements 21*c*, with the result that fluid A is mixed.

In particular, since a larger number of mixing elements 21*c* are provided than three, a larger number of flow paths extending in the direction in which mixing elements 21*c* extend are provided than the two layers. Hence, a large number of flow paths that divide the fluid in the direction in which mixing elements 21*c* are stacked are obtained in the stacking direction, and the division and combination of fluid A is three-dimensionally performed in a wide area in the direction in which mixing elements 21*c* are stacked. Consequently, it is possible to obtain higher mixing effects. It is also possible to reduce the loss of pressure.

The other parts of the configuration of and the other effects of the mixing unit 1*b* of the second embodiment are the same as those of mixing unit 1*a* of the first embodiment.

Third Embodiment

Figure 5A:
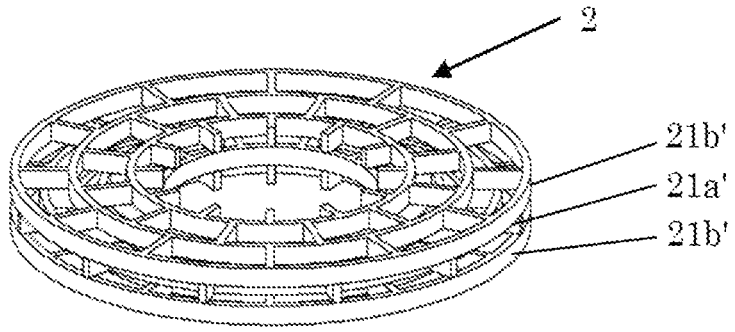
FIG. 5A is a perspective view of a mixing body in accordance with a third embodiment of the present invention.

FIG. 5A is a perspective view of a mixing body 2 in accordance with a third embodiment of the present invention, which may be employed in mixing unit 1*a* of FIG. 1 instead of mixing body 2. Mixing body 2 includes three layered portions 21*a*' and 21*b*' corresponding to mixing elements 21*a* and 21*b*, and has the same external configuration as that of mixing body 2 as shown in FIG. 3B to provide the same flow condition of fluid A in mixing body 2. Mixing body 2 is formed as a single member by 3D printing. Mixing body 2 with two layered portions with 21*a*' and 21*b*' is formed as a single member by die casting or 3D printing.

Figure 5B:
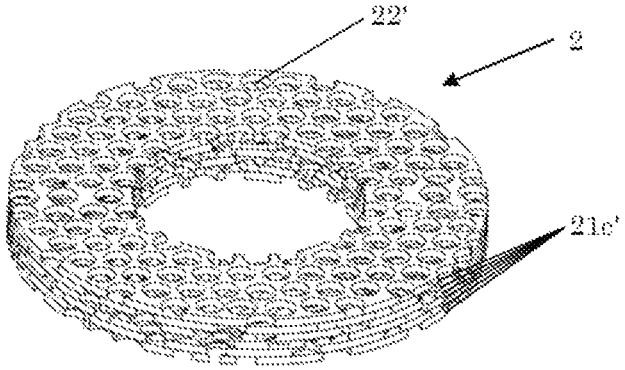
FIG. 5B a perspective view of a mixing body as one of modifications of the third embodiment.

FIG. 5B is a perspective view of a mixing body 2 which may be employed in mixing unit 1*b* of FIG. 4A instead of mixing body 2 as one of modifications of the third embodiment of the present invention. Mixing body 2 includes six layered portions each having different pattern of first through holes 22', which correspond to mixing elements 21*c* of FIG. 4A. First through holes 22' communicate in a direction crossing the extending direction with in random fashion, whereby fluid may be divided and combined in plural directions. Mixing body 2 is formed as a single member by 3D printing. If desired, first through holes 22' may be formed in a random fashion to provide a porous body.

Figure 5C:
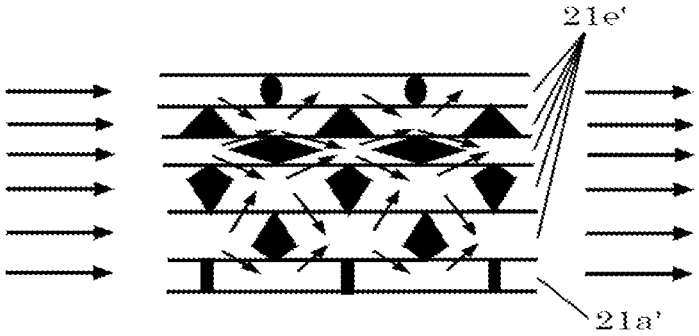
FIG. 5C is a partial schematic sectional view of a mixing unit as another modification of the third embodiment.

FIG. 5C is a partial schematic sectional view of a mixing unit employing opposing layers guiding fluid within a mixing body including a different pattern of layered portions 21*a*' (21*b*') and 21*e*' (21*f*') which correspond to mixing elements as shown in FIGS. 2, 16, 17 and 19 as another modification of the third embodiment. According to the mixing body of FIG. 5C, a fluid within the mixing body may be guided in favorite plural directions in which the fluid is divided and combined in accordance with the material of fluid. If desired, the mixing body may be formed by 3D printing.

In the third embodiment, the mixing body may provide division and combination of a fluid within the mixing body in three-dimensional plural directions. If desired, the mixing body of the third embodiment may be formed by die casting, 3D printing or other conventional way. Further, the mixing body may be employed in the mixing bodies as explained in other embodiments.

Fourth Embodiment

Figure 6A:
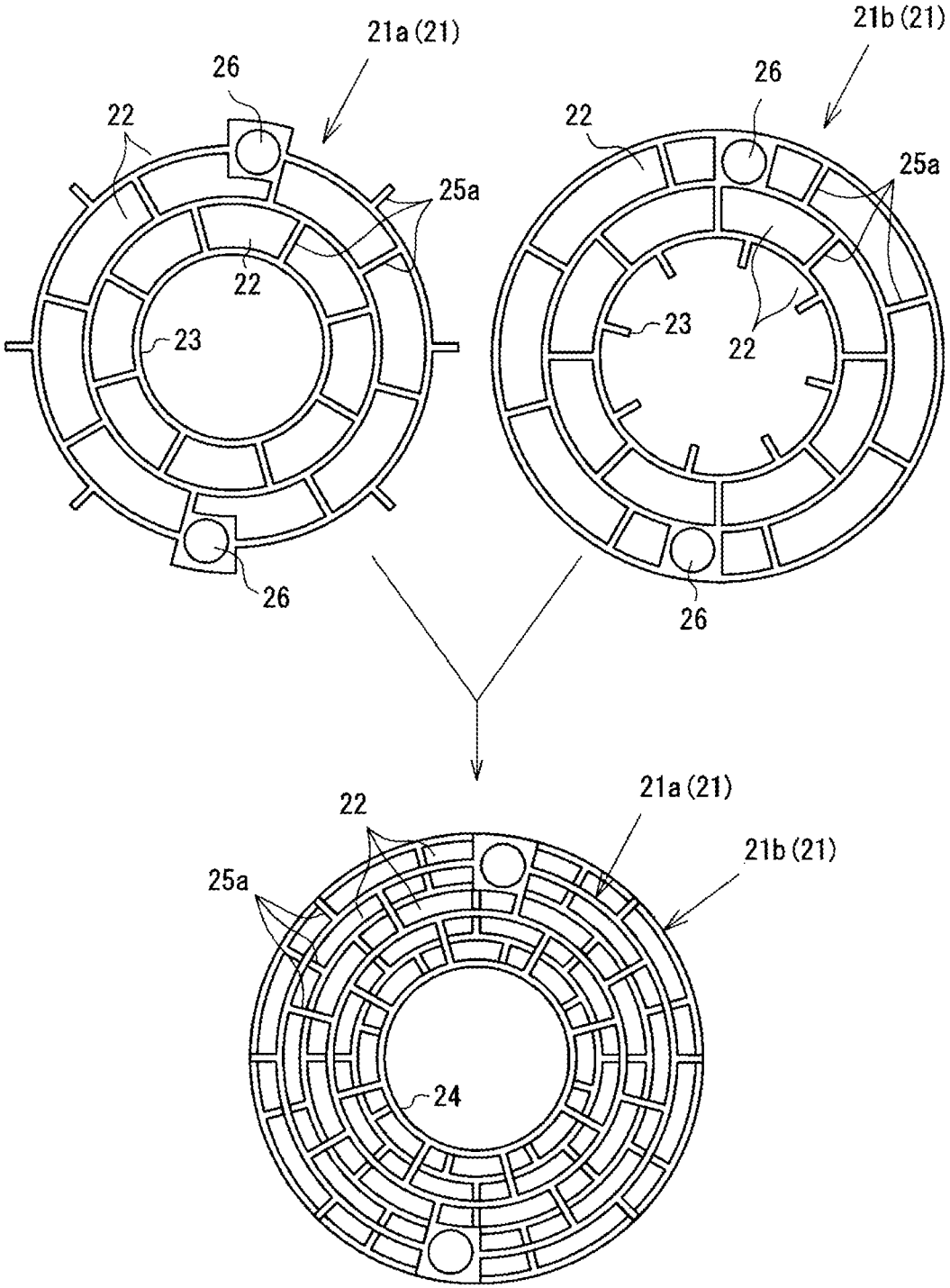
FIG. 6A is a plan view of mixing elements to constitute a mixing body in accordance with a fourth embodiment of the present invention.
Figure 6B:
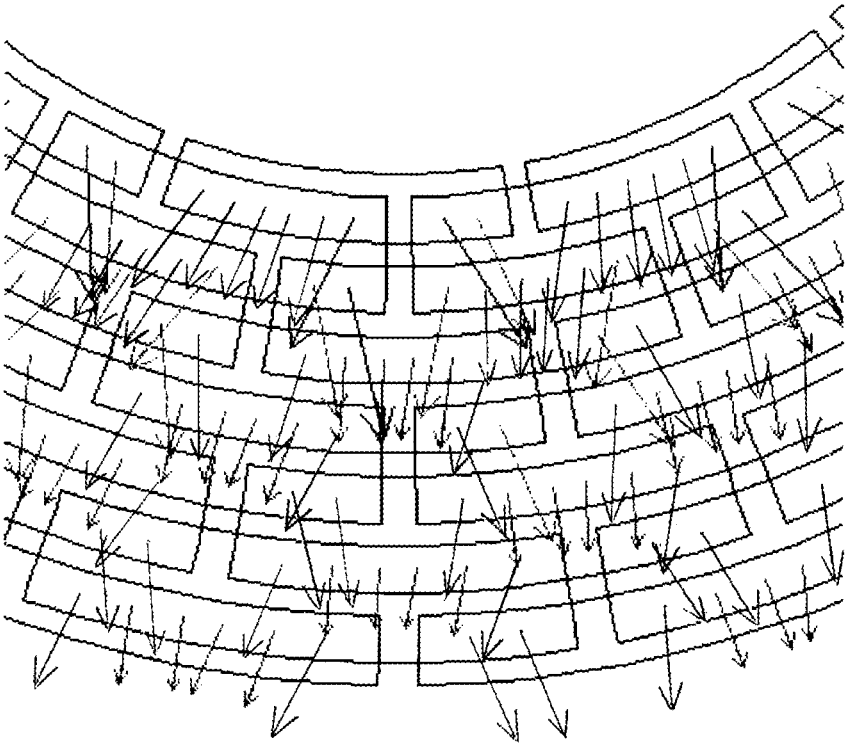
FIG. 6B is a partial plan view of the mixing elements stacked for showing a state of flow of the fluid within the mixing unit a computer analysis result.

FIG. 6A is a plan view of mixing elements 21*a* and 21*b* to constitute a mixing body and further a mixing unit in a similar manner as shown in FIG. 1 or 2 in accordance with a fourth embodiment of the present invention, and FIG. 6B is a partial plan view of mixing elements 21*a* and 21*b* stacked for showing a state of flow of the fluid within the mixing unit by a computer analysis result. Mixing elements 21*a* and 21*b* of this fourth embodiment differ from mixing elements 21*a* and 21*b* of the first embodiment in that, in the state of the two types of mixing elements 21*a* and 21*b* stacked, the area of a certain portion where first through holes 22 overlap each other is not equal in the circumferential direction to the area of another portion adjacent to the above-mentioned portion. According to one or more embodiments of the present invention, mixing elements 21*a* and 21*b* have substantially same external or internal configurations, but may have different diameters. That is, according to one or more embodiments of the present invention, the diameter of mixing element 21*a* may be smaller than the diameter of mixing element 21*b*, or vice versa.

In order to realize the configuration described above, the two types of mixing elements 21*a* and 21*b* are configured such that, among the partition walls between first through holes 22, partition walls 25*a* extending in the radial direction are arranged at different angles with respect to an imaginary straight line passing through the center of mixing elements 21*a* and 21*b* and connecting bolt holes 26.

Even with the mixing unit including mixing elements 21*a* and 21*b* described above, the fluid is highly mixed as described above; in this case, in particular, the fluid passing through first through holes 22 is unevenly divided in the circumferential direction. Consequently, it is possible to further enhance the mixing efficiency.

FIG. 6B is a result obtained by analyzing, with a computer, a state of flow a fluid when the areas where first through holes 22 overlap each other are uneven in the circumferential direction (the structure in the fourth embodiment). As shown in FIG. 6B, it is found that the unevenness of the areas produces various types of flow of the fluid.

The other parts of the configuration of and the other effects of the mixing unit of this fourth embodiment are the same as those of mixing unit 1*a* of the first embodiment. According to this fourth embodiment, there may be provided a mixing body or a mixing unit including the mixing elements, wherein the mixing elements are arranged such that the first through hole in the one of the mixing elements overlaps the first through hole in the adjacent one of the mixing elements to allow the fluid to be unevenly divided in the extending direction.

Fifth Embodiment

Figure 7:
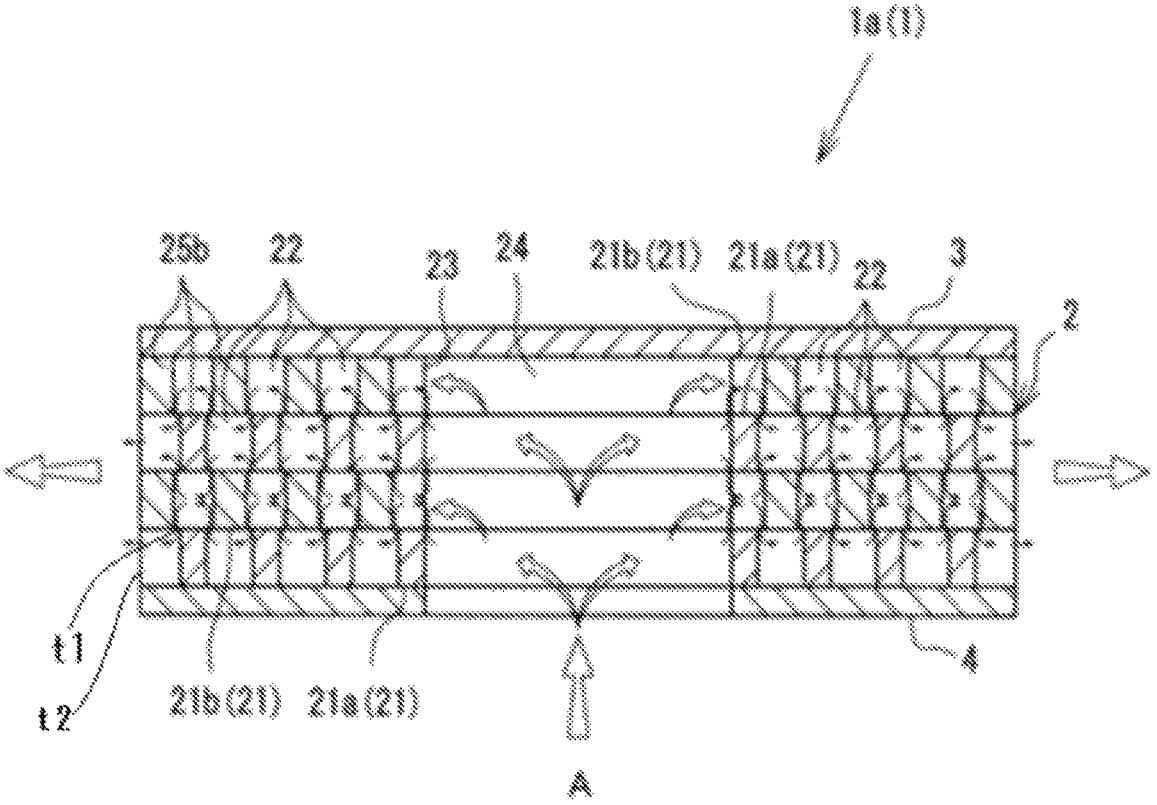
FIG. 7 is a side sectional side view of a mixing unit in accordance with a fifth embodiment of the present invention showing a state of flow of fluid within the mixing unit.

FIG. 7 is a side sectional side view of a mixing unit 1*a* including a first plate, a mixing body 2 having mixing elements 21*a* and 21*b* (here exemplary, four mixing elements), and a second plate 4 in accordance with a fifth embodiment of the present invention showing a state of flow of fluid A within mixing unit 1*a*. This mixing unit 1*a* differs from mixing unit 1*a* of the first embodiment in that, as shown in FIG. 7, a width t1 of a flow path, in the direction in which mixing elements 21*a* and 21*b* extend, that is formed in the portion where first through holes 22 overlap each other by the stacking of mixing elements 21*a* and 21*b* is narrower than a thickness t2 of a partition wall 25*b*, in the stacking direction, that is connected to the upstream side of the above-mentioned flow path and that is between the above-mentioned first through holes 22. In the example of FIG. 7, in particular, the width of the flow path is narrower than half of the thickness of partition wall 25*b*, and more specifically, is narrower than one-fourth thereof.

In mixing unit 1*a* configured as described above, when fluid A flows in the direction in which mixing elements 21*a* and 21*b* extend, fluid A likewise flows separately in the direction in which mixing elements 21*a* and 21*b* are stacked and in the direction along the extending surface extending in the direction of the extension. However, since a flow path along which fluid A flows from first through hole 22 of one mixing element 21*a* to first through hole 22 of mixing element 21*b* adjacent to the above-mentioned mixing element 21*a* is narrow, it is possible to provide a shearing force to the fluid, with the result that it is possible to enhance the degree of mixing of the fluid.

In the case where the width of the flow path is made narrower than one-fourth of the thickness of partition wall 25*b*, when the fluid flows through the flow path from one first through hole 22 into other two first through holes 22, each flow rate is increased to be twice or more as high as before, with the result that it is possible to further increase the effect of enhancing the degree of mixing of the fluid. The other parts of the configuration of and the other effects of mixing unit 1*a* of this fifth embodiment are the same as those of mixing unit 1*a* of the first embodiment.

Sixth Embodiment

Figure 8A:
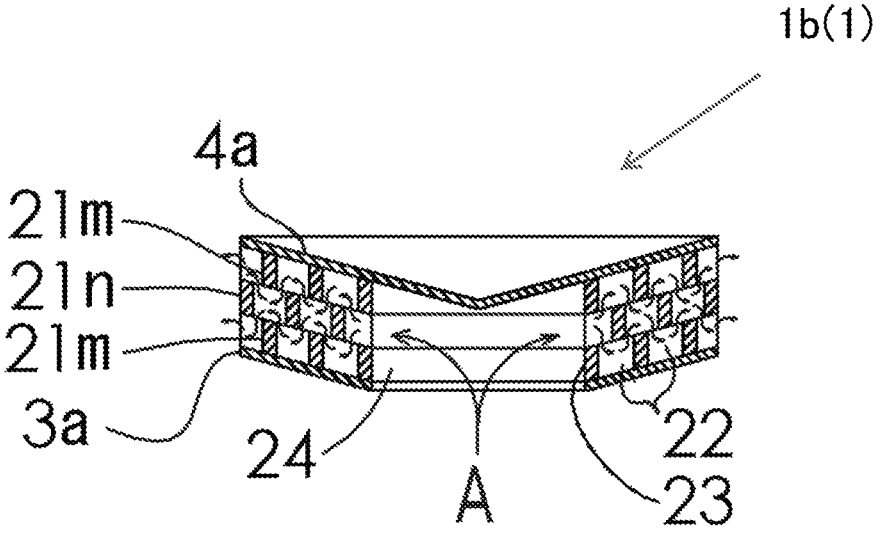
FIG. 8A is a side sectional side view of a mixing unit in accordance with a sixth embodiment of the present invention showing a state of flow of fluid within the mixing unit.

FIG. 8A is a side sectional side view of a mixing unit 1*b* in accordance with a sixth embodiment of the present invention showing a state of flow of a fluid A within mixing unit 1*b*. Mixing unit 1*b* includes a plurality of mixing elements 21*m* and 21*n* (here exemplary, three mixing elements) which are alternately stacked, a first plate 4*a*, and a second plate 3*a* having an opening portion 24. Mixing elements 21*m* and 21*n* have first through holes 22 and 23 and second through holes 24 in their center portions, in two types respectively, to provide flow paths for passing fluid A entering into second through holes 24 to outwards from an outer circumferential side of the mixing elements 21*m* and 21*n* as shown in FIG. 8A. Each of mixing elements 21*m* and 21*n* is configured to be a plate in a conical shape, and its extension direction intersects a stacking direction in which the mixing elements are stacked. The other parts of the configuration of and the other effects of the mixing unit of this sixth embodiment are the same as those of mixing unit 1*a* of the first embodiment.

Figure 8B:
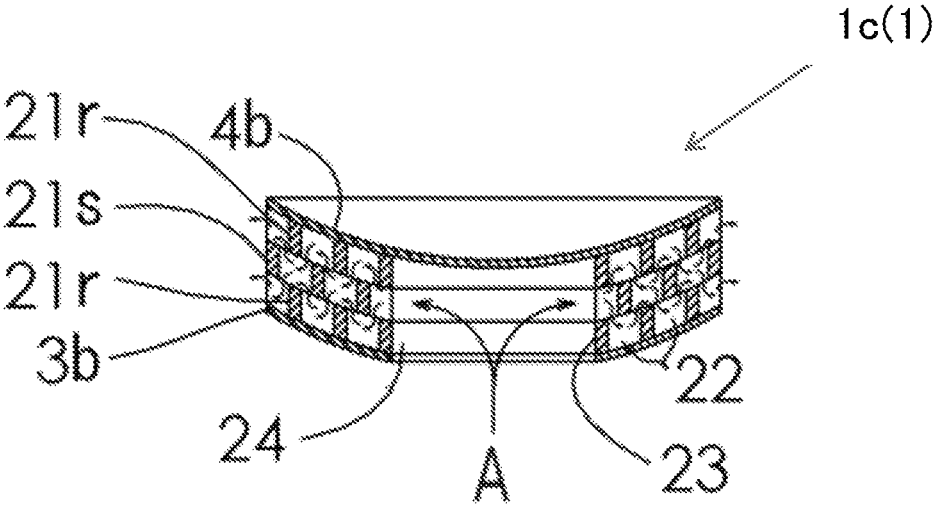
FIG. 8B is a sectional side view of a mixing unit modified from the mixing unit of FIG. 8A.

FIG. 8B is a sectional side view of a mixing unit 1*c* modified from mixing unit 1*b* of FIG. 8A, which includes a plurality of mixing elements 21*r* and 21*s* which are alternately stacked, a first plate 4*b*, and a second plate 3*b* having an opening portion 24, Mixing elements 21*r* and 21*s* have first through holes 22 and 23, and second through holes 24 in their center portions, in two types respectively, and are configured to be a plate in a partial ball shape, wherein extension direction in which the mixing elements extend intersects a stacking direction in which the mixing elements are stacked. The other parts of the configuration of and the other effects of the mixing unit 1*c* of this sixth embodiment are the same as those of the mixing unit of the fifth or first embodiment.

Seventh Embodiment

Figure 9A:
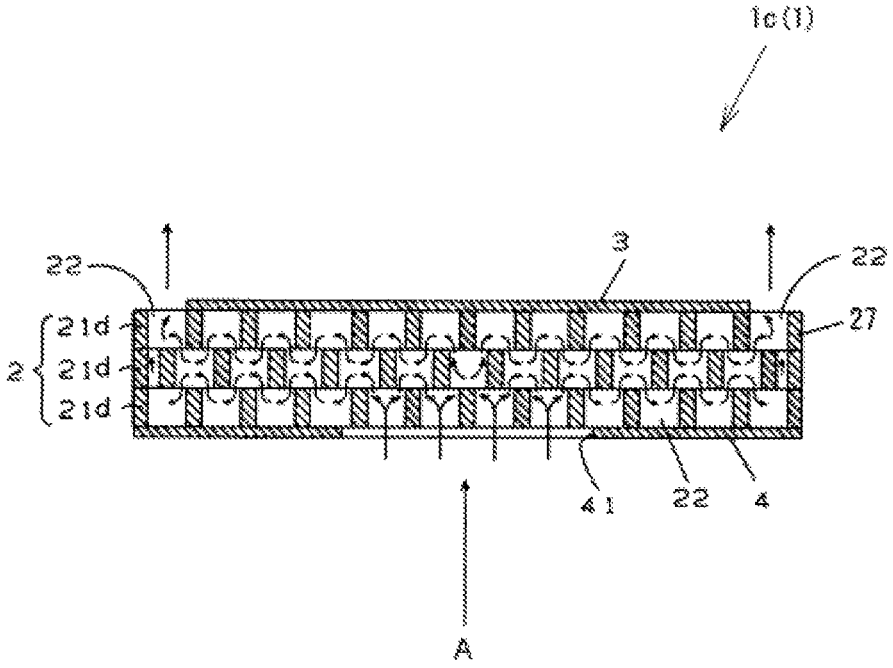
FIG. 9A is a sectional side view of a mixing unit in accordance with a seventh embodiment of the present invention showing a state of flow of fluid within the mixing unit.
Figure 9B:
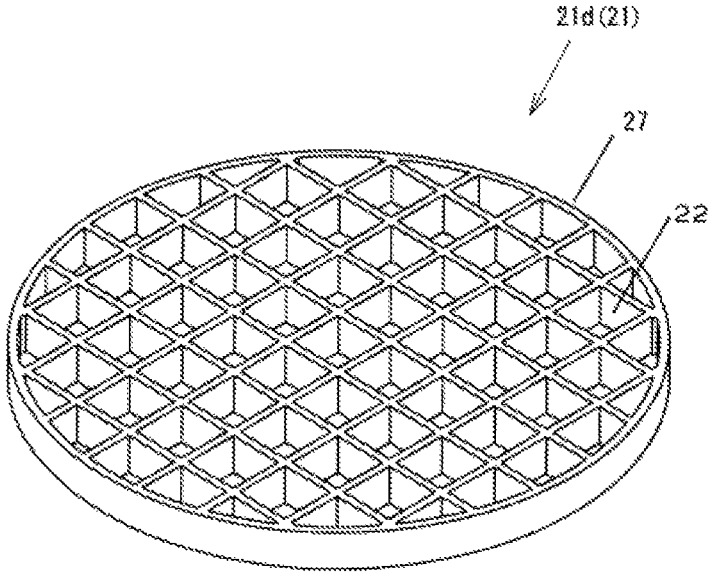
FIG. 9B is a perspective view of a mixing element employed in the mixing unit of FIG. 9A.
Figure 10A:
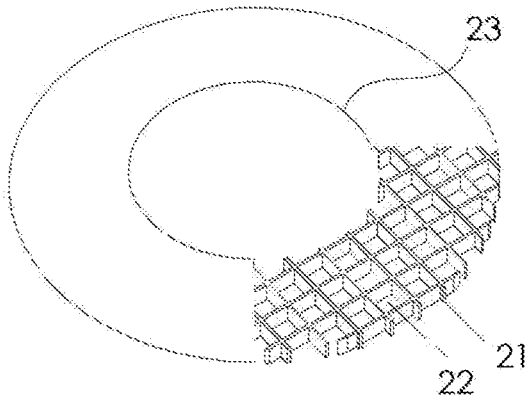
FIGS. 10A, 10B, 10C, and 10D are perspective views of mixing elements as a first variation of the mixing units of the foregoing embodiments.
Figure 10B:
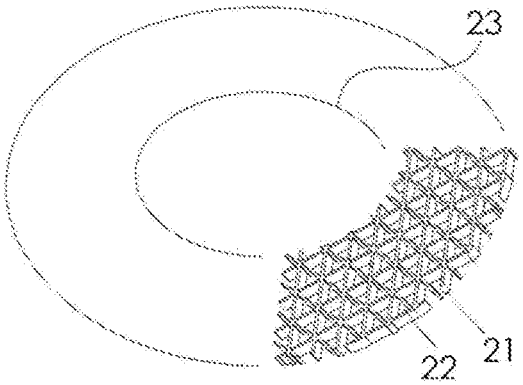
Figure 10C:
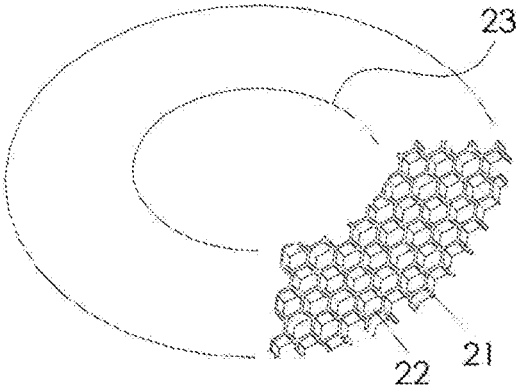
Figure 10D:
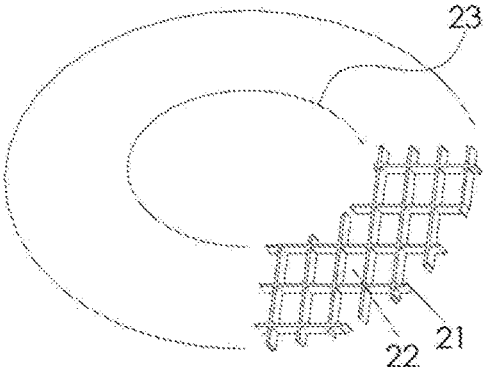

FIG. 9A is a cross-sectional view of a mixing unit 1*c* including a first plate 3, a mixing body 2 having a plurality of mixing elements 21*d* (here, three plates), and a second plate 4 in accordance with a seventh embodiment of the present invention showing how fluid A flows within mixing unit 1*c*, and FIG. 9B is a perspective view of mixing element 21*d*.

This mixing unit 1*c* differs from mixing unit 1*a* of the first embodiment in that, as shown in FIGS. 9A and 9B, a plurality of mixing elements 21*d* have first through holes 22, viz., a plurality of through holes, over the entire surface without the provision of the second through holes 23 in the center portion and a frame portion 27 (see FIG. 9B) that prevents first through holes 22 from being open to the outer circumferential portion. Each of first through holes 22 is formed in the shape of a quadrangle (see FIG. 9(*b*)). Furthermore, the diameter of first plate 3 in the outer circumferential shape is smaller than the diameter of mixing elements 21*d* (see FIG. 9A) such that first through holes 22 in the outer circumferential portion of mixing elements 21*d* stacked on first plate 3 are open.

Even with the mixing unit 1*c* configured as described above, fluid A made to flow into the mixing unit 1*c* with appropriate pressure flows into mixing body 2 through the opening portion 41 of the second plate 4. The fluid entering mixing body 2 is passed radially within mixing body 2 and is passed through first through holes 22 with which mixing elements 21*d* communicate. Here, since the flow is performed in the direction in which the mixing element 21*d* extends, and fluid A is repeatedly divided and combined while extending in the direction in which mixing elements 21*d* are stacked, fluid A is mixed. Finally, fluid A flows out through first through holes 22 that are open to the outer circumferential portion of first plate 3 arranged on one end of mixing body 2.

As described above, since, in mixing unit 1*c* of this seventh embodiment, first through holes 22 are formed over the entire surface of the mixing element 21*d*, it is unnecessary to provide the second through hole 23 in the center portion, with the result that it is easy to produce the mixing unit 1*c*.

The other parts of the configuration of and the other effects of the mixing unit 1*c* of this seventh embodiment are the same as those of mixing unit 1*a* of the first embodiment.

Mixing unit 1 of the present invention is not limited to those described in the foregoing first to seventh embodiments; many variations are possible.

(First Variation of Mixing Units)

For example, first through holes 22 of mixing element 21 is not limited to be circular nor rectangular. As shown in FIGS. 10A to 10D, first through holes 22 of mixing element 21 as shown in FIGS. 1 and 2 in the first embodiment of the present invention may be formed in the shape of a polygon such as a square, a triangle, a hexagon or a rectangle as a first variation of the mixing units of the foregoing embodiments. By forming first through holes 22 in the shape of a rectangle or a polygon to increase the aperture ratio of mixing element 21, it is possible to reduce the flow resistance of mixing unit 1*a* though the pitches between first through holes 22 of mixing elements 21*a* are substantially equal to each other, the present invention is not limited to this configuration. As shown in mixing elements 21*a* and 21*b* of FIG. 2, the size of and the pitch between first through holes 22 may be increased as the mixing element extends from the inner circumferential portion to the outer circumferential portion.

Although the outer circumferential shape of mixing elements 21 is substantially circular and the outer circumferential shape of first plate 3 and the second plate 4 is circular as shown in FIGS. 1 and 2, the present invention is not limited to this configuration. Any other shape that achieves the equivalent function may be employed. Although the second through holes 23 of mixing elements 21 are substantially circular and opening portion 41 of second plate 4 is circular as shown in FIG. 1, the present invention is not limited to this configuration. Any other shape that achieves the similar function may be employed. Although mixing elements 21 have the second through holes 23 in the center portion, second plate 4 has the opening portion 41 in the center portion and second through hole 23 and opening portion 41 are substantially equal in diameter to each other and are substantially concentric with each other, the present invention is not limited to this configuration, and any other shape that achieves the similar function may be employed.

Mixing unit 1 may be formed as follows. Mixing elements 21 having a plurality of first through holes 22 arranged in the same positions and having tile same shape are used; first through holes 22 are displaced such that first through holes 22 overlap each other in the radial direction and the circumferential direction.

Two types of mixing elements having different inside and outside diameters are used, and thus first through holes 22 in the inner circumferential portion and the outer portion may be open.

(Second Variation of the Mixing Units)

Figure 11A:
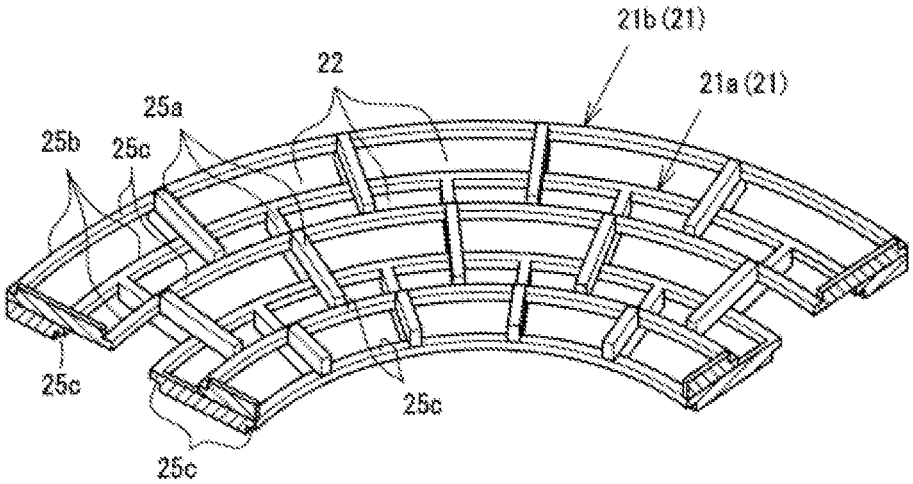
FIG. 11A a perspective view of a main portion of a pair of mixing elements as a second variation of the mixing units.
Figure 11B:
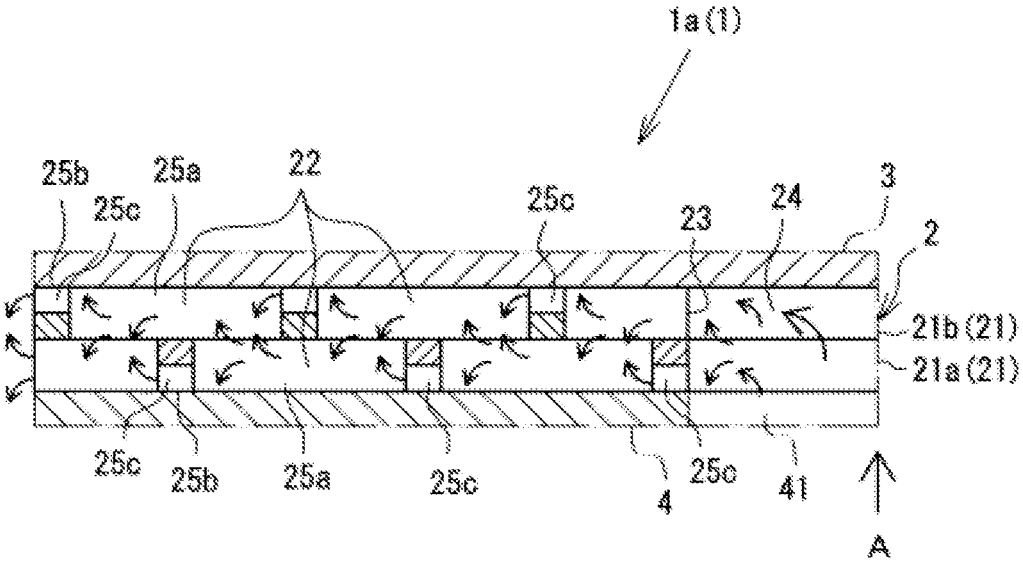
FIG. 11B is a cross-sectional view of a mixing unit employing the mixing elements of FIG. 11A showing a state of flow of fluid within the mixing unit.

FIG. 11A is a perspective view of a main portion in a state where one mixing element 21*a* and one mixing element 21*b* of the two types of mixing elements 21*a* and 21*b* are stacked, and FIG. 11B is a cross-sectional view showing the state of fluid A flowing within mixing elements 21*a* and 21*b*, which are a second variation of the mixing units of the foregoing embodiments.

Even when only two mixing elements 21 and 21*b* are stacked, in these mixing elements 21*a* and 21*b*, two or more layers of the flow paths aligned in the stacking direction are provided.

Specifically, among the partition walls between first through holes 22 of mixing elements 21*a* and 21*b*, in the partition walls 25*b* extending in the direction intersecting the direction in which mixing elements 21*a* and 21*b* extend, cut portions 25*c* whose height is lower than that of the partition walls 25*a* extending in the radial direction of mixing elements 21*a* and 21*b* are formed. When the two mixing elements are stacked, mixing elements 21*a* and 21*b* are stacked with the sides where the cut portions 25*c* are not present in mixing elements 21*a* and 21*b* arranged to face the contact surface.

The shape of first through holes 22 of mixing elements 21*a* and 21*b*, that is, the shape of the partition walls, is the same as in the first embodiment of the mixing unit shown in FIGS. 1, 2 and 3. Among first through holes 22 of mixing elements 21*b* shown on the upper side of the figure, first through holes 22 on the inner circumferential edge are open to the inner circumference; among first through holes 22 of mixing elements 21*a* shown on the lower side of the figure, first through holes 22 on the outer circumferential edge are open to the outer circumference. Hence, partition walls 25*b* extending in the circumferential direction, which is the direction intersecting the direction in which mixing elements 21*a* and 21*b* extend, are displaced between stacked mixing elements 21*a* and 21*b* in the circumferential direction.

That is, in partition walls 25*b* extending in the circumferential direction, the position in the circumferential direction differs from the position in the stacking direction. In other words, each of the two types of mixing elements 21*a* and 21*b* stacked has a flow path that divides the fluid in the direction in which mixing elements 21*a* are stacked. Hence, unlike the case where one flow path that divides the fluid in the direction in which mixing elements 21*a* are stacked is present as shown in FIG. 3B, two flow paths may be formed by each mixing element having two layers of flow paths as shown in FIG. 11B.

In the configuration described above, even when a small number of mixing elements 21*a* and 21*b* stacked are provided, it is possible to provide a multilayer structure where two or more layers of the flow paths along which fluid A flows, with the result that it is possible to obtain a high mixing capability.

Although, in FIGS. 11A and 11B, the example where cat portions 25*c* are formed over partition walls 25*b* extending in the direction intersecting the direction in which mixing elements 21*a* and 21*b* extend has been shown, cut portions 25*c* may be formed partially or intermittently. Mixing elements 21*a* and 21*b* may be stacked such that partition walls 25*b* extending in the direction intersecting the direction in which mixing elements 21*a* and 21*b* where cut portions 25*c* of stacked mixing elements 21*a* and 21*b* are formed extend are in contact with each other. Even in this case, it is possible to form at least one flow path that divides the fluid in the direction in which mixing elements 21*a* and 21*b* are stacked because two mixing elements 21*a* and 21*b* provide four layers of flow paths (each mixing element provides two layers of flow paths) each having an unique pattern of first through holes 22. Furthermore, three or more mixing elements 21*a* and 21*b* as described above may be stacked.

Thus, according to this second variation of the mixing unit, there is provided a mixing unit including mixing elements, wherein each of the mixing elements has a partition wall between the first through holes, and the partition wall is disposed such that each of the mixing element is formed to have two layers of flow paths.

(Third Variation of the Mixing Units)

Figure 12:
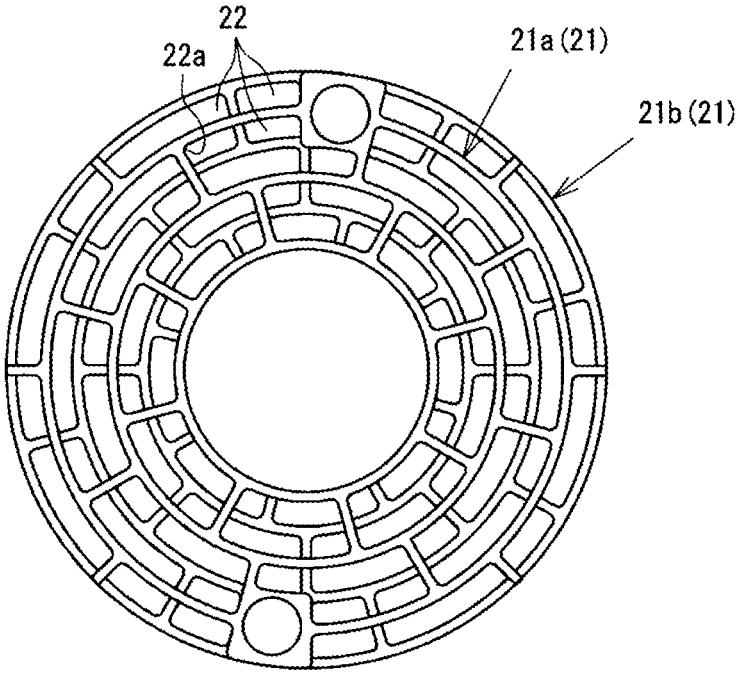
FIG. 12 is a plan view of mixing elements which are stacked as a third variation of the mixing units.

FIG. 12 is a plan view in a state where the two types of mixing elements 21*a* and 21*b* are stacked. In these mixing elements 21*a* and 21*b*, in the corner portions of the substantially rectangular first through hole 22, rounded corner portions 22*a* are formed as a third variation of the mixing units of the foregoing embodiments.

When rounded corner portions 22*a* are provided as described above, the fluid is unlikely to be left in the corner portions. Consequently, the leaving of the fluid in the mixing element is reduced, and thus it is possible to perform satisfactory mixing and washing.

(Fourth Variation of the Mixing Unit)

Mixing element 21, first plate 3, second plate 4 and the like may be divided into separate structures of various shapes as a fourth variation of the mixing units of the foregoing embodiments. Herein, it is possible to easily produce even large mixing unit.

Figure 13A:
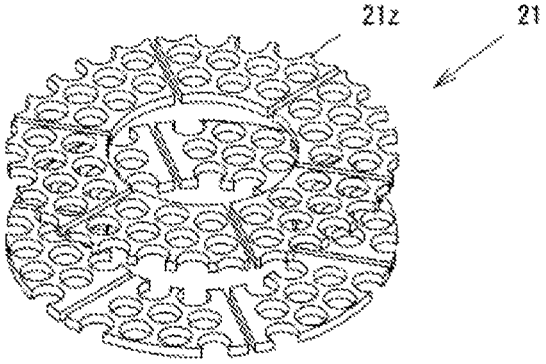
FIGS. 13A, 13B, and 13C are plan views of mixing elements to be stacked as a fourth variation of the mixing units.
Figure 13B:
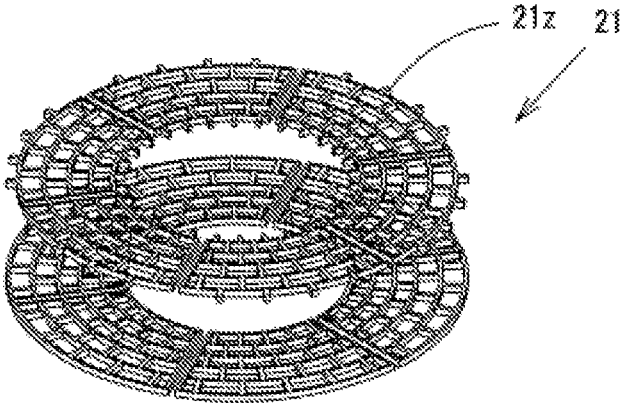
Figure 13C:
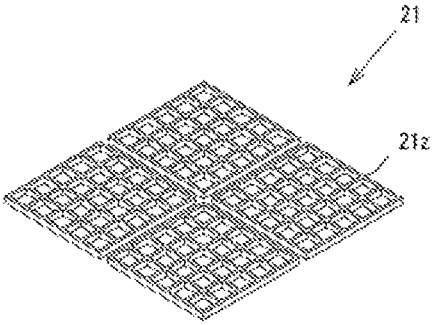

As shown in FIGS. 13A and 13B, as mixing element 21 has an annular shape, mixing element 21 may be divided into separate structures, each composed of a sector-shaped divided member 21*z*. When mixing element 21 is formed in the shape of a quadrangle as shown in FIG. 13C, mixing element 21 may be divided into separate structures, each composed of a rectangular divided member 21*z*.

(Fifth Variation of the Mixing Units)

Figure 14:
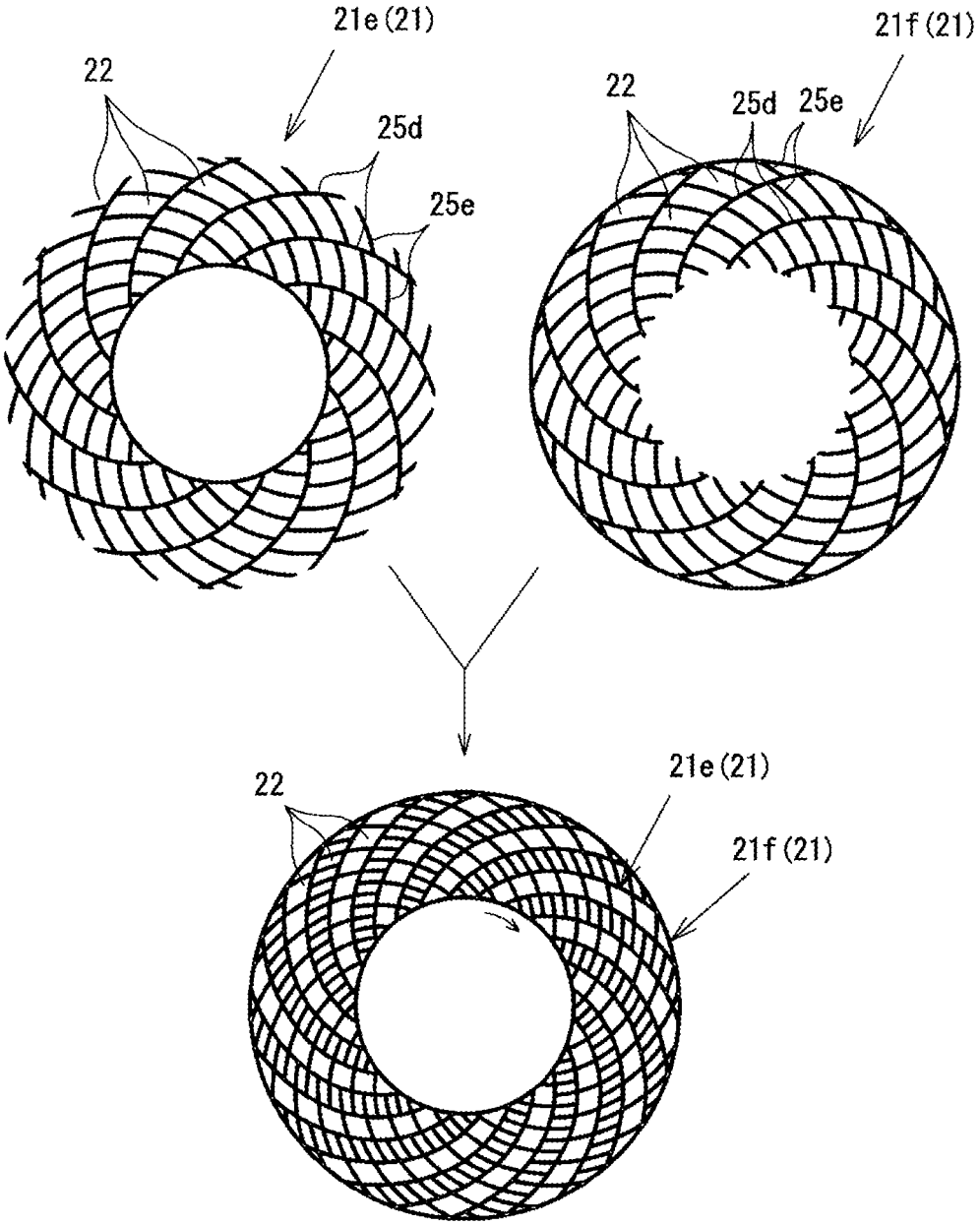
FIG. 14 shows plan views of a pair of mixing elements and their stacked mixing elements as a fifth variation of the mixing units.
Figure 15:
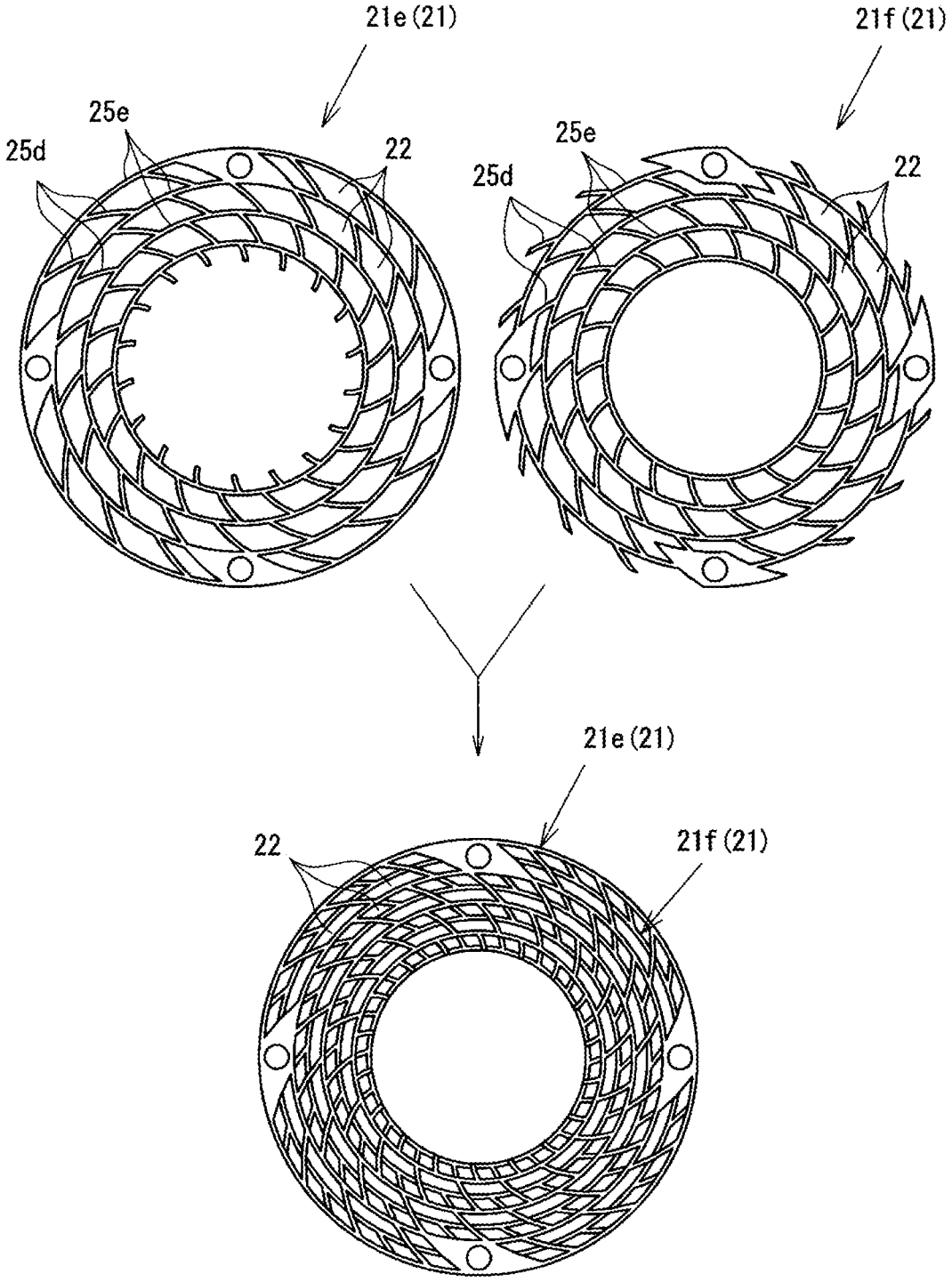
FIG. 15 shows plan views of a pair of mixing elements and their stacked mixing elements as a modification of the mixing element of FIG. 14.

As shown in FIGS. 14 and 15, first through holes 22 of mixing elements 21 may be non-linearly arranged in the direction in which mixing elements 21 extend as a fifth variation of the mixing units of the foregoing embodiments.

FIG. 14 is a plan view showing the two types of mixing elements 21*e* and 21*f* and shows a state of mixing elements 21*e* and 21*f* stacked.

As shown in FIG. 14, first through holes 22 are non-linearly arranged from the center side of mixing elements 21*e* and 21*f* to the outer circumference. Specifically, among the partition walls between first through holes 22, partition walls 25*d* continuous from the center portion to the outer circumference extend in the form of a curve curving to one direction; more specifically, partition walls 25*d* extend substantially in the form of an involute curve. According to one or more embodiments of the present invention, "substantially in the form of an involute curve" means that an involute curve is included.

In addition to partition walls 25*d*, partition walls 25*e* that substantially perpendicularly interest partition walls 25*d* and that extend so as to connect partition wails 25*d* are provided.

The arrangements of partition walls 25*d* and 25*e* are made to differ between the two types of mixing elements 21*e* and 21*f*; among the partition walls, the positions of the partition walls extending in the direction intersecting the direction in which mixing elements 21*e* and 21*f* extend, that is, partition walls 25*d* and 25*e*, are displaced between the adjacent mixing elements 21*e* and 21*f*; the fluid is passed by being made to sequentially pass through first through holes 22 of the adjacent mixing elements 21*e* and 21*f* in the direction in which mixing elements 21*e* and 21*f* extend.

First through holes 22 are non-linearly arranged as described above, and thus it is possible to increase the path length of fluid as compared with the case where first through holes 22 are linearly arranged. In other words, since the number of times the fluid passes through first through holes 22 may be increased, it is possible to satisfactorily mix the fluid.

Even when mixing elements 21*e* and 21*f* are small, it is possible to increase the path length and obtain high mixing effects, with the result that it is possible to reduce the size of the mixing unit.

As the non-linear configuration, a configuration where the curvature of a curve is increased toward the direction in which the mixing element extends or the like may be employed as necessary. In the direction in which mixing elements 21*e* and 21*f* extend, first through holes 22 may be spaced regularly along the same direction in the form of a substantially same curve or an involute curve; moreover, mixing elements 21*e* and 21*f* may be spaced irregularly.

FIG. 15 is a plan view showing the two types of mixing elements 21*e* and 21*f* and the state of mixing elements 21*e* and 21*f* stacked.

In mixing elements 21*e* and 21*f* shown in FIG. 15, among the partition walls between first through holes 22, partition walls 25*d* continuous from the center portion to the outer circumference extend substantially in the form of an involute curve curving to one direction, and partition walls 25*d* are coupled by partition walls 25*e* extending in the circumferential direction. Partition walls 25*e* extending in the circumferential direction are formed concentrically with respect to the center point of mixing elements.

In mixing elements 21*e* and 21*f* described above, it is possible to perform satisfactory mixing as described above; in particular, when the mixing unit is actively rotated to perform mixing, since a rotational force may be efficiently transmitted to the fluid, it is possible to enhance the mixing effects. Thus, according to this fifth variation of the mixing unit, there is provided a mixing body or mixing unit including mixing elements each having plurality of first through holes that are stacked in a stacking direction and each of the mixing element which are to form a flow path therein, wherein the first through holes in each of mixing elements are non-linearly arranged in the extending direction.

(Sixth Variation of the Mixing Units

The partition walls between first through holes 22 in the mixing element 21 described above may be formed in a shape other than a square as seen in cross section. Further variations of the mixing unit will be shown in FIGS. 16A to 22 as a sixth variation of the mixing units of the foregoing embodiments.

Figure 16A:
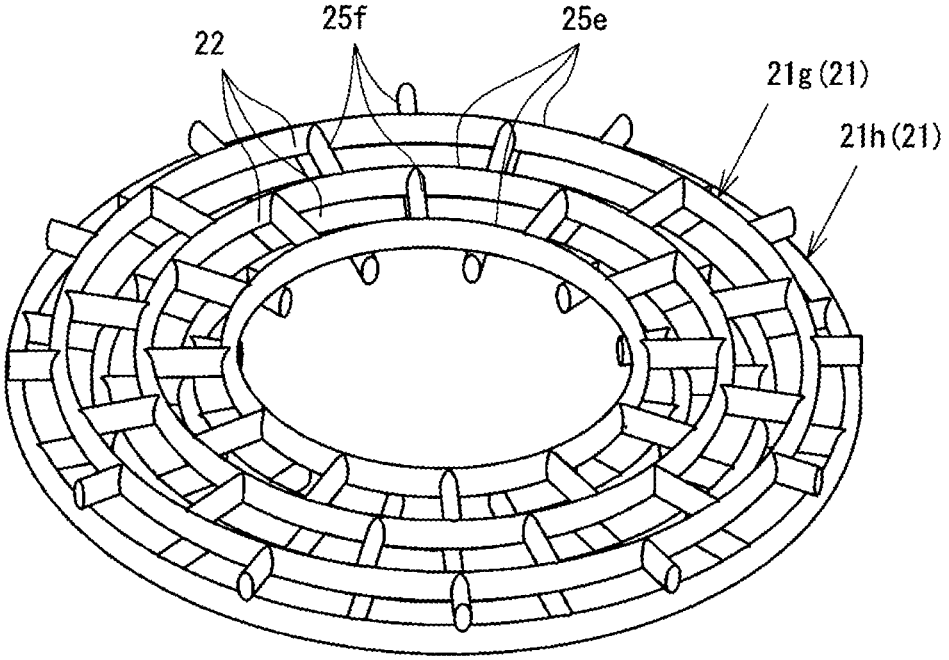
FIG. 16A is a perspective view of mixing elements which are stacked as a sixth variation the mixing units.
Figure 16B:
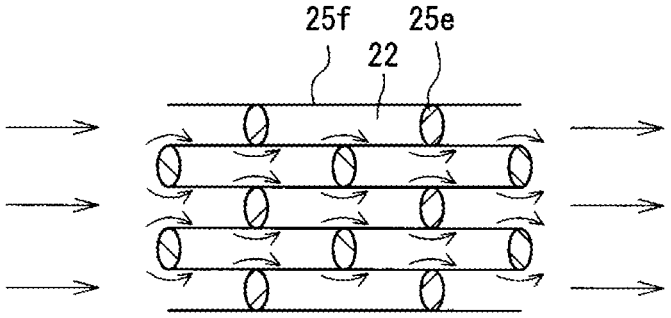
FIG. 16B is a partial cross-sectional schematic view of a mixing unit employing the mixing elements of FIG. 16A showing a state of flow of fluid within the mixing unit.

FIG. 16A is a perspective view in a state where two types of mixing elements 21*g* and 21*h* are stacked, and FIG. 16B is an illustrative diagram showing a state where the fluid flows within mixing elements 21*g* and 21*h*.

As shown in FIG. 16A, in mixing elements 21*g* and 21*h*, the cross-sectional shape of partition walls 25*f* extending in the radial direction and partition walls 25*e* extending in the circumferential direction is formed substantially in the shape of a vertically long ellipse. According to one or more embodiments of the present invention, "substantially in the shape of an ellipse" described above means that an ellipse is included.

The flow of the fluid within mixing elements 21*g* and 21*h* having partition walls 25*e* and 25*f* shaped as described above is the same as in, for example, the first embodiment of the mixing unit; as compared with partition walls whose end surfaces rise steeply, an impact at the time of collision with the fluid is reduced, and thus it is possible to make the fluid flow smoothly. This type of flow is suitable for a fermentation process that deals with y east or the like.

The partition walls between first through holes 22 in mixing elements 21 may have a cross-sectional shape including a chamfered portion as seen in cross section.

Figure 17A:
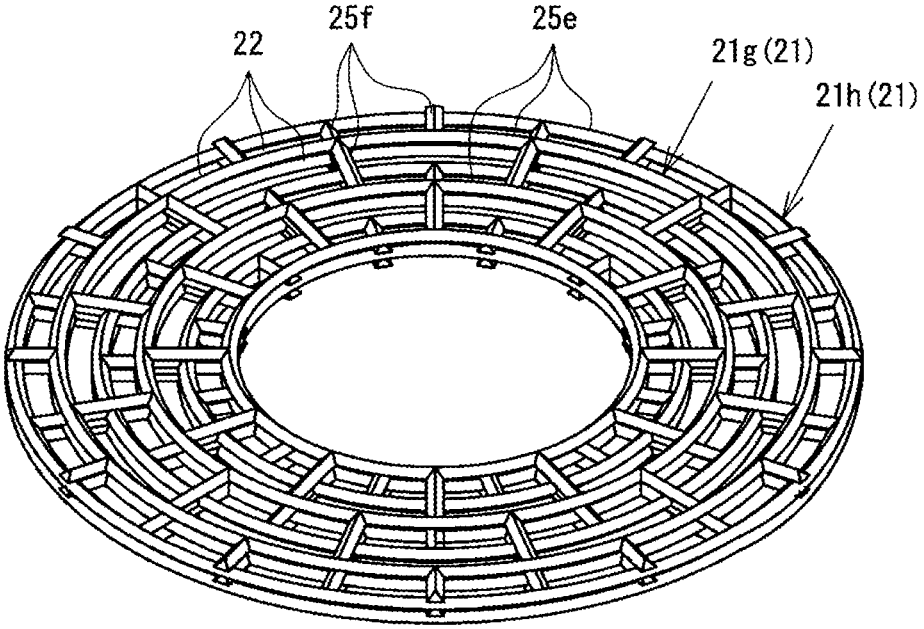
FIG. 17A is a perspective view of mixing elements which are stacked.
Figure 17B:
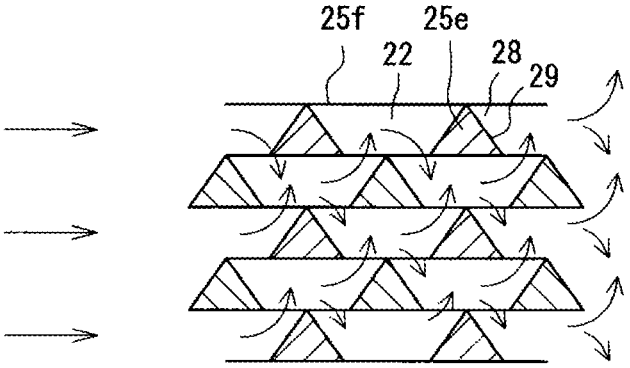
FIG. 17B is a partial cross-sectional schematic view of a mixing unit employing the mixing elements of FIG. 17A showing a state of flow of fluid within the mixing unit.

FIG. 17A is a perspective view in a state where the two types of mixing elements 21*g* and 21*h* are stacked, and FIG. 17B is an illustrative diagram showing a state where the fluid flows within mixing elements 21*g* and 21*h*.

As shown in FIG. 17A, in mixing elements 21*g* and 21*h*, the cross-sectional shape of partition walls 25*f* extending in the radial direction and partition walls 25*e* extending in the circumferential direction is formed in the shape of a triangle where the width of its upper portion is narrow and the width of its lower portion is wide. Hence, the surface opposite the direction in which mixing elements 21*g* and 21*h* extend is inclined in such a direction that, as the surface extends upwardly, the thickness of partition walls 25*e* and 25*f* is decreased. The inclined portion described above is the chamfered portion 28, and forms inclined surfaces 29.

In the flow of the fluid within mixing elements 21*g* and 21*h* having partition walls 25*e* and 25*f* shaped as described above, since the chamfered portions 28 are provided, as compared with partition walls whose end surfaces rise steeply, an impact at the time of collision with the fluid is reduced. Thus, it is possible to make the fluid flow smoothly.

Figure 18A:
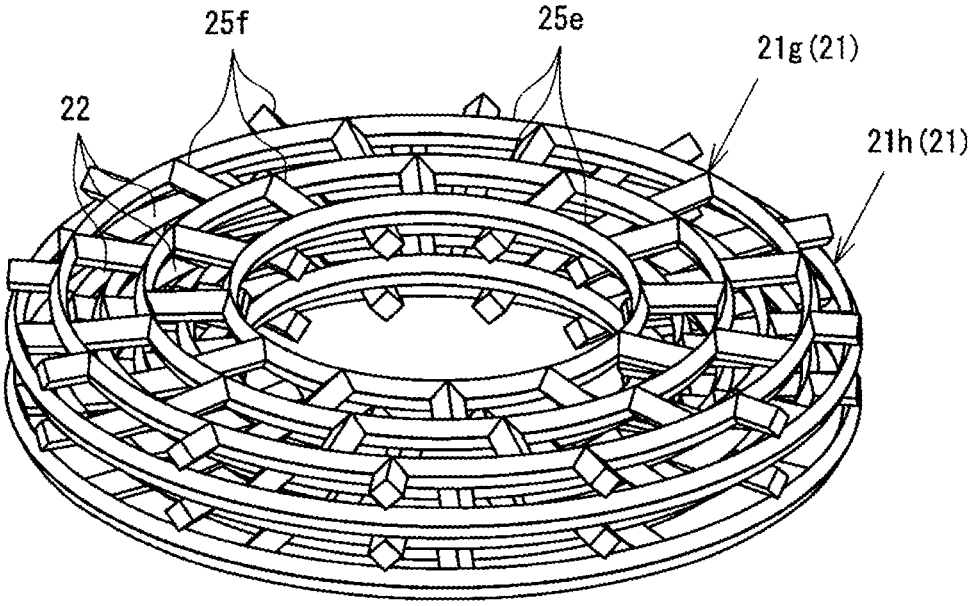
FIG. 18A is a perspective view of mixing elements which are stacked as a modification of the mixing elements of FIG. 17A.
Figure 18B:
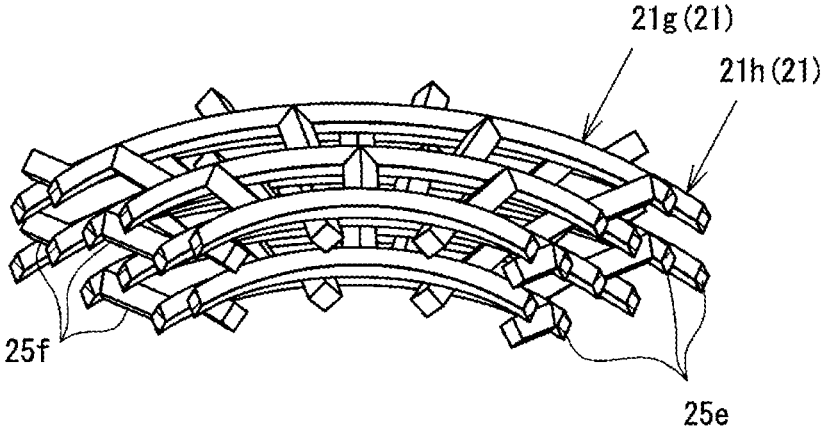
FIG. 18B is a partial enlarged perspective view of the stacked mixing elements of FIG. 18A showing its cross-sectional shape.
Figure 19A:
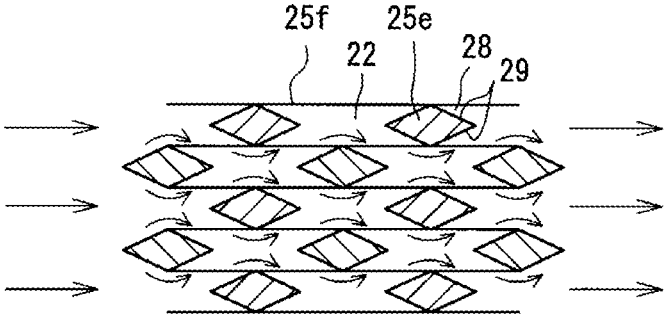
FIGS. 19A, 19B and 19C are cross-sectional schematic views showing states of flow of fluid within mixing units as further modifications the mixing unit of the FIG. 17B.

FIG. 18A is a perspective view in a state where the two types of mixing elements 21*g* and 21*h* are stacked, and FIG. 18B is a perspective view showing the cross-sectional shape of mixing elements 21*g* and 21*h*. FIG. 19A is an illustrative diagram showing a state where the fluid flows within mixing elements 21*g* and 21*h*.

As shown in FIG. 18A, in mixing elements 21*g* and 21*h*, the cross-sectional shape of partition walls 25*f* extending in the radial direction and partition walls 25*e* extending in the circumferential direction is formed substantially in the shape of a rhombus where corners are present in upper, lower, left and right portions. According to one or more embodiments of the present invention, "substantially in the shape of a rhombus" means that a rhombus is included.

Hence, the surface opposite the direction in which mixing elements 21*g* and 21*h* extend is inclined in such a direction that, as the surface extends upwardly or downwardly, the thickness of partition walls 25*e* and 25*f* is decreased. The inclined portion described above is the chamfered portion 28, and forms inclined surfaces 29.

In the flow of the fluid within mixing elements 21*g* and 21*h* having partition walls 25*e* and 25*f* shaped as described above, since the chamfered portions 28 are provided as shown in FIG. 19A, as compared with partition walls whose end surfaces rise steeply, an impact at the time of collision with the fluid is reduced. Thus, it is possible to make the fluid flow smoothly.

The angle of inclined surfaces 29 is set as necessary, and thus it is possible to adjust and control the direction in which the fluid flows.

Figure 19B:
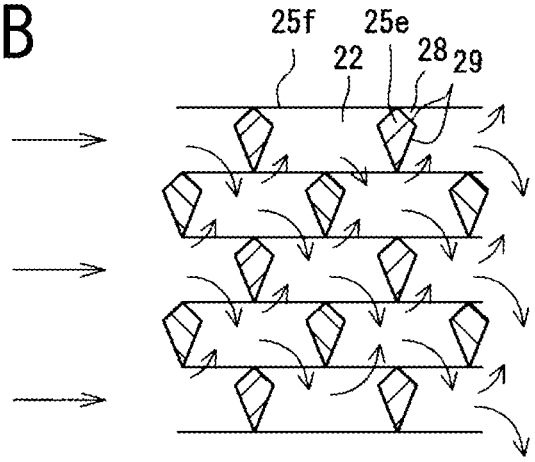
Figure 19C:
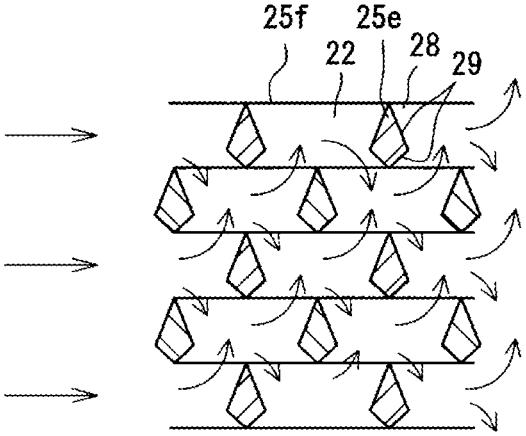

As shown in FIGS. 19B and 19C, the angles of the upper and lower inclined surface 29 are made to differ from each other, and thus it is possible to increase and decrease the magnitude of the flow of the fluid in the up/down direction (the stacking direction), with the result that it is possible to change the entire flow. For example, with consideration given to a direction in which satisfactory mixing may be performed and the like, the angle of the inclined surfaces 29, the distance between partition walls 25*e* and 25*f* and the like are set as necessary, and thus it is possible to realize desired mixing.

The control of the direction in which the fluid flows may be performed such as by setting the cross-sectional shape of partition walls 25*e* and 25*f* as necessary, inclining partition walls 25*e* and 25*f* of the cross-sectional shape as in the example described above or twisting partition walls 25*e* and 25*f*.

Figure 20A:
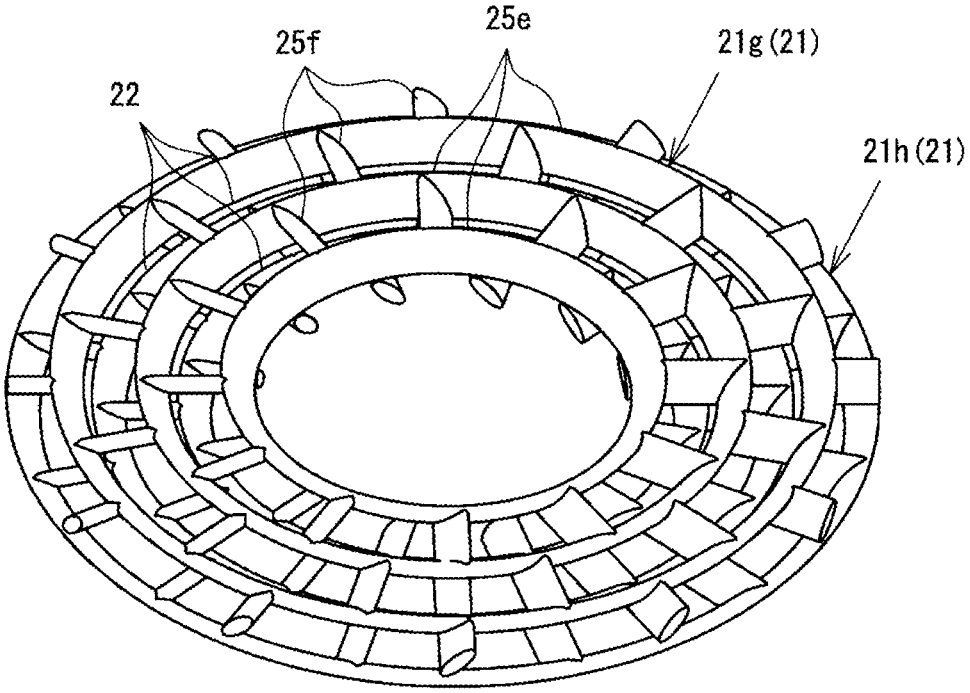
FIG. 20A is a perspective view of mixing elements which are stacked as a further modification of the mixing elements of FIG. 18A.
Figure 20B:
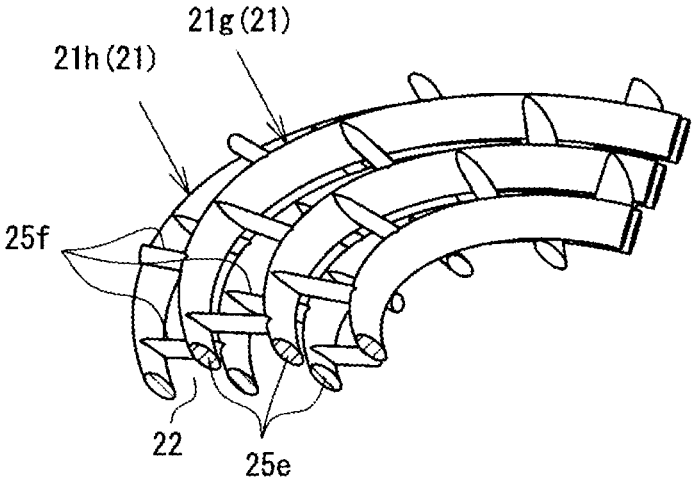
FIG. 20B is a partial enlarged perspective view of the stacked mixing elements of FIG. 20A showing its cross-sectional shape.

FIG. 20A is a perspective view in a state where the two types of mixing elements 21*g* and 21*h* are stacked, and FIG. 20B is a partial perspective view showing the cross-sectional shape of mixing elements 21*g* and 21*h*.

As shown in FIGS. 20A and 20B, the cross-sectional shape of partition walls 25*f* extending in the radial direction and partition walls 25*e* extending in the circumferential direction is formed substantially in the shape of an ellipse; partition walls 25*e* are inclined with respect to the stacking direction so as to extend circumferentially; partition walls 25*f* extending in the radial direction are inclined to one of the leftward and rightward directions.

As mixing elements 21*g* and 21*h* are relatively moved, differences in the resistance between partition walls 25*e* and 25*f* are made, and thus directivity is given to the fluid within mixing elements 21*g* and 21*h* having partition walls 25*e* and 25*f* shaped as described above. Since the fluid is made to flow easily in the circumferential direction along partition walls 25*e* by partition walls 25*f* inclined to the circumferential direction and extending in the radial direction, it is possible to obtain spiral flow shown conceptually in FIG. 21 especially for use as an agitation impeller.

When the cross-sectional shape of partition walls 25*e* and 25*f* is formed in the shape of a rhombus, among the partition walls, the resistance of the partition walls extending from the center portion of mixing elements to the outer circumference to fluid and the resistance of the other partition walls to fluid are made to differ from each other, and thus it is possible to likewise achieve spiral flow.

Figure 22:
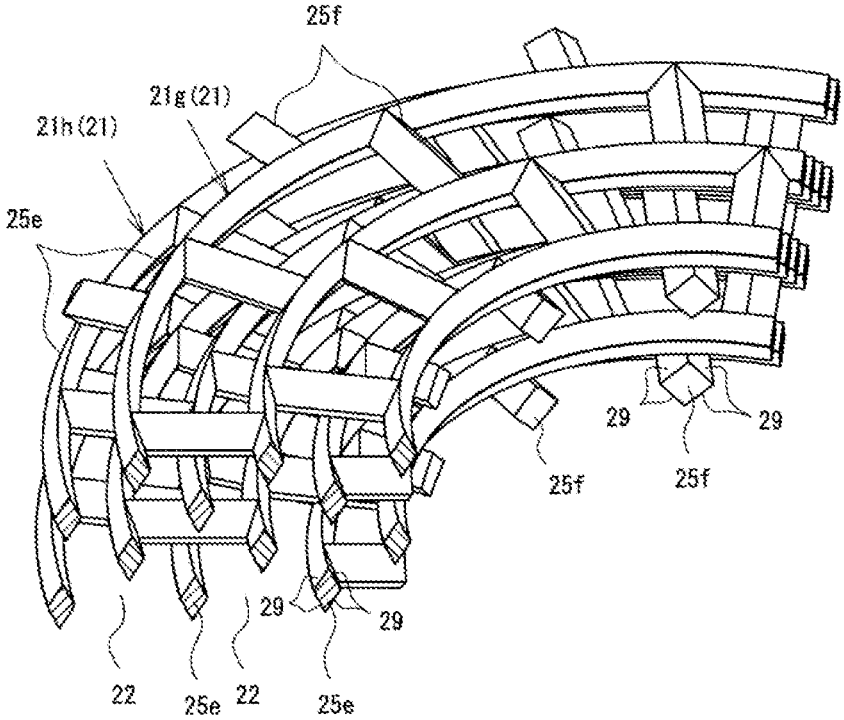
FIG. 22 is a partial cross-sectional perspective view showing a cross-sectional shape of mixing elements as a modification of the mixing elements of FIG. 20A.

FIG. 22 is a partial perspective view showing a cross-sectional shape of two types of mixing elements 21*g* and 21*h* in a state which the elements are stacked.

As shown in FIG. 22, partition walls 25*e* and 25*f* between first through holes 22 in mixing elements 21*g* and 21*h* have the inclined surfaces 29 whose upper and/or lower ends are narrower in width, and, with respect to the inclination angle of the inclined surfaces 29 described above, among the partition walls, the inclination angle of partition walls 25*f* extending in the radial direction from the center portion of mixing elements to the outer circumference is smaller than that of the inclination surface of the cross-sectional shape of the other partition walls 25*e* extending in the circumferential direction.

Figure 21:
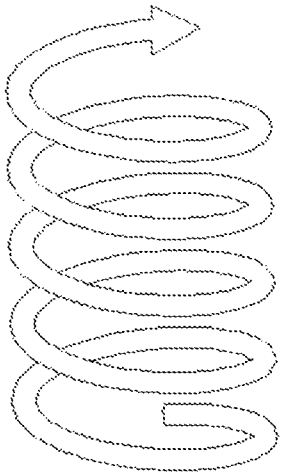
FIG. 21 is a conceptual diagram showing states of spiral flow of fluid mixed by the mixing unit of FIG. 20A.

In the fluid within mixing elements 21*g* and 21*h* having partition walls 25*e* and 25*f* shaped as described above, the flow in the circumferential direction is promoted more than in the radial direction, and resistance is given to the flow of the fluid in the radial direction by partition walls 25*e* in the circumferential direction, with the result that it is possible to produce spiral flow as shown in FIG. 21.

Thus, according to this sixth variation of the mixing unit, there is provided a mixing body or mixing unit including mixing elements each of which has a plurality of first through holes and a partition wall between the first through holes, wherein the partition wall is disposed in each of the mixing elements so as to produce a spiral flow.

(Seventh Variation of the Mixing Units)

Figure 23A:
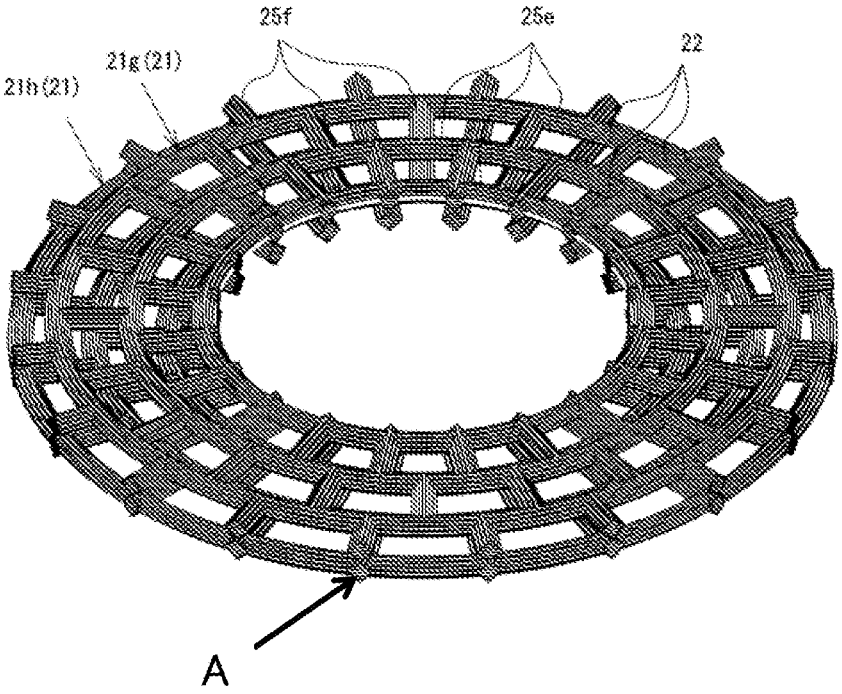
FIG. 23A is a perspective view of mixing elements of a mixing unit as a seventh variation of the mixing units.

Since mixing elements 21 may be formed to have various cross-sectional shapes as described above, as necessary, a plurality of members may be stacked. FIG. 23A is a perspective view of mixing elements 21*g* and 21*h* which are stacked, and FIG. 23B is a partial enlarged vertical cross-sectional view of a partition wall of the elements 21 (21*g* and 21*h*), which are a seventh variation of the mixing units of the foregoing embodiments.

As shown in FIG. 23A, mixing elements 21*g* and 21*h* include partition walls 25*e* and 25*f* whose cross-sectional outline is substantially rhombic. As shown in FIG. 23B, partition walls 25*e* and 25*f* are configured by stacking a plurality of plate members (here, seven plate members) having different width dimensions. The plate members are fixed to each other such as by adhesion or welding as necessary.

By stacking a plurality of plate member as described above, it is possible to freely obtain mixing elements 21*g* and 21*h* having various cross-sectional shapes that cannot be formed by pressing or the like.

Figure 23B:
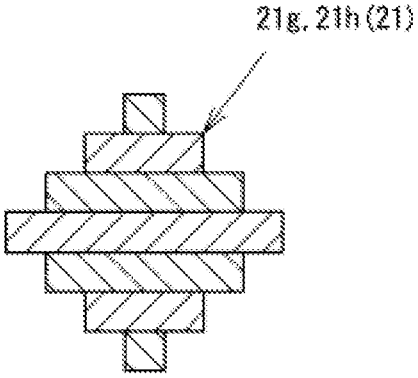
FIG. 23B is its partial cross-sectional view.

Although partition walls 25*e* and 25*f* shown in FIGS. 23A and 23B have ladder-shaped steps, it is possible to provide the partition wall having the inclined surfaces by chambering the plate members.

Eighth Embodiment

Figure 24A:
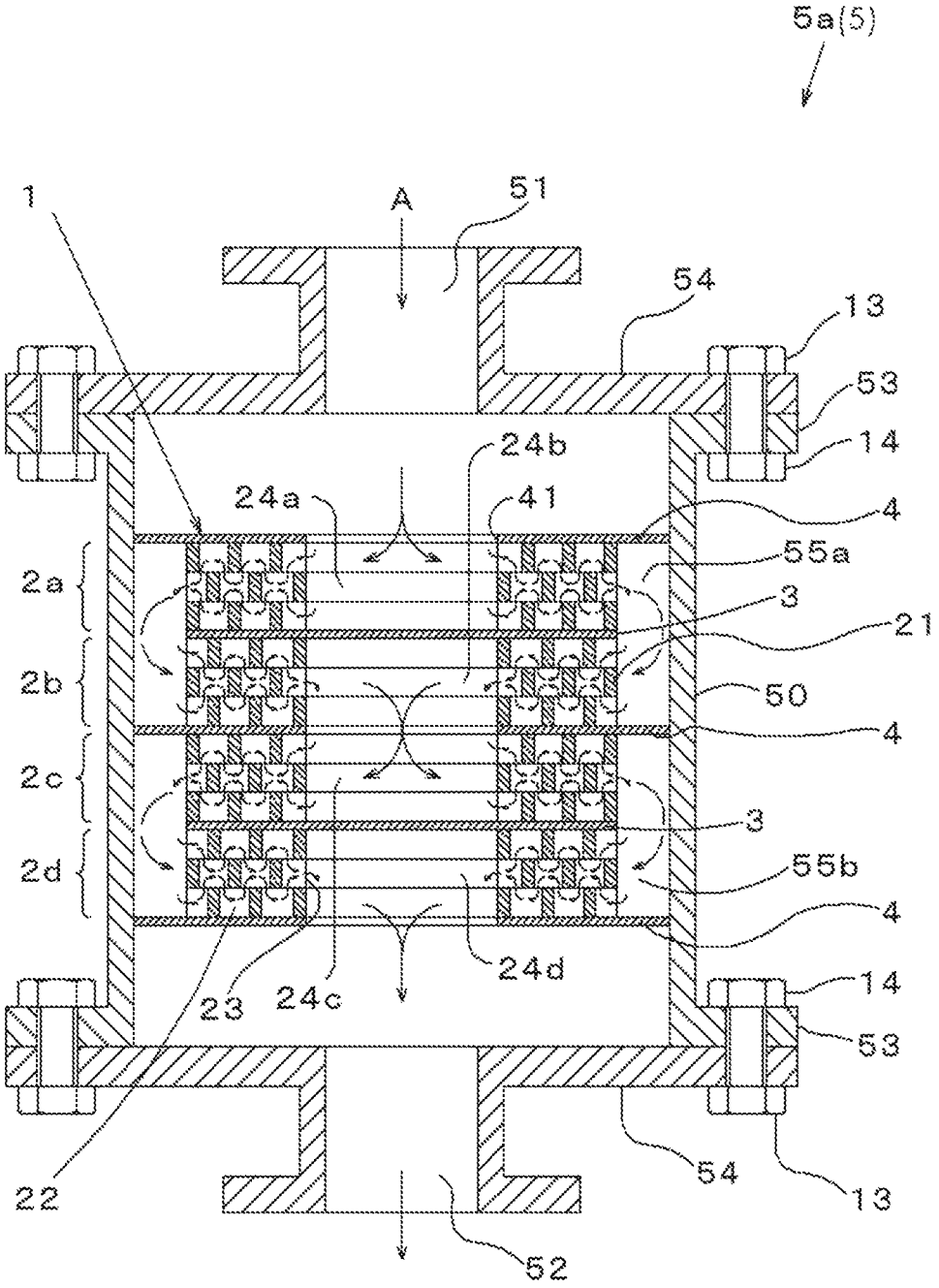
FIG. 24A is a cross-sectional view of a mixing device in accordance with an eighth embodiment of the present invention showing a state of flow of fluid within the mixing device.

FIG. 24A is a cross-sectional view of a mixing device 5*a* showing how fluid A flows within mixing device 5*a* in accordance with an eighth embodiment of the present invention.

In FIG. 24A, mixing device 5*a* includes flanges 54 having an inlet 51 and an outlet 52 and formed in the shape of an outer circumferential disc, a casing 50 having a flange 53 and formed in the shape of a cylinder to which flanges 54 are removably mounted, and a mixing unit 1 within casing 50. Mixing unit 1 includes four mixing bodies 2*a*, 2*b*, 2*c* and 2*d* in which a plurality of mixing elements 21 (here, three mixing elements) composed of discs described above are stacked.

In the side of inlet 51 of casing 50, a second plate 4 having an opening portion 41 in the center portion serving as an inlet of a first mixing body 2*a* and an outside diameter substantially equal to the inside diameter of the casing 50 is provided, and first mixing body 2*a* having mixing elements 21 is provided on a bottom surface of second plate 4. On a bottom surface of first mixing body 2*a*, a first plate 3 having an outside diameter substantially equal to the outside diameter of mixing elements 21 is provided. Then, second mixing body 2*b*, second plate 4, third mixing body 2*c*, first plate 3, fourth mixing body 2*d* and second plate 4 are sequentially disposed.

In mixing device 5*a* shown in FIG. 24A, mixing unit 1 may be fixed within casing 50 with fixing units such as bolts and nuts.

Each of mixing elements 21 has a plurality of first through holes 22 and a substantially circular second through hole 23 in the center portion. The inside diameters of second through holes 23 of mixing elements 21 are substantially equal to the inside diameter of the opening portion 41 of second plates 4. Second through holes 23 are substantially concentric with opening portions 41 of second plates 4. Mixing elements 21 are stacked, and thus second through holes 23 constitute a first hollow portion 24*a*, a second hollow portion 24*b*, a third hollow portion 24*c* and a fourth hollow portion 24*d*, which are hollow space portions. Hollow portions 24*a* to 24*d* are hollow portions corresponding to mixing bodies 2*a* to 2*d*, respectively.

A first annular space portion 55*a* is formed between an inner circumferential portion of casing 50 and the outer circumferential portion of first mixing body 2*a* and second mixing body 2*b*. A second annular space portion 55*b* is formed between an inner circumferential portion of casing 50 and the outer circumferential portion of third mixing body 2*c* and fourth mixing body 2*d*.

Within mixing bodies 2*a* to 2*d*, first through holes 22 communicate with each other in a direction in which mixing element 21 extends, and part thereof are open to the inner circumferential surface and the outer circumferential surface of mixing elements 21.

First plate 3 and second plate 4 arranged on both end portions of each of the mixing bodies 2*a* to 2*d* and opposite each other close first through holes 22 in both end portions of each of mixing bodies 2*a* to 2*d* in the stacking direction. This prevents fluid A within mixing body 2 from flowing out through first through holes 22 in both end portions of each of mixing bodies 2*a* to 2*d* in the stacking direction. Fluid A is reliably passed within mixing bodies 2*a* to 2*d* in the direction in which each of mixing elements 21 extends.

In mixing device 5*a* configured as described above, for example, fluid A flows in through inlet 51 with appropriate pressure, and flows into first hollow portion 24*a*. Then, fluid A flows into first mixing body 2*a* through first through holes 22 open to inner circumferential surface of first hollow portion 24*a*, and is passed in the outer circumferential direction through first through holes 22 communicating with each other. Then, fluid A flows out through first through holes 22 open to the outer circumferential surface of first mixing body 2*a*, and flows into first annular space portion 55*a*.

Then, fluid A flows into second mixing body 2*b* through first through holes 22 open to the outer circumferential surface of second mixing body 2*b*, and is passed in the inner circumferential direction through first through holes 22 communicating with each other. Then, fluid A flows out through first through holes 22 open to the inner circumferential surface of second hollow portion 24*b*, and flows into second hollow portion 24*b*.

Thereafter, fluid A flows from third hollow portion 24*c* to third mixing body 2*c* to second annular space portion 55*b* to fourth mixing body 2*d* and to fourth hollow portion 24*d*, and flows out through outlet 52 via opening portions 41 of second plates 4 serving as an outlet of the mixing unit 2*d*.

As described above, fluid A is passed through holes 22 communicating with each other while flowing within mixing bodies 2*a* to 2*d* from the inner circumferential portion to the outer circumferential portion or from the outer circumferential portion to the inner circumferential portion in a meandering manner, with the result that fluid A is highly mixed. In this way, fluid A flows in through inlet 51 of mixing device 5*a*, is highly mixed and flows out through outlet 52.

In mixing device 5*a* described above, first plate 3 and second plate 4 are arranged on both end portions of each of mixing bodies 2*a* to 2*d* and opposite each other to allow the direction in which fluid A flows within mixing body 2 to be changed from the inner circumferential portion to the outer circumferential portion or vice versa, that is, from the outer circumferential portion to the Inner circumferential portion. Thus, fluid A is passed through a larger number of first through holes 22 communicating with each other, with the result that the degree of mixing may be further increased.

Even in mixing device 5, each of the hollow portions 24*a* to 24*d* is sufficiently larger in size than first through holes 22, and second through holes 23 of mixing elements 21 constituting hollow portion 24 are substantially equal in inside diameter to each other, and are substantially concentric with each other. Hence, the flow resistance to fluid A flowing through hollow portions 24*a* to 24*d* is smaller than that of fluid A flowing through mixing bodies 2*a* to 2*d*, and so the loss of pressure is also smaller. Therefore, even when a large number of mixing elements 21 are stacked, fluid A substantially uniformly reaches the inner circumferential portions of mixing elements 21 regardless of the position in the mixing direction, and substantially uniformly flows within mixing bodies 2*a* to 2*d* from the inner circumferential portion to the outer circumferential portion or vice versa, that is, from the outer circumferential portion to the inner circumferential portion.

Fluid A flows from annular space portions 55*a* and 55*b* into mixing bodies 2*b* and 2*d* in the same manner as hollow portions 24*a* and 24*d* described above.

Furthermore, since, in mixing device 5*a* described above, fluid A may be mixed within casing 50 having inlet 51 and outlet 52, it is possible to use mixing device 5*a* as an in-line static mixing device and mix fluid A continuously.

Moreover, since the outer circumferential shapes of mixing element 21, first plate 3 and second plate 4 are circular and thus casing 50 may be cylindrical, it is possible to increase the pressure resistance of casing 50. Thus, it is possible to mix fluid A at a high pressure.

Instead of mixing unit 1, mixing elements 21*d* of FIG. 9B in which second through holes are not provided as in mixing unit 1*c* of FIG. 9B may be used.

Figure 24B:
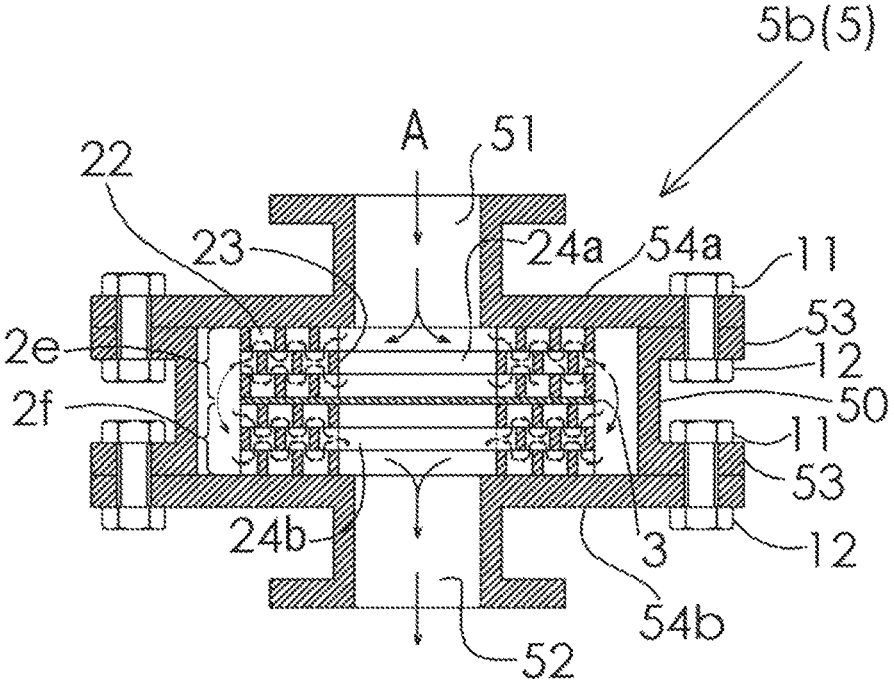
FIGS. 24B and 24C are cross-sectional views of the mixing devices as modifications of the device of FIG. 24A.

FIG. 24B is a cross-sectional view of a mixing device 5*b* wherein each of flanges 54*a* and 54*b* serves as a second plate, and shows how fluid A flows within mixing device 5*b* as a modification of this eighth embodiment of the present invention. Mixing device 5*b* includes a first plate 3, and a pair of mixing bodies 2*e* and 2*f* which are stacked to sandwich first plate. Opposite surfaces of mixing bodies 2*e* and 2*f* contacting first plate 3 are in contact with inner surfaces of flange 54*a* and 54*b* respectively. An inlet 51 disposed on flange 54*a* communicates with a hollow portion 24*a* of stacked unit 2*e*, and an outlet 52 disposed on flange 54*b* communicates with a hollow portion 24*b* of stacked unit 2*f*.

Figure 24C:
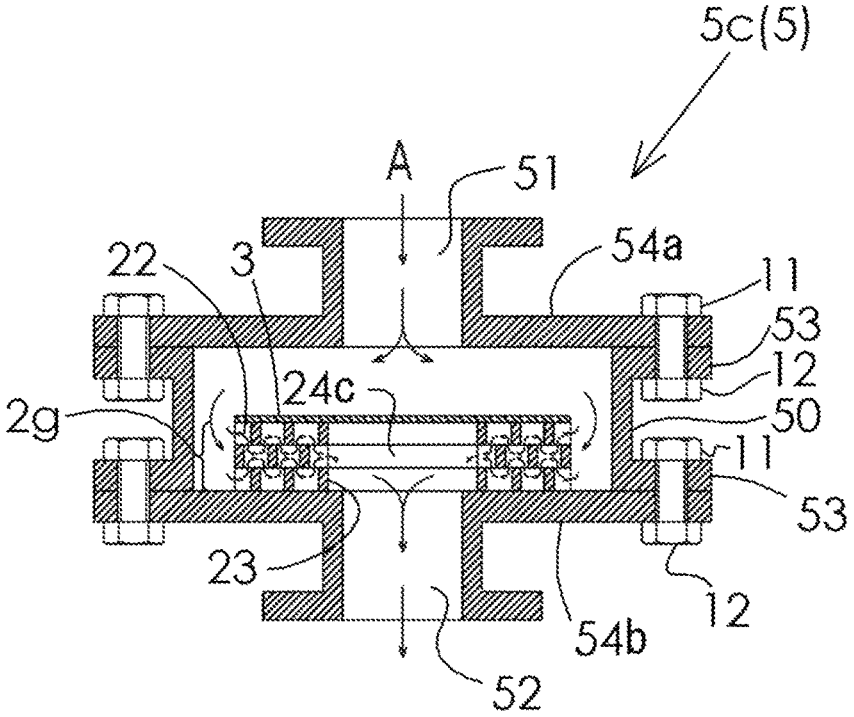

FIG. 24C is a cross-sectional view of a mixing device 5*c* as a further modification of the eighth embodiment of the present invention. Mixing device 5*c* includes a casing 50, a pair of flanges 54*a* and 54*b*, a mixing body 2*g*, and a first plate 3 disposed on one surface of mixing body 2*g*. Other opposite surface of mixing body 2*g* comes in contact with an inner surface of flange 54*b*, and outlet 52 communicates with a hollow portion 24*c* of mixing body 2*g*.

In the above described mixing devices 5*b* and 5*c* of FIGS. 24B and 24C, flanges 54*a* and 54*b* serve same components as second plates 4, whereby fluid A flows within mixing bodies 2*e* to 2*g* from the inner circumferential portion to the outer circumferential portion or vice versa, that is, from the outer circumferential portion to the inner circumferential portion, and is mixed by passing through first through holes 22.

As in the variations of the mixing unit, mixing device 5 (5*a* to 5*c*) according to the present invention is not limited to the embodiments of the mixing devices described above. Variations are possible within the scope of the present invention, and it is possible to practice variations.

Ninth Embodiment

Figure 25A:
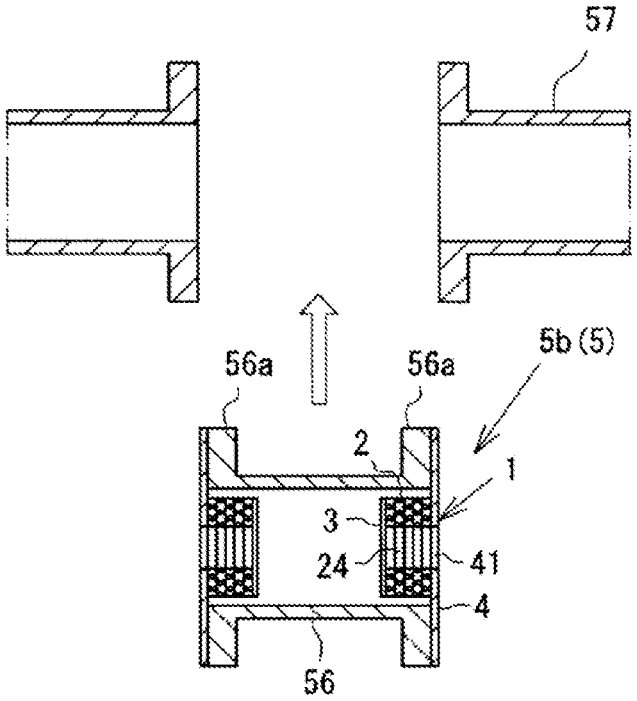
FIG. 25A is a cross-sectional view of a mixing device in accordance with a ninth embodiment of the present invention.
Figure 25B:
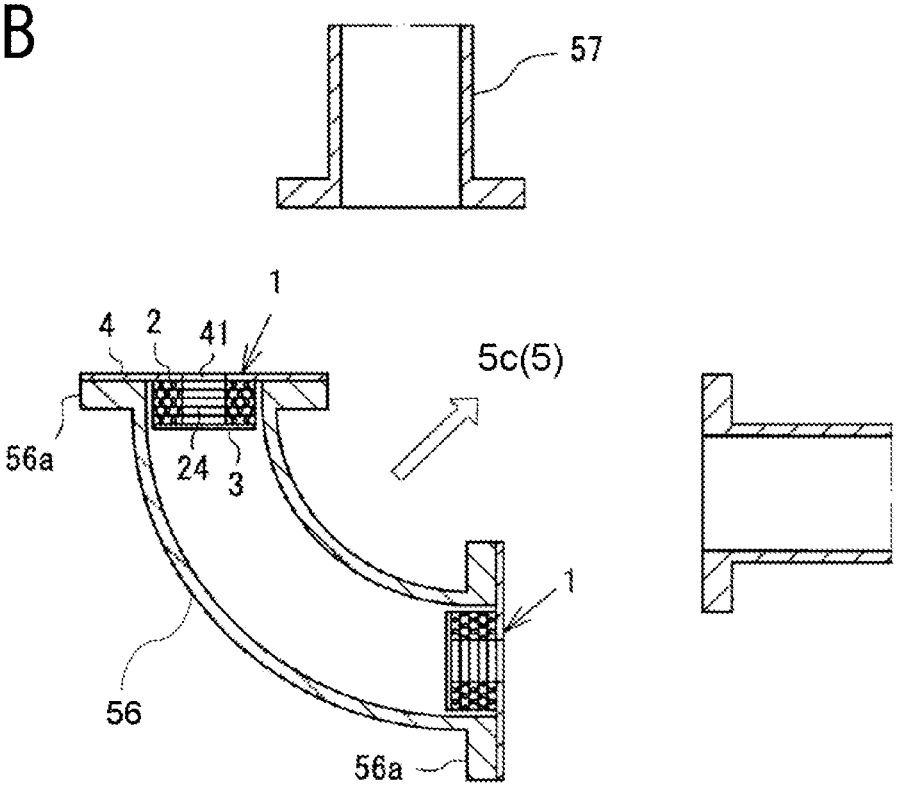
FIG. 25B is a cross-sectional view of a mixing device as a modification of the mixing device of FIG. 25A.
Figure 25C:
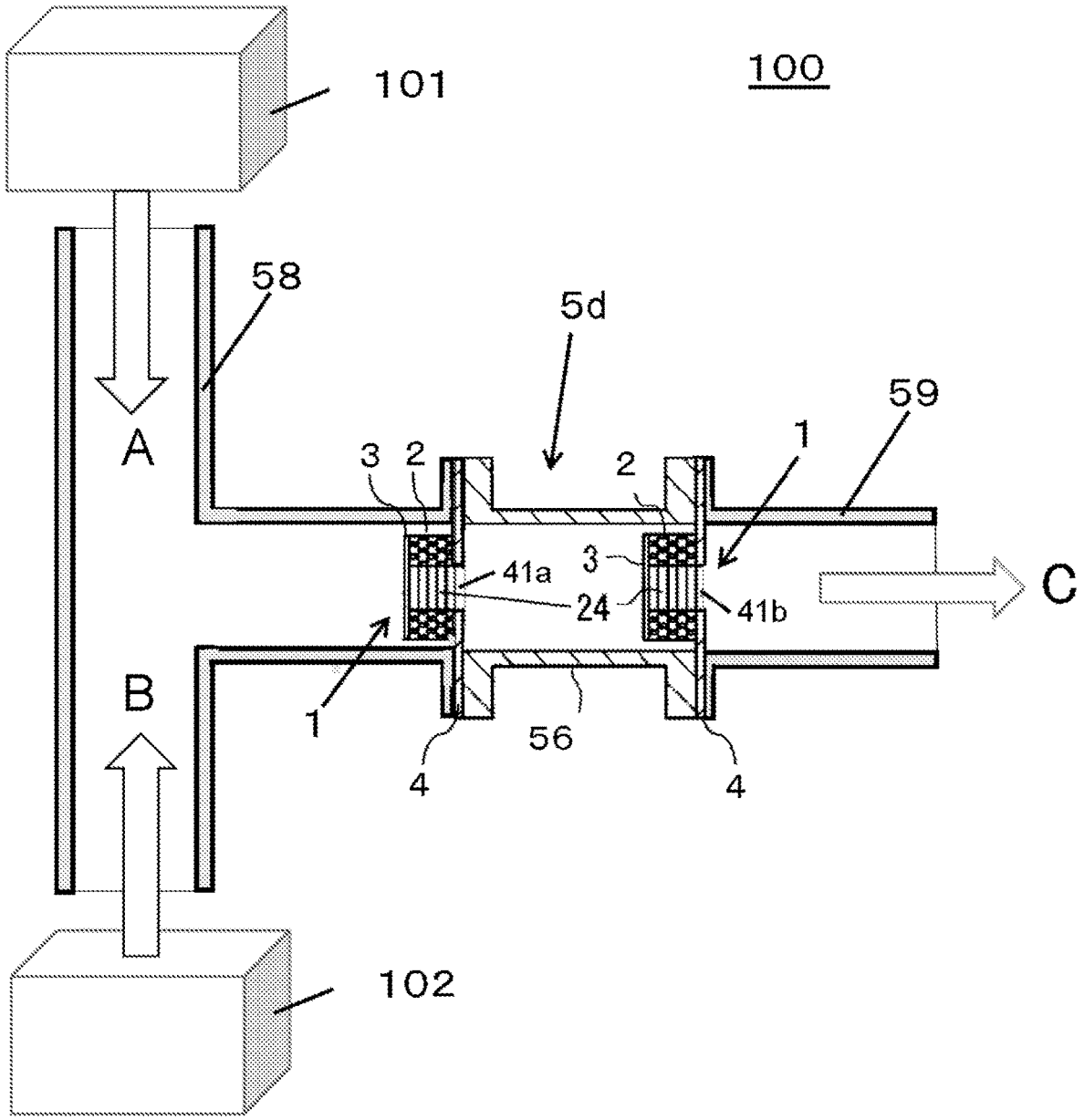
FIG. 25*c* is a cross-sectional view of a mixing system as another modification of the device of FIG. 25A

FIG. 25A is a cross-sectional view of a mixing device 5*b* having a pair of mixing units 1 disposed within a tube member 56 through which a fluid flows in accordance with a ninth embodiment of the present invention. FIG. 25B is a cross-sectional view of a mixing device 5*c* having a pair of mixing units 1 disposed within a tube member 56 as a modification of this embodiment, and FIG. 25C is a schematic view of a mixing system 100 employing a mixing device 5*d* as another modification of this ninth embodiment of the present invention.

FIG. 25A shows a linear type of mixing device 5*b*, and FIG. 25B shows a curved type of mixing device 5*c*. In each of mixing devices 5*b* and 5*c*, mixing unit 1 is provided within tube member 56 at both ends thereof connected to a pipe line 57 so as not to protrude in the longitudinal direction of tube member 56. In other words, a first plate 3 of the mixing unit 1 is formed to have the same size as the outer circumference of a mixing body 2, and a second plate 4 is formed to have a size corresponding to a flange 56*a* of tube member 56. An opening portion 41 of a second plate 4 is equal in size to a hollow portion 24 of mixing body 2.

In order for mixing unit 1 to be fixed to tube member 56, first plate 3 of mixing unit 1 is inserted into tube member 56, and second plate 4 is joined to the outer side surface of flange 56*a*.

Mixing unit 1 is provided at each end of tube member 56 in FIGS. 25A and 25B. If desired, one unit of mixing unit 1 may be provided at one end, or in an intermediate portion of tube member 56 in the longitudinal direction.

Since in mixing device 5*b* configured as described above, the mixing unit 1 does not protrude in the longitudinal direction of tube member 56, mixing device 5*b* may be used by being attached to the pipe line 57 that has been already provided. Thus, it is possible to mix fluid within a piping system as necessary. It is also easy to perform maintenance.

Since mixing unit 1 has mixing effects as described above, it is possible to sufficiently perform mixing, it is not necessary to provide a mixing device separately and it is also possible to save space.

In addition to the example described above, mixing device 5 (5*b*, 5*c*) of the present invention may be configured as follows.

The outer circumferential shapes of mixing element 21, first plate 3 and second plate 4 are not limited to be circular. This is because, even if the outer circumferential shapes are not circular, there is no problem at all in practicing the invention.

Returning to FIG. 25C, there is shown mixing system 100 including mixing device 5*d* modified from mixing device 5*b* of FIG. 25A by disposing mixing units 1 in the same direction, a fluid supplying unit 101 for supplying a fluid A, a fluid supplying unit 102 for supplying a fluid B, a pipe 58 as a guide member connecting mixing device 5*d* with fluid supplying units 101 and 102, and a pipe 59 a guide member for exhausting mixed fluid mixed by mixing device 5*d*.

Fluid supplying units 101 and 102 may be any device or system for supplying fluids A and B to mixing device 5*d* with driving means (not shown in drawings) so that fluids A and B flow into one mixing unit 1 to be mixed thereby by avoiding a first plate 3 and passing through a mixing body 2, a hollow portion 24 and an opening portion 41*a* of a second plate 4.

Fluids A and B mixed by the one mixing unit 1 pass through within tube member 56 to be blocked by a first plate 3 of another mixing unit 1 but further mixed by another mixing body 2, and pass through another hollow portion and an opening 41*b* of another second plate to be fed out to an external device (not shown) or externally through pipe 59 as a mixed fluid C.

A pair of mixing units 1 are employed in FIG. 25C. If desired, one unit of mixing unit 1 may be provided at one end, or in an intermediate portion of tube member 56 in the longitudinal direction. The mixing unit 1 may be disposed in the opposite direction. More than two mixing units 1 may be disposed within tube member 56 or a pipe representing pipe 58, tube member 56 and pipe 59 as a guide member. Pipe 58 may be modified to any guide member including a coaxial double pipe having an internal pipe for fluid A and an external pipe for fluid B, and more than two supplying units 101 and 12 may be employed to mix more than two fluids A and B as needed. Thus, a desired number of fluids can be mixed by a desired number of supplying units. Accordingly, there is provided a mixing device including a mixing unit, a fluid supplying unit, and a guide member connected between the fluid supplying unit and the mixing unit to allow fluid to pass into the mixing unit through the guide member and pass out therefrom.

A fluid that is mixed is not limited to a gas or a liquid; it may be a solid mixture consisting of a liquid and a powder and granular material or the like.

With respect to applications, in addition to an application for making the concentration of a fluid uniform, for example, the mixing device can also be used for mixing the same type of fluid having different temperatures so that the fluid has a uniform temperature.

Mixing unit 1 or mixing device 5 may be used in a place, such as a diesel automobile, an exhaust gas line, or any device or system demanding high degree mixing.

Tenth Embodiment

Figure 26A:
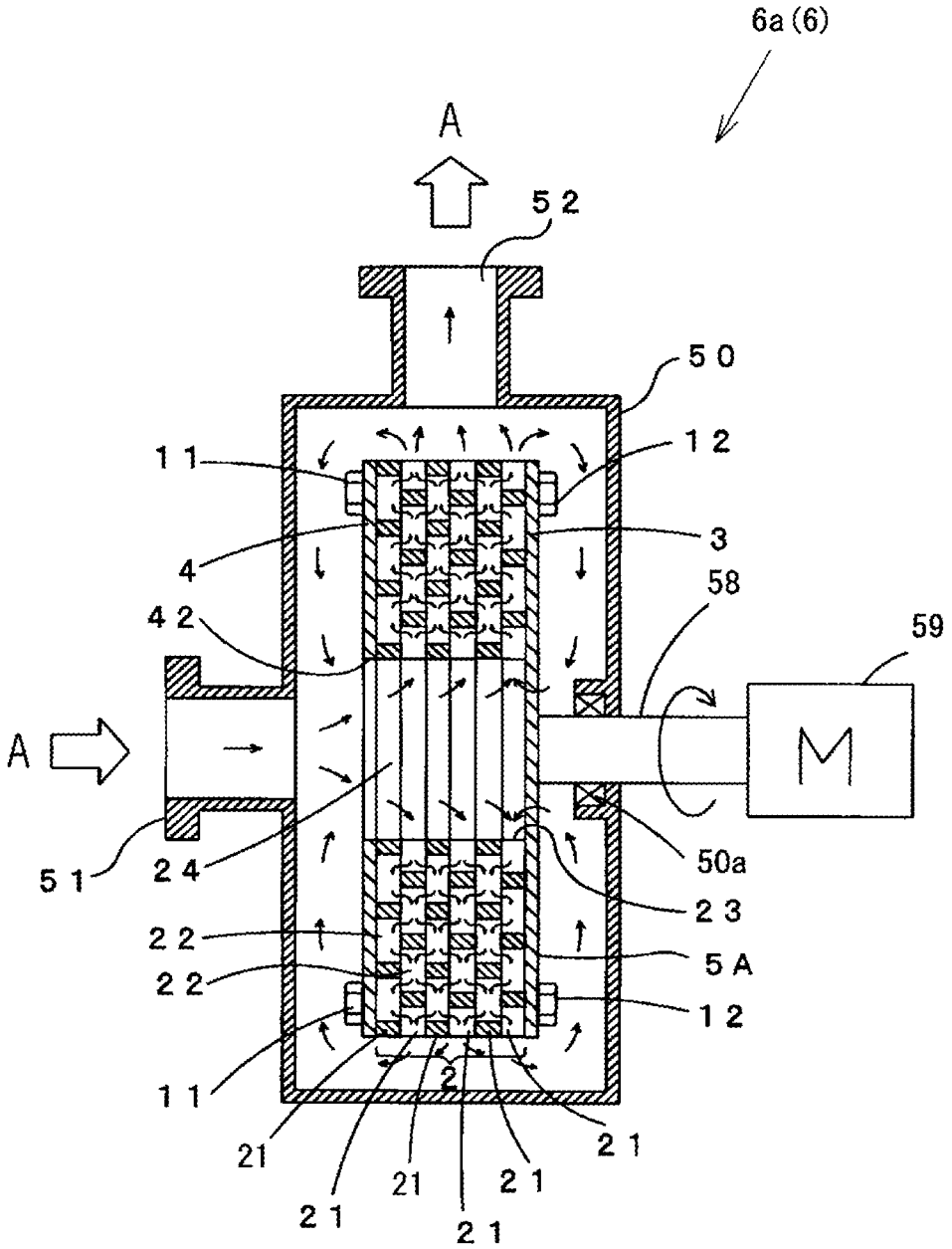
FIG. 26A is a cross-sectional view of a pump mixture in accordance with a tenth embodiment of the present invention.

FIG. 26A is a cross-sectional view showing a mixer as a pump mixer 6*a* in accordance with a tenth embodiment of the present invention, showing flow of fluid A within the pump mixer.

As shown in FIG. 26A, pump mixer 6*a* includes a mixing unit 1 having a cylindrical external shape, a cylindrical casing 50, a rotation shaft 58 and an electric motor 59 serving as a drive source. Electric motor 59 drives and rotates mixing unit 1; in this tenth embodiment, electric motor 59 is driven to rotate by the supply of electric power from an unillustrated power supply. While rotation shaft 58 is coupled to electric motor 59, rotation shaft 58 supports mixing unit 1*a* and a seal member 50*a* is provided to a portion in which rotation shaft 58 slides with respect to casing 50 so as to prevent the leakage of fluid A within pump mixer 6*a*.

Casing 50 has an inlet 51 serving as a suction port and an outlet 52 serving as a discharge port formed in the shape of a flange; fluid A is sucked into pump mixer 6*a* through inlet 51 and is discharged through outlet 52.

Figure 26B:
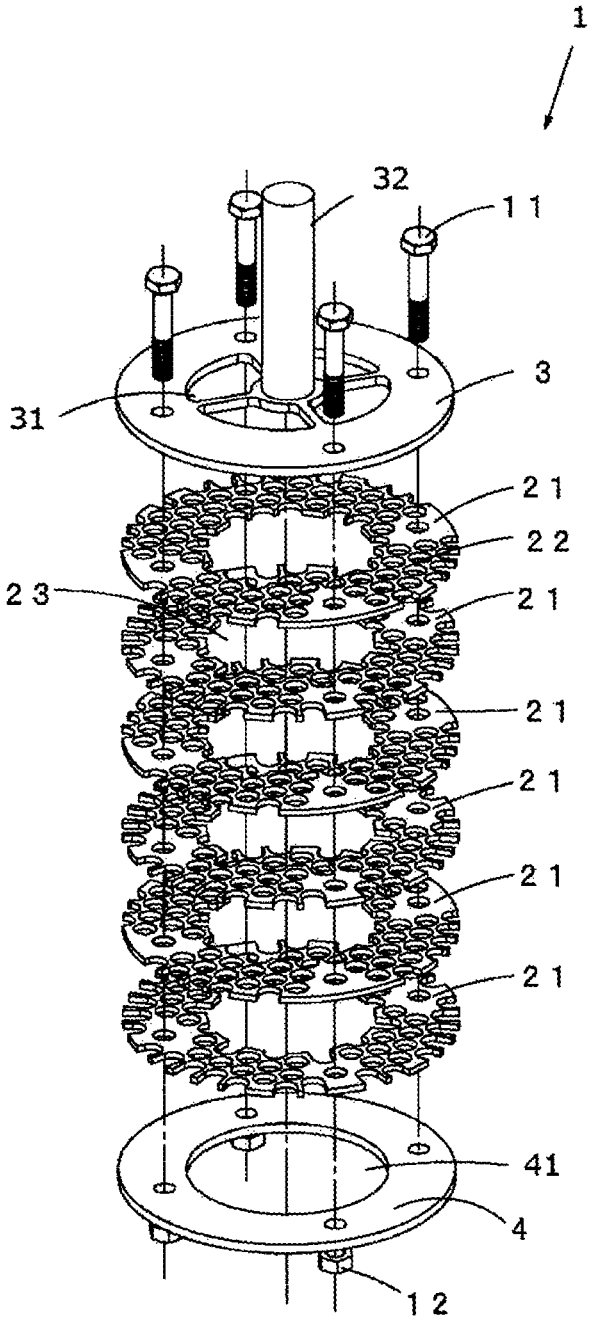
FIG. 26B is an exploded perspective view the mixing unit employed in the pump mixture of FIG. 26A.

As shown in FIG. 26B, mixing unit 1 has an axis portion 32 connected to the rotation shaft 58. Axis portion 32 is provided at the center of first plate 3; an opening portion 31 is formed around axis portion 32. As with opening portion 41 of second plate 4, opening portion 31 is a portion through which the fluid flows. Mixing unit 1 is configured as described above.

As the mixing unit 1 is driven to rotate by electric motor 59, fluid A sucked through inlet 51 of pump mixer 6*a* flows into hollow portion 24 having a cylindrical shaped hole through opening portions 31 of first plate 3 and opening portion 41 of second plate 4 of mixing unit 1. Then, fluid A flows into mixing body 2 through first through holes 22 in mixing elements 21 open to the inner circumferential portion of hollow portion 24.

A force acting outwardly in a radial direction resulting from the centrifugal force is applied to fluid A that has flowed into mixing body 2. Fluid A receiving the force is radially passed through first through holes 22 communicating with each other within mixing body 2 from the inner circumferential portion to the outer circumferential portion, and is discharged outwardly from the outer circumferential portion of mixing body 2 through first through holes 22 open to the outer circumferential portion. Fluid A that has flowed out is discharged from pump mixer 6*a* through outlet 52.

Part of fluid A that has flowed out of mixing unit 1 flows again into hollow portion 24 through the opening portion 31 of first plate 3 and opening portion 41 of second plate 4, further flows into mixing body 2 and flows out from the outer circumferential portion of mixing body 2, with the result that fluid A circulates within mixing body 2 of mixing unit 1.

Then, while fluid A substantially radially flows through first through holes 22 communicating with each other within mixing body 2 from the inner circumferential portion to the outer circumferential portion, the fluid is repeatedly dispersed, combined, reversed and subjected to turbulent flow, eddying flow, collision and the like, and thus the fluid is highly mixed.

Although, in tenth embodiment, casing 50 is cylindrical, the present invention is not limited to this con figuration. The opening portion 31 may be omitted in first plate 3 if desired.

When the required degree of mixing is low, the clearance between mixing unit 1 and inlet 51 is reduced as in a conventional centrifugal pump and thus the flow rate of fluid A circulating within the pump mixer 6*a* may be reduced.

Figure 26C:
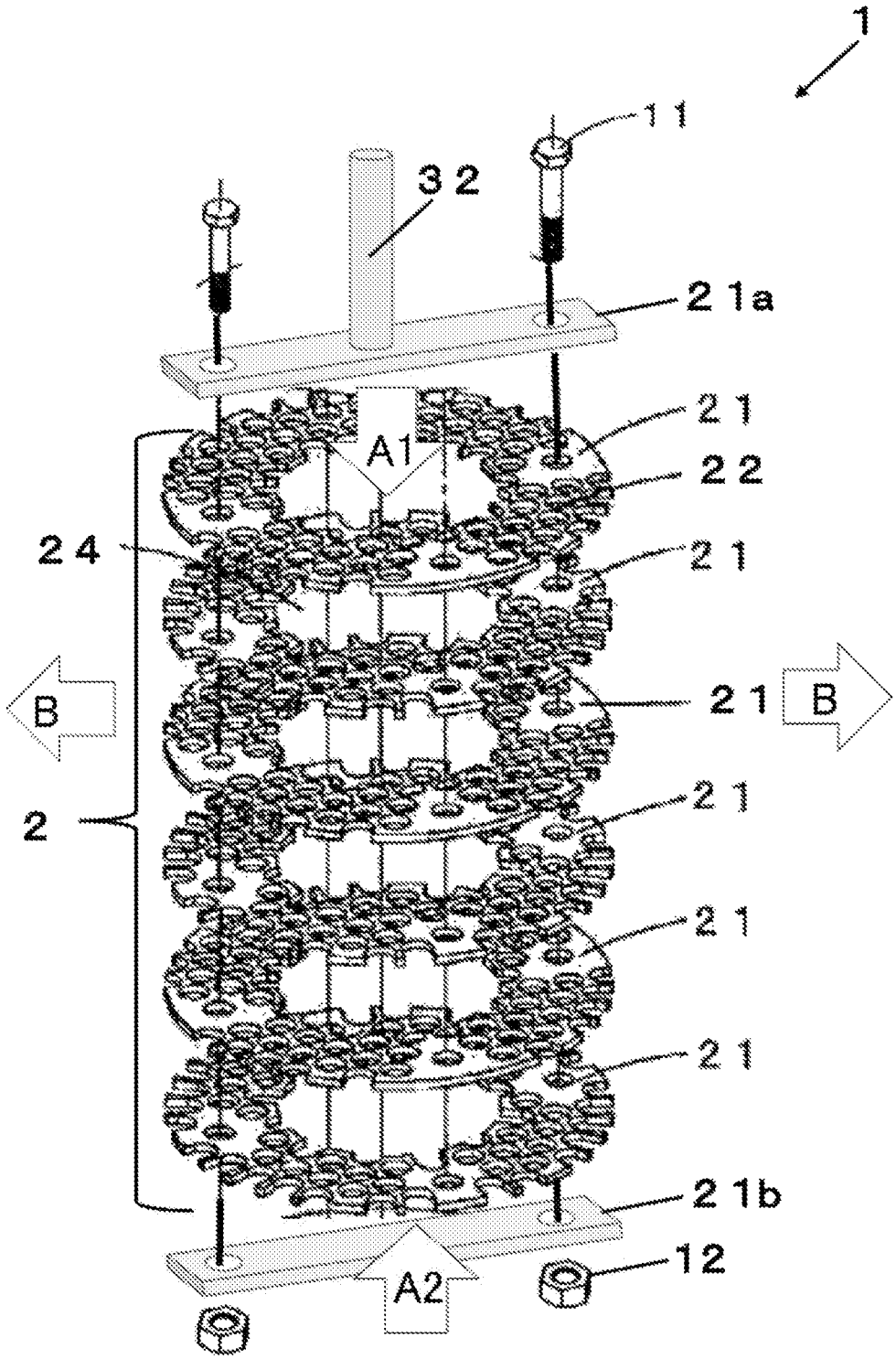
FIG. 26C is an exploded perspective view a mixing unit which may be employed in the pump mixture of FIG. 26A as a modification of FIG. 26B.

FIG. 26C is a perspective view of a mixing unit 1 modified from the mixing unit 1 of FIG. 26B, which can be applied to the pump mixer of FIG. 26A as a modification of this embodiment. The modified mixing unit 1 includes an upper attachment part 21*a* having axis portion 32, mixing body 2, and a lower attachment part 21*b*. Mixing body 2 includes mixing elements 21 sandwiched by attachment parts 21*a* and 21*b* which are fixed with bolts 11 and nuts 12.

Figure 32:
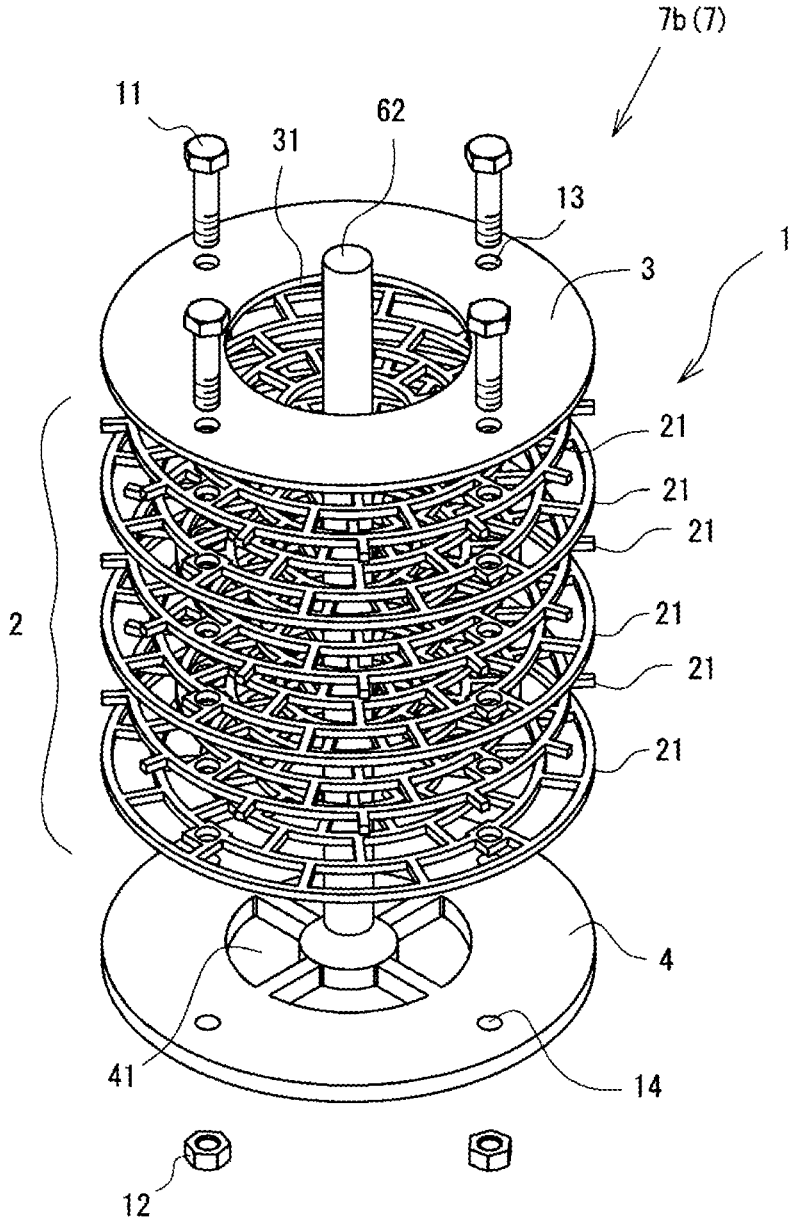
FIG. 32 is an exploded perspective view of an agitation impeller as a modification of the agitation impeller of FIG. 30.

In this modification, first plates 3 and second plate 4 of FIG. 26B are replaced with attachment parts 21*a* and 21*b*, whereby the same fluid movements as those of FIG. 26B can be performed without first and second plates. The lower attachment part 21*b* may be omitted as necessary. If desired, the upper attachment part 21*a* may be omitted by connecting attachment part 21*b* with axis portion 32 to support mixing body 2 as shown in FIG. 32.

As the mixing unit 1 of FIG. 26C is driven to rotate through axis portion 32 by electric motor 59 (FIG. 26A), fluids A1 and A2 from fluid A sucked through inlet 51 of pump mixer 6*a* (FIG. 26A) flow into hollow portion 24, and further into mixing body 2 through first through holes 22 in mixing elements 21 open to the inner circumferential portion of hollow portion 24.

A force acting outwardly in a radial direction resulting from the centrifugal force is applied to fluids A1 and A2 that have flowed into mixing body 2. Fluids A1 and A2 receiving the force are radially passed through first through holes 22 communicating with each other within mixing body 2 for mixing from the inner circumferential portion to the outer circumferential portion, and are discharged outwardly from the outer circumferential portion of mixing body 2 through first through holes 22 open to the outer circumferential portion as mixed fluid B as shown in FIG. 26C. Its subsequent fluid movements are same as above-described fluid movements in FIGS. 26A and 26B with the same mixing advantages.

Mixing elements 21 may be replaced with mixing elements of the foregoing embodiments including mixing elements having concentric circular partitions like mixing elements 21 of FIG. 2. If desired, mixing body 2 may be made by pressing a plurality of mixing elements each having an engaging past or 3D printing with forming a single unit without bolts 11.

According to mixing units of FIGS. 26B and 26C, there is provided a mixing unit or a mixing body including mixing elements that are stacked in a stacking direction and that extend in an extending direction wherein the mixing elements have a plurality of first through holes to form a flow path therein, and the mixing elements are arranged such that part or all of the first through holes in one of the mixing elements communicate with first through holes in the adjacent mixing elements to allow fluid to be passed in the extending direction in which the mixing element extends and to be divided as the fluid passes into the mixing elements. The mixing unit without first and second plates shown in FIG. 26C can be applied to other embodiments of the present invention for rotation use of the mixing unit, including the mixing system of FIG. 29.

Figure 27A:
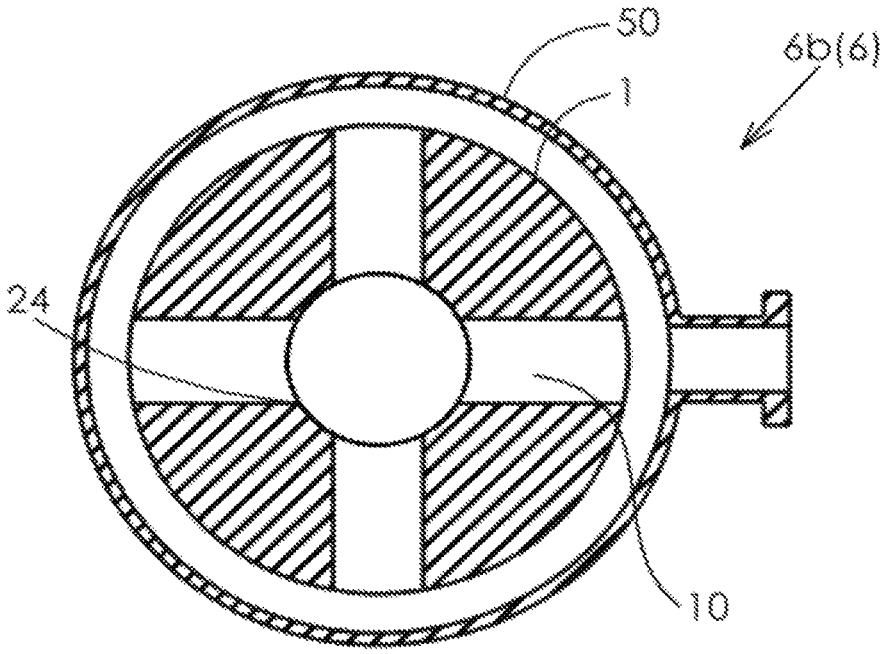
FIG. 27A shows a sectional plan view of a pump mixture as a modification of the pump mixture of FIG. 26A and its cross sectional view.
Figure 27A:
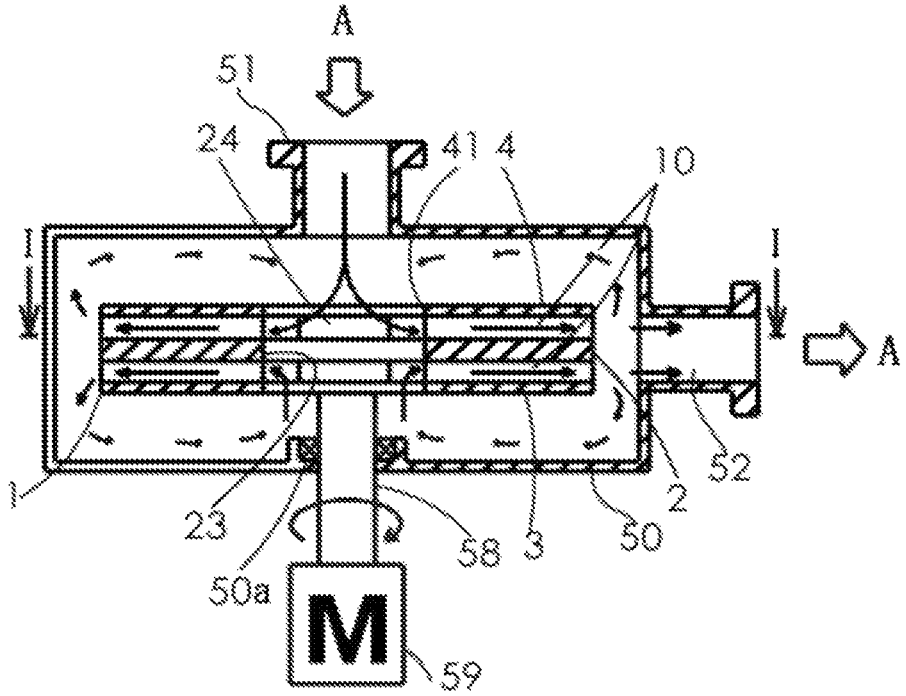

FIG. 27A shows a plan sectional view and a cross sectional view of a mixing device as a pump mixer 6*b* as a modification of pump mixer 6*a* of FIG. 26A. Pump mixer 6*b* includes a casing 50 and a mixing unit 1 disposed within casing 50*a*. Mixing unit 1 includes a cylindrical shaped hollow portion 24 passing through in a coaxial (vertical) direction of mixing unit 1, and four flow paths 10 in two layers radially expanding from hollow portion 24 to circumferential direction thereof which are closed by first layer or plate 3 and second layer or plate 4.

In pump mixer 6*b*, fluid A taken into mixing unit 1 from an inlet 51 by rotation of mixing unit 1 is mixed by passing flow paths 10 from hollow portion 24 of mixing unit 1 to the external circumferential portion. A part of fluid A passing out from the external circumferential portion of mixing unit 1 re-enters into hollow portion 24 to be re-circulated, and remaining part of fluid A is fed out through outlet 52 outwardly.

Figure 27B:
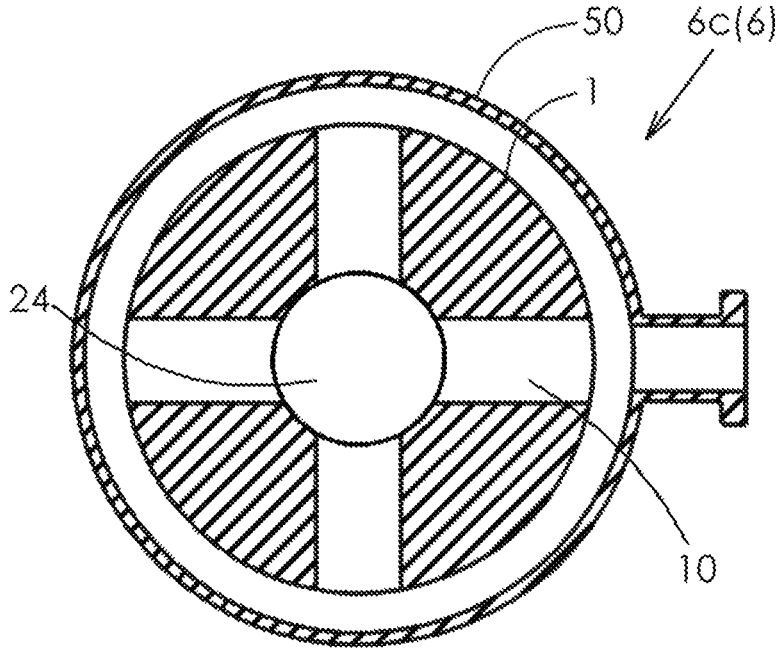
FIG. 27B shows a sectional plan view of a pump mixture as another modification of the pump mixture of FIG. 26A and its cross sectional view.
Figure 27B:
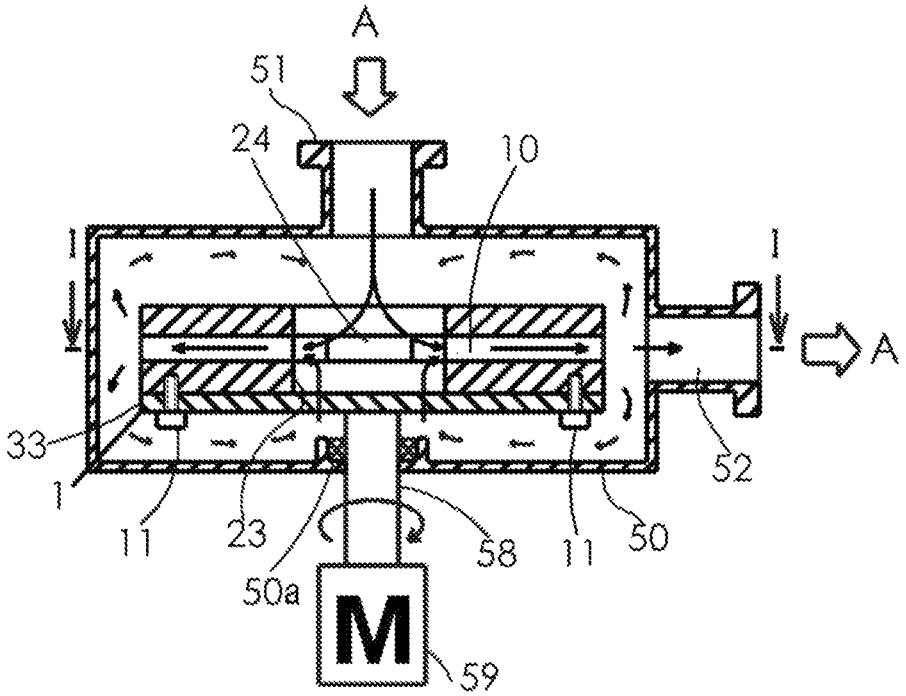

FIG. 27B shows a plan sectional view and a cross sectional view of a pump mixer 6*c* as another modification of pump mixer 6*a* of FIG. 26A. Pump mixer 6*c* includes casing 50 and mixing unit 1, but mixing unit 1 has four flow paths 10 in a single layer. Mixing unit 1 may be a mixing body formed by 3-D printing as a single unit.

Figure 28A:
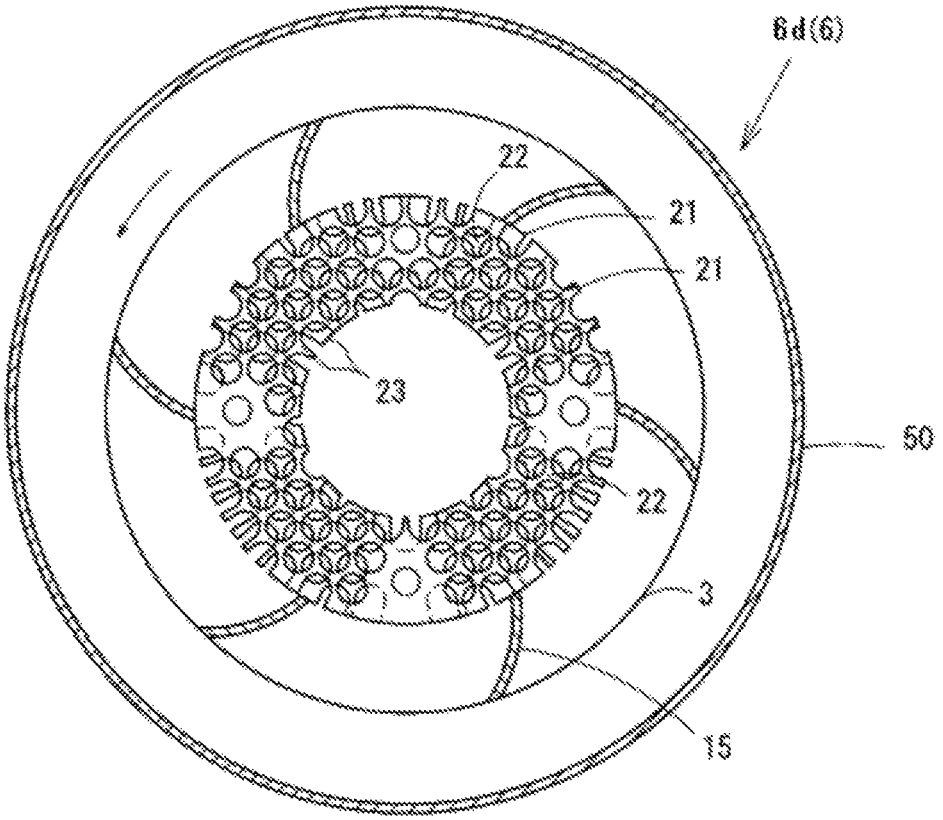
FIG. 28A is a cross-sectional plane view of a pump mixer as a modification of a tenth embodiment of the present invention.
Figure 28B:
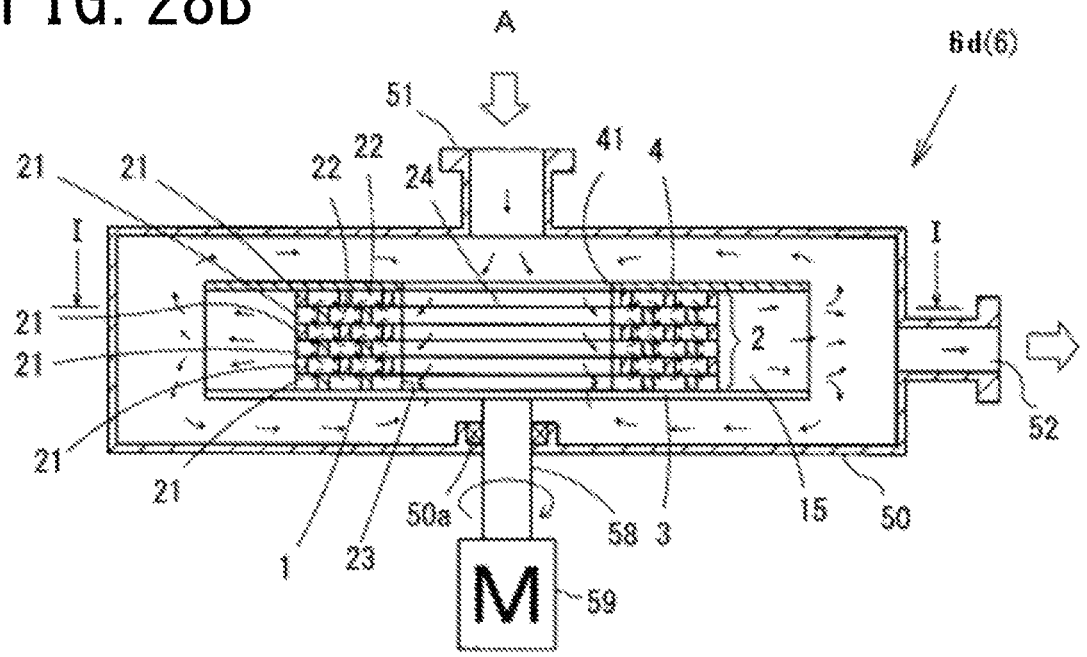
FIG. 28B is a cross-sectional view of the pump mixer of FIG. 28A showing how a fluid flows within the pump mixer.

FIGS. 28A and 28B are diagrams showing a pump mixer 6*d* as still another modification of the tenth embodiment of the present invention. FIG. 28A is a cross-sectional view taken along line I-I of FIG. 28B which is a cross-sectional view showing how fluid A flows within the pump mixer 6*d*.

The pump mixer 6*d* differs from the pump mixer 6*a* of FIG. 26A in that the outer circumferential shape of first plate 3 and second plate 4 is larger than that of mixing elements 21, and that blades 15 (here, six blades) extending in the direction in which mixing elements 21 are stacked are provided in the outer circumferential portion of mixing body 2, that is, in a space formed by first plate 3 and the second plate 4.

As mixing unit 1 rotates, fluid A that has flowed out of the outer circumferential portion of mixing body 2 flows out of the mixing unit 1 by receiving a force from blades 15. Since the ends of blades 15 are closed by first plate 3 and second plate 4, fluid A that has flowed out of the outer circumferential portion of mixing body 2 efficiently receives the force from blades 15, and thus it is possible to increase the pressure of fluid A discharged from pump mixer 6*d*.

As mixing elements of the mixing unit 1, mixing elements 21*e* and 21*f* shown In FIG. 15 may be used, and thus fluid A is mixed and receives the force efficiently.

Although blades 15 are provided in the space formed by first plate 3 and second plate 4, the present invention is not limited to this configuration. For example, another disc may be attached to mixing unit 1 to fix blades 15. Although blades 15 are provided to extend in a direction perpendicular to the direction in which mixing elements 21 extend, the present invention is not limited to this configuration. Blades 15 may be inclined as long as the effects of the present invention are achieved. The shape of blades 15 may be formed to other shape as necessary.

The other parts of the configuration of and the other effects of pump mixer 6*d* according to this modification of the pump mixer 6 are the same as those of pump mixer 6*a* of FIG. 26A according to the tenth embodiment. According to one or more embodiments of the present invention, two or more number of inlets (51) may be employed in that respectively intake different external flows A. The mixers of this tenth embodiment can be used not only as a pump mixer but also as other mixing device having a rotating mixing unit.

According to this tenth embodiment, there is provided a mixer including, a casing having a suction port that sucks fluid, and a discharge port that discharges fluid mixed within the casing, a mixing unit supported by the casing for a rotatable movement around a rotational axis within and relative to the casing, and having a hollow part provided with an opening port around the rotational axis; and a flow path disposed within the mixing unit communicating the hollow part with a periphery of the mixing unit, wherein the casing sucks the fluid through the suction port from an outside of the casing into an inside of the casing, mixes the fluid within the casing, and discharges the fluid through the discharge port to the outside of the casing.

Eleventh Embodiment

Figure 29:
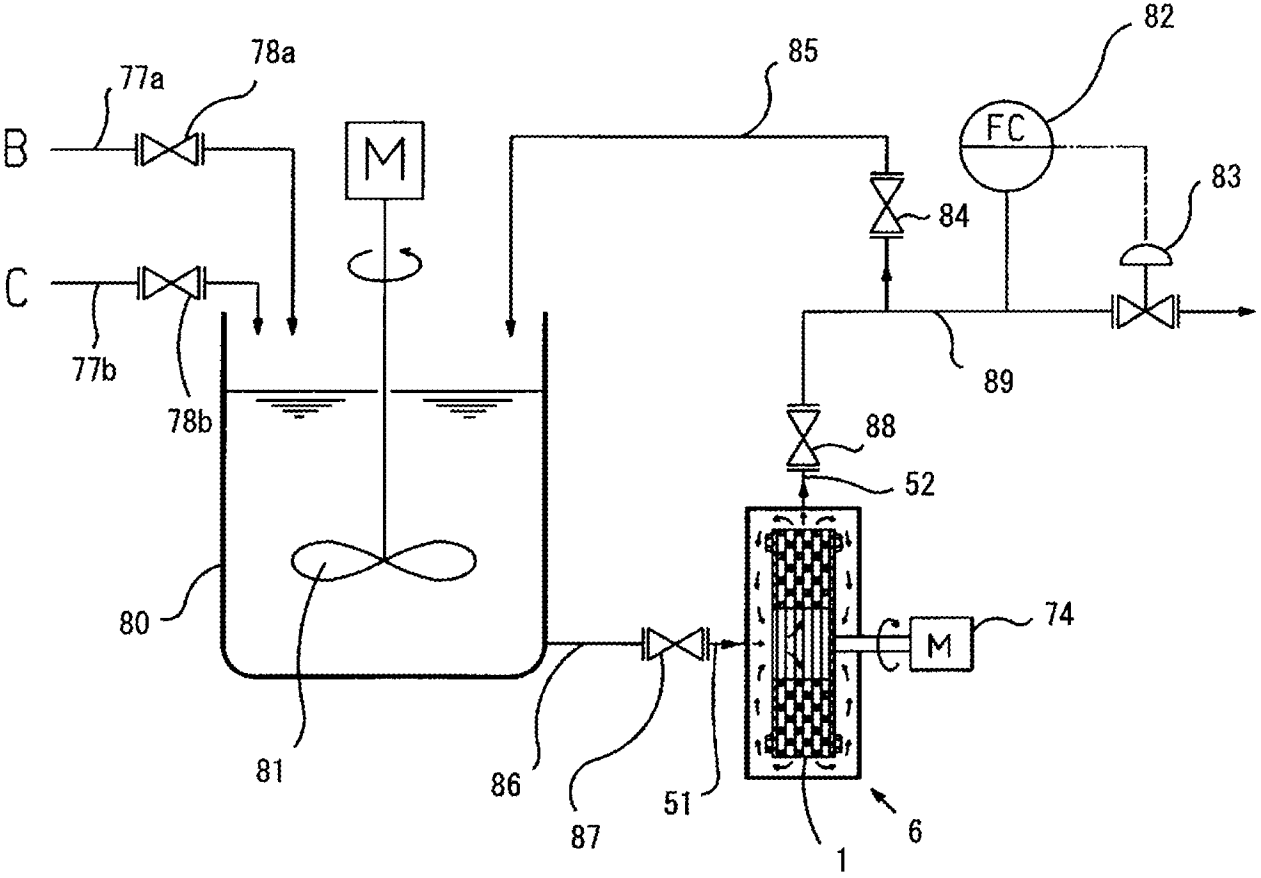
FIG. 29 is a schematic diagram showing a configuration of a mixing system in accordance with an eleventh embodiment of the present invention.

FIG. 29 is a diagram showing a configuration of a mixing system for mixing fluid with a pump mixer 6 such as pump mixers of the tenth embodiment including pump mixer 6 of FIG. 26A in accordance with an eleventh embodiment of the present invention. In this example of use, the fluid is continuously mixed by pump mixer 6 and is fed out.

A fluid B and a fluid C are fed to a fluid storage vessel 80 from pipe lines 77*a* and 77*b* through valves 78*a* and 78*b*, respectively. Fluid storage vessel 80 is provided with an agitation impeller 81 for agitating fluids B and C somewhat uniformly. A nozzle 86 is provided on a lower portion of fluid storage vessel 80, and is connected to inlet 51 serving as a suction port of pump mixer 6 through a valve 87. Outlet 52 serving as a discharge port of pump mixer 6 is connected to a feed-out line 89 through a valve 88. Feed-out line 89 branches off to a circulation line 85 communicating with fluid storage vessel 80. Circulation line 85 is provided with a valve 84 for controlling the flow rate of circulated fluid.

In this example of use, in order for the mixing to be performed on fluids B and C, fluids B and C are stored in fluid storage vessel 80, and are somewhat uniformly agitated by agitation impeller 81. Then, electric motor 74 is driven to rotate mixing unit 1 having a plurality of mixing elements and a hollow portion, and fluids B and C are sucked from inlet 51 by the pump action resulting from the rotation.

Within pump mixer 6, the sucked fluids B and C are radially passed through first through holes 22 communicating with each other within mixing body 2 constituting mixing unit 1 from the inner circumferential portion to the outer circumferential portion, with the result that fluids B and C are mixed. Mixed fluids B and C are discharged from outlet 52 of pump mixer 6, are controlled by a flow rate controller 82 and a flow rate control valve 83 and are fed out of the system through feed-out line 89.

Feed-out line 89 branches off to the circulation line 85 communicating with the fluid storage vessel 80, and part of the fluids B and C discharged from the pump mixer 6 is returned to the fluid storage vessel 80. Since the circulation line 85 is provided in this way and thus the fluids B and C are returned from the fluid storage vessel 80 to the pump mixer 6 where the fluids B and C are repeatedly mixed, the degree of mixing of the fluids B and C is increased, and the fluids B and C may be fed out of the system.

Since the degree of opening of outlet valve 88 arranged in outlet 52 of pump mixer 6 is adjusted and thus it is possible to adjust the flow rate of fluid circulating within mixing body 2 of mixing unit 1 within pump mixer 6, it is possible to adjust the degree of mixing of fluids B and C by pump mixer 6.

Moreover, since the degree of opening of valve 84 arranged in circulation line 85 is adjusted and thus it is possible to adjust the flow rate of fluid circulating through the circulation system including fluid storage vessel 80 and pump mixer 6, it is also possible to adjust the degree of mixing of fluids B and C. In this case, valve 88 and valve 84 may be automatically controlled valves.

Thus, according to this eleventh embodiment, there is provided a mixing system including a mixer which includes a casing or housing having a suction port that sucks fluid, and a discharge port that discharges fluid mixed within the casing; a mixing unit supported by the casing for a rotatable movement around a rotational axis within and relative to the casing, and having a hollow part provided with an opening port around the rotational axis; and a flow path disposed within the mixing unit communicating the hollow part with a periphery of the mixing unit, wherein the casing sucks the fluid through the suction port from an outside of the casing into an inside of the casing, mixes the fluid within the casing, and discharges the fluid through the discharge port to the outside of the casing; and a fluid circulating path communicating between the discharge port to the suction port of the mixer to allow the fluid to flow from the discharge port to the suction port for a circulation movement.

Twelfth Embodiment

Returning to FIG. 30, there is shown a perspective exploded view of an agitation impeller 7*a* in accordance with a twelfth embodiment of the present invention. FIG. 31 is a cross-sectional view of an agitation device 60 including an agitation vessel 63 and agitation impeller 7*a* of FIG. 30 arranged within agitation vessel 63, showing how fluid A circulates within agitation impeller 7*a* and an agitation vessel 63.

Figure 30:
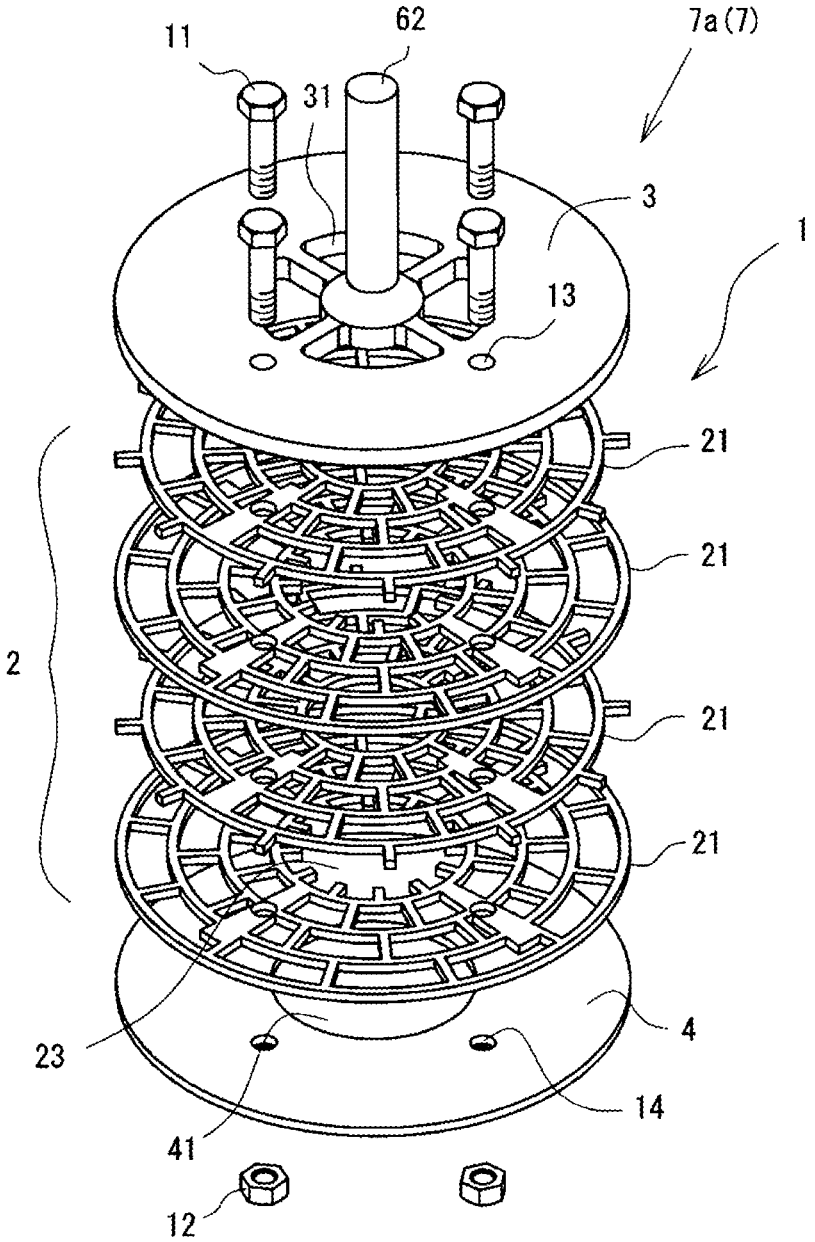
FIG. 30 is an exploded perspective view of an agitation impeller in accordance with a twelfth embodiment of the present invention.

As shown in FIG. 30, agitation impeller 7*a* has the mixing unit 1, and mixing unit 1 is configured by sandwiching mixing body 2, in which a plurality of substantially disc-shaped mixing elements are stacked, between first layer or plate 3 and second layer or plate 4 with fastening members composed of four bolts 11 and nuts 12 appropriately arranged.

First plate 3 is a disc that has holes 13 for the bolts and four opening portions 31 through which fluid A flows in, and has a rotation shaft 62 fitted thereto. Second plate 4 has holes 14 for the bolts and a circular opening portion 41 in the center portion through which fluid A flows out. First plate 3 and second plate 4 are substantially equal in outside diameter to mixing elements 21.

Mixing elements 21 have a plurality of first through holes 22, and have substantially circular second through holes 23 in the center portion through which fluid A circulating within agitation vessel 63 flows in. Second through holes 23 in mixing elements 21 are substantially equal in inside diameter to and are substantially concentric with the opening portion 41 in the second plate 4. Mixing elements 21 are stacked, and thus second through holes 23 form hollow portion 24.

The other parts of the configuration of mixing unit 1 of agitation impeller 7*a* are the same as those of mixing unit 1*a* or 1*b* according to the foregoing embodiments of the mixing unit.

Figure 31A:
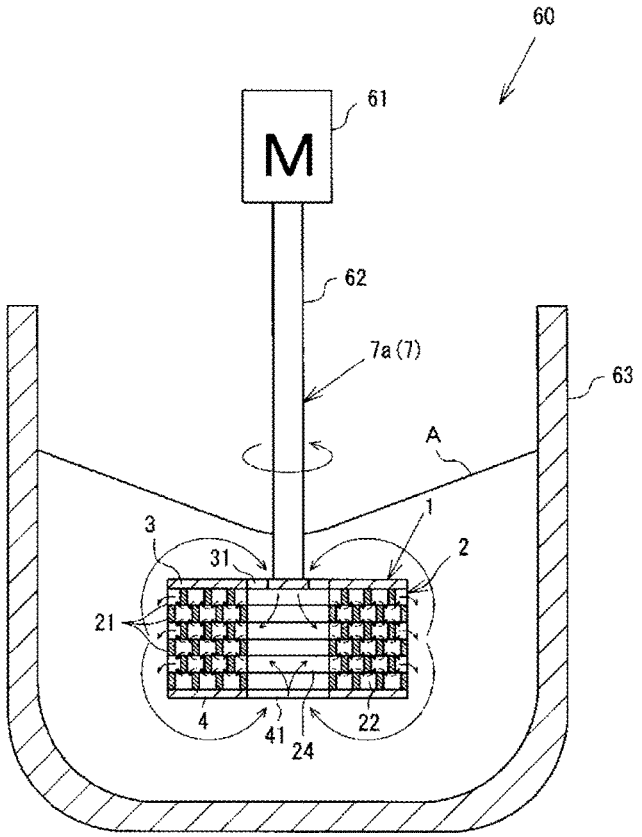
FIG. 31A is a cross-sectional view of an agitation device employing the impeller of FIG. 30 in a used state.

As shown in FIG. 31A, when agitation impeller 7*a*, that is, mixing unit 1 fitted to rotation shaft 62 is driven to rotate by a drive motor 61 to which electric power is supplied from an unillustrated power supply, a force acting outwardly in a radial direction resulting from the centrifugal force is applied to fluid A within mixing body 2 of mixing unit 1. Fluid A receiving the force is substantially radially passed through first through holes 22 communicating with each other within mixing body 2 from the inner circumferential portion to the outer circumferential portion, and is discharged outwardly from first through holes 22 open to the outer circumferential surface.

On the other hand, fluid A within agitation vessel 63 is sucked into hollow portion 24 within mixing body 2 through opening portion 41 in second plate 4 on the lower end of and four opening portions 31 in first plate 3 on the upper end of mixing unit 1. The sucked fluid A flows into mixing body 2 through first through holes 22 open to the inner circumferential surface of hollow portion 24. Then, a force acting outwardly in a radial direction due to the centrifugal force resulting from the rotation operation of mixing unit 1 is applied to sucked-fluid A, and sucked-fluid A is discharged outwardly from first through holes 22 open to the outer circumferential surface.

Then, when fluid A substantially radially flows within mixing body 2 from the inner circumferential portion to the outer circumferential portion, fluid A is passed through first through holes 22 communicating with each other, with the result that fluid A is highly agitated.

Since the fluid may be mixed by being sucked from the upper and lower portions of agitation impeller 7*a*, it is possible to expect to effectively perform agitation.

In agitation impeller 7*a* described above, since the number of mixing elements 21 stacked is increased to increase the number of through holes 22 within mixing unit 1 through which the fluid is passed and which communicate with each other, it is possible to reduce a time period during which the fluid is agitated within agitation vessel 63.

Agitation impeller 7 of the present invention is not limited to the configuration described above.

(Variations of the Agitation Impeller)

Figure 31B:
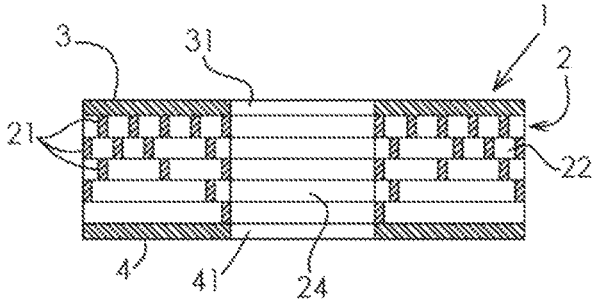
FIGS. 31B and 31C are side sectional views of mixing units as modifications of mixing elements as shown FIG. 31A.
Figure 31C:
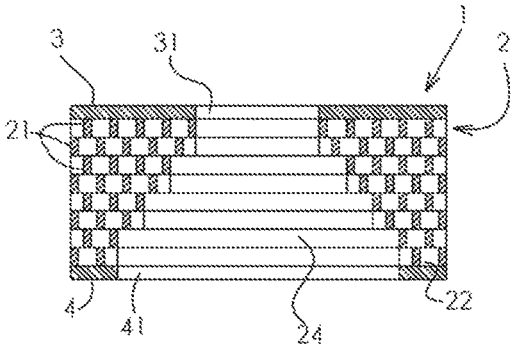

FIGS. 31B and 31C are side sectional views of mixing units 1 as modifications of mixing elements 21 of FIG. 31A. In FIG. 31B, a mixing body 2 sandwiched by first layer 3 having an opening 31 and a second layer 4 having an opening 41 consists of a plurality of mixing elements 21 each having first through holes 22 and a second through hole 24 providing a cylindrical hollow (24) communicating with openings 31 and 41. The number of partition walls extending in the circumferential direction of each mixing element 21 providing first through holes 22 in a higher position is designed to be larger than that in a lower position where diameter of each second through hole 24 is designed to be equal to those of openings 31 and 41 as shown in FIG. 31B. The resistance against fluid flowing in the radial direction of fluid increase as the number of partition walls in the circumferential direction of each mixing element 21 increases. Thus designed mixing elements 21 may decrease the volume of flowing in an upper position of mixing unit 1 but increase it in a lower position, whereby, for example, the volume of circulating fluid flowing in upper and lower portion of an agitation device circulating may be controlled when mixing unit 1 is employed in the agitation device. Mixing unit 1 of FIG. 31C differs from mixing unit 1 of FIG. 31B in that the diameter of second through hole 24 (inner hole) of each mixing element 21 is designed to be different, narrower than that in a lower position, but other construction is same as that of FIG. 31B. As shown in FIGS. 31B and 31C, each mixing element 21 has partition walls extending around the hollow portion 24, and a number of partition walls is different for each of the mixing elements 21.

In FIG. 32, there is shown an agitation impeller 7*b* including a rotation shaft 62 which may be provided on an end side of a mixing unit 1, that is, on second plate 4 as a variation of the agitation impeller shown in FIG. 30. In thus configured agitation impeller 7*b*, it is possible to suck a larger amount of fluid in the upper portion of the agitation vessel than the fluid in the lower portion of the agitation vessel.

Figure 33A:
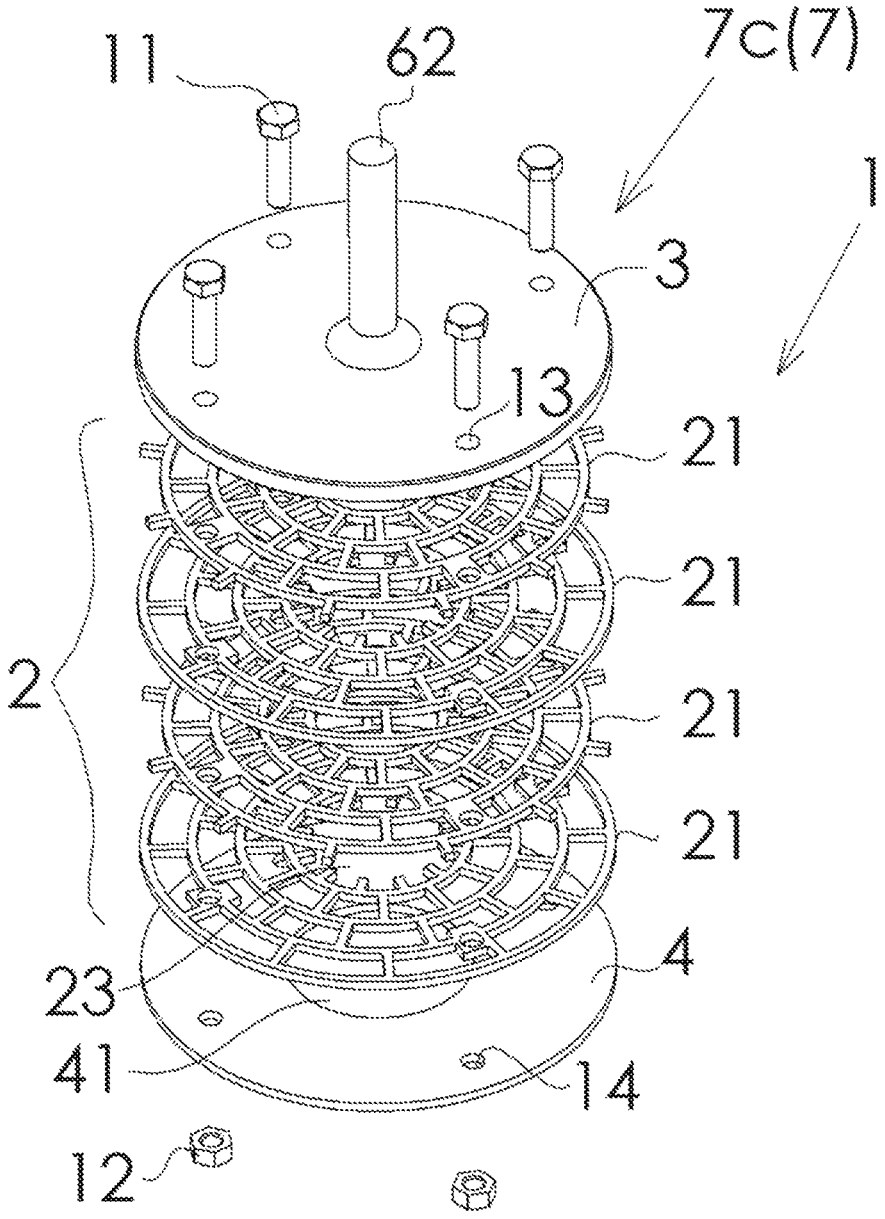
FIG. 33A is a cross-sectional view of an agitation device employing an agitation impeller modified from the agitation impeller of FIG. 30.
Figure 33B:
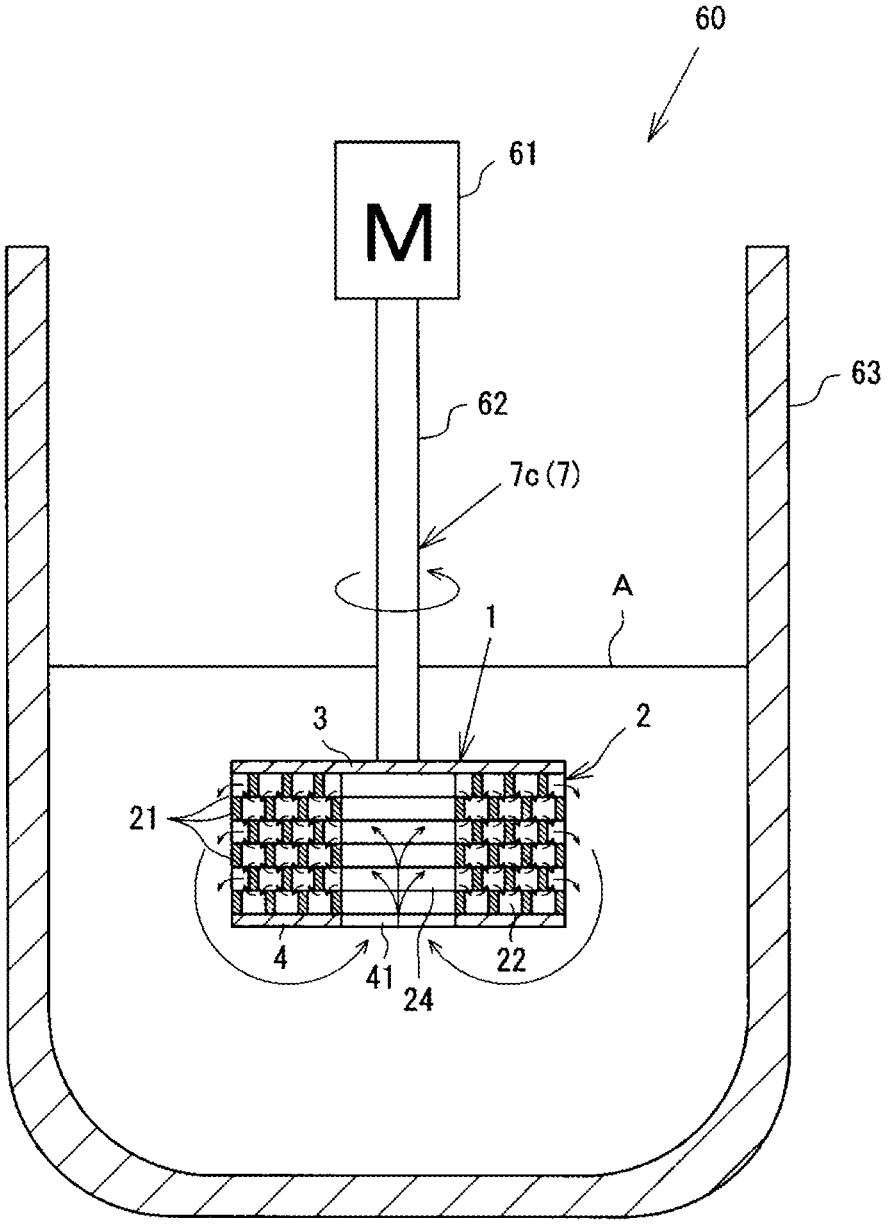
FIG. 33B is a cross-sectional view of an agitation device employing the agitation impeller of FIG. 33A.

Agitation impeller 7*b* may be modified as shown in FIG. 33A. In FIG. 33A, there is shown an agitation impeller 7*c* in which any opening portion may not be formed in first plate 3 of mixing unit 1, that is, first plate 3 may be closed. In other words, first plate 3 present near the fluid surface is closed. FIG. 33B is a cross-sectional view of an agitation device 60 including an agitation vessel 63 and agitation impeller 7*a* of FIG. 33A arranged within agitation vessel 63, showing how fluid A circulates within agitation impeller 7*c* and agitation vessel 63.

In this configuration, since the fluid flows in only from below at the time of the rotation, it is possible to agitate the fluid by raising up particles and the like deposited within agitation vessel 63. The surface of fluid A within agitation vessel 63 is unlikely to be frothed. When a fluid, such as a paint, in which bubbles are desired to be prevented from being mixed at the time of agitation is agitated, this configuration is suitably used.

Figure 34:
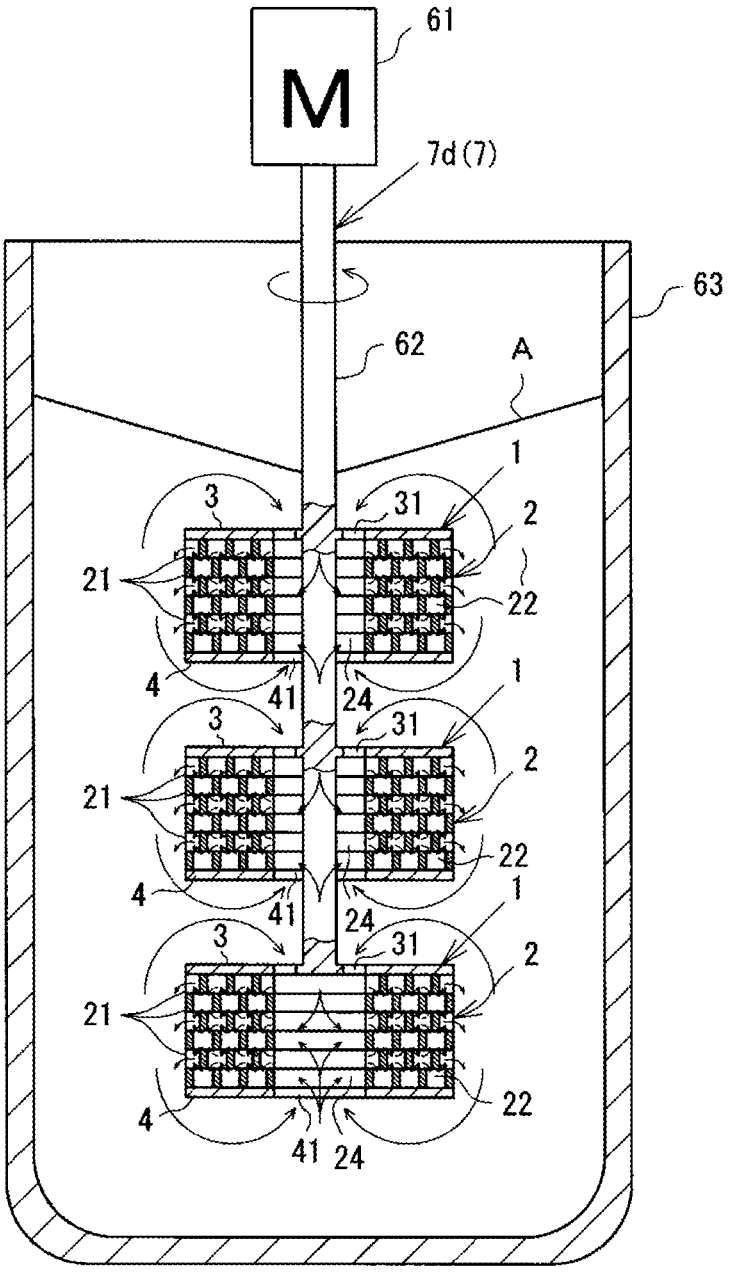
FIG. 34 is a cross-sectional view of an agitation device as a modification of the agitation device of FIG. 33B.

FIG. 34 is a cross-sectional view of an agitation device 60 including an agitation vessel 63 and a further modified agitation impeller 7*d* as another modification of agitation device. Agitation impeller 7*d* includes a rotation shaft 62 which is provided with a plurality of mixing units 1, and an appropriate space is provided between mixing units 1.

Since agitation impeller 7*d* configured as described above has a plurality of mixing units 1, it is possible to suck the fluid from the upper and lower portions of each of mixing units 1. Hence, it is possible to perform agitation even when agitation vessel 63 is deep.

Figure 35A:
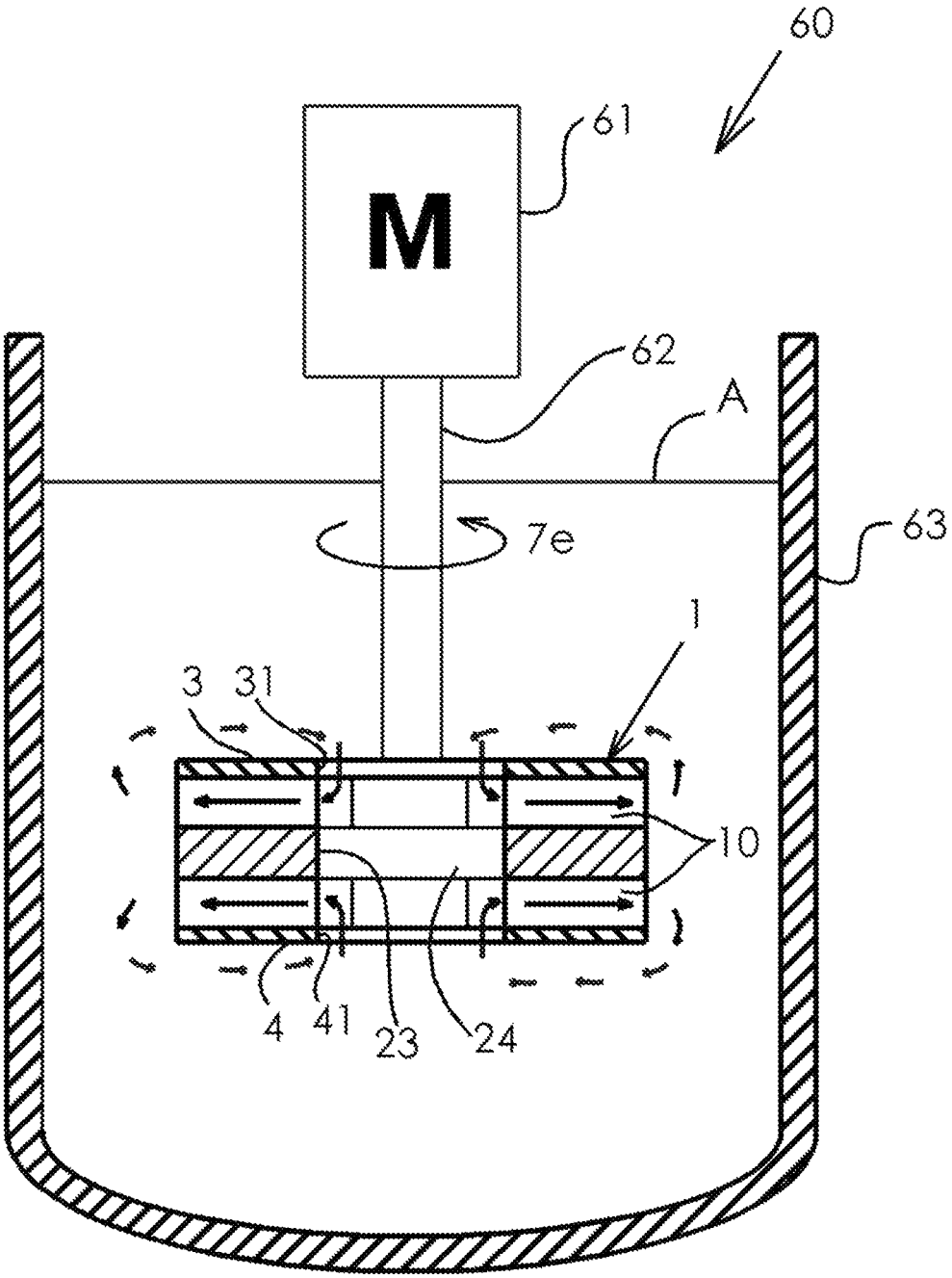
FIG. 35A is a sectional view of an agitation device including an agitation impeller which is modified from agitation impeller of FIG. 30.
Figure 35B:
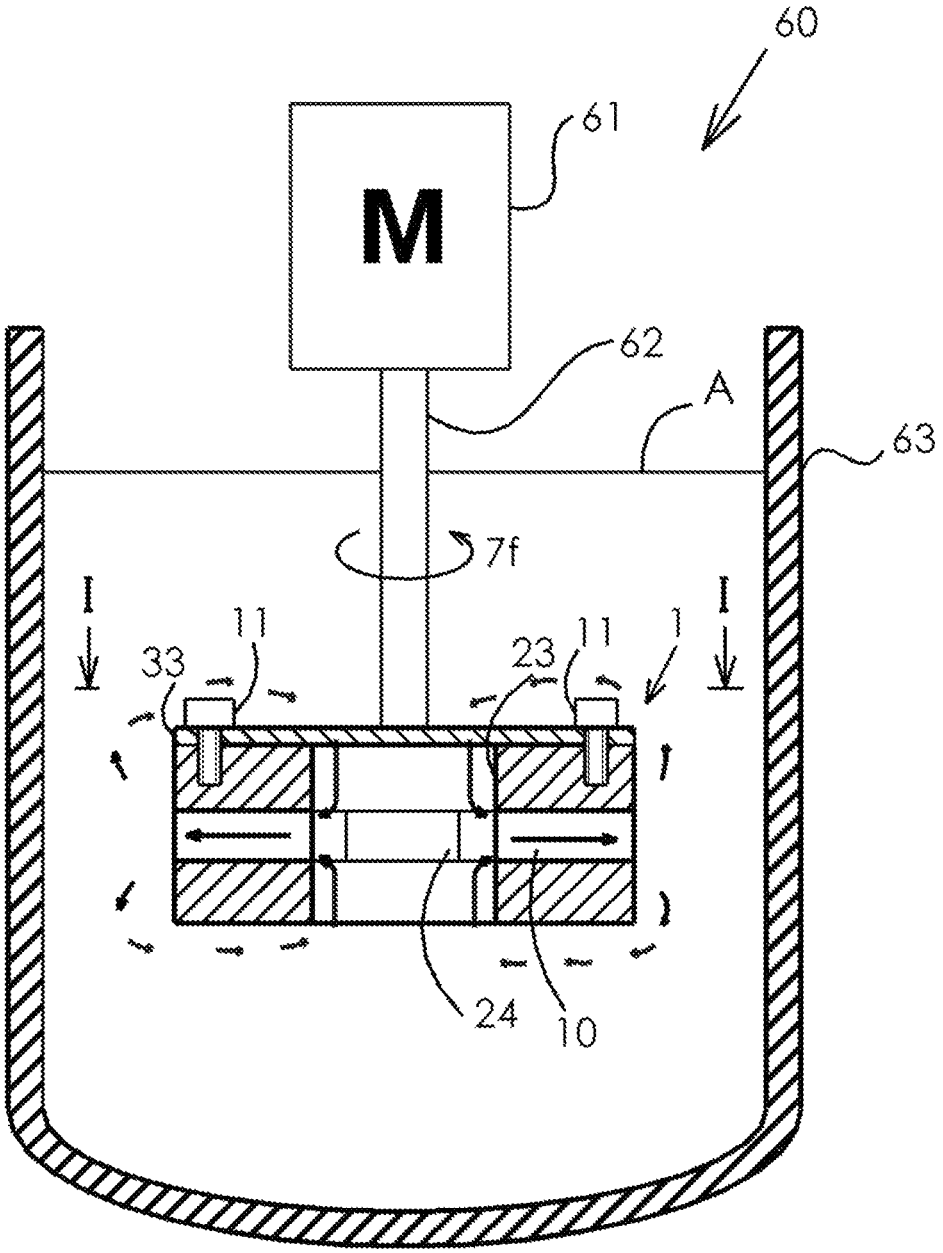
FIG. 35B is a sectional side view of an agitation device modified from the agitation device of FIG. 35A.

FIGS. 35A and 35B show further modifications of agitation impellers which may be used in agitation devices. FIG. 35A shows a cross sectional view of an agitation device 60 including an agitation impeller 7*e* which has a different configuration from that of FIG. 30 but a mixing unit 1 similar to that of FIG. 27A. Mixing unit 1 of FIG. 35A includes a cylindrical shaped hollow portion 24 at its center location passing through in a coaxial (vertical) direction of mixing unit 1, and four flow paths 10 crossing in each of two layers radially expanding from hollow portion 24 to circumferential direction thereof which are formed by a member 23, and closed by first plate 3 having a first through hole 31 and a second plate 4 having a second through hole.

Even in agitation impeller having this simplified configuration, a fluid A sucked into mixing unit 1 through a through hole 41 of second plate 4 by rotation of mixing unit 1 is mixed by passing flow paths 10 from hollow portion 24 of mixing unit 1 to the external circumferential portion. A part of fluid A passing out from the external circumferential portion of mixing unit 1 re-enters into hollow portion 24 through first and second through holes to be re-circulated.

According to one or more embodiments of the present invention, mixing unit 1 may be a single unit drilled to provide flow paths 10, through holes 31 and 41, and hollow portion 24.

FIG. 35B shows a cross sectional view of an agitation device 60 including an agitation impeller 7*f* which is modified from that of FIG. 35A, in which a mixing unit 1 similar to that of FIG. 27B. Mixing unit 1 of FIG. 35B differs from unit 1 of FIG. 35A in that four crossing flow paths 10 are disposed in a single layer in a middle of mixing unit 1. Other components or functions are same as those of FIG. 35A.

Figure 36A:
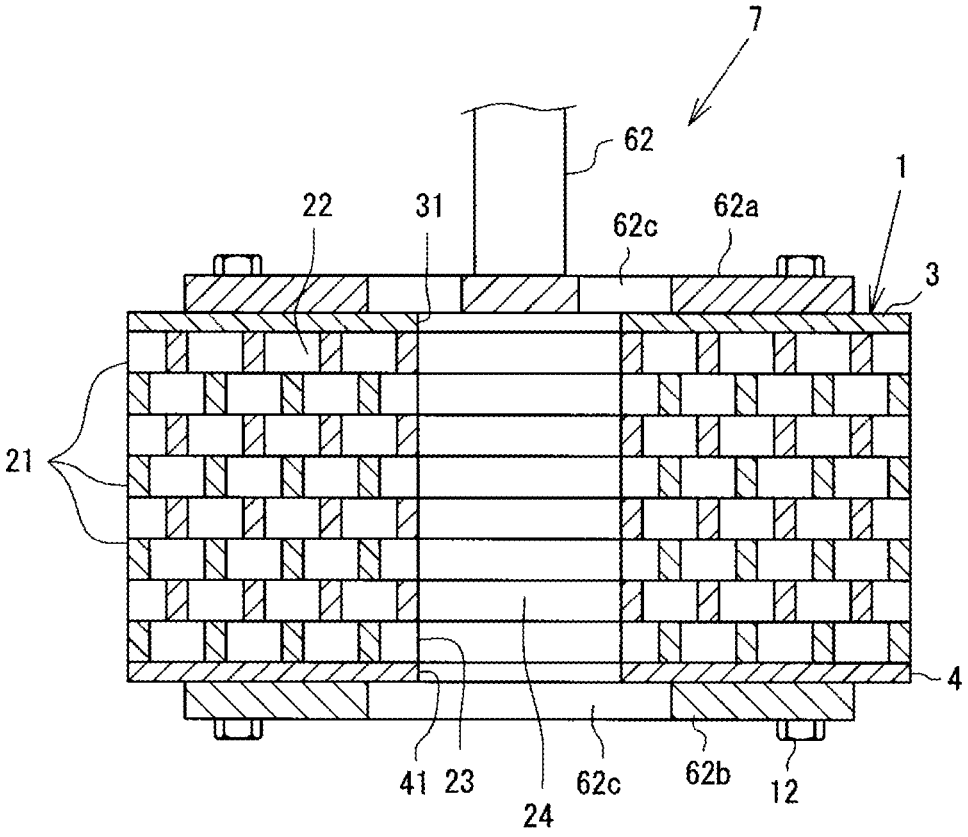
FIG. 36A is a cross sectional view of an agitation impeller as another modification.

FIG. 36A is a cross-sectional view showing the portions of a mixing unit 1 of an agitation impeller 7 as another modification of the above-described agitation impellers. In this mixing unit 1, agitation impeller 7 is configured not by providing a rotation shaft 62 directly on a first plate 3 but by using a fixing plate 62*a* provided an end of rotation shaft 62 and an auxiliary plate 62*b* which forms a pair with fixing plate 62*a* to sandwich mixing unit 1 and which is fixed with bolts 11 and nuts 12.

Opening portions 62*c* are formed in positions corresponding to second through holes 23 of mixing elements 21 in fixing plate 62*a* and auxiliary plate 62*b*. Likewise, opening portions 41 and 31 are formed in positions corresponding to second through holes 23 of mixing elements 21 in first plate 3 and second plate 4.

In agitation impeller 7 configured as described above, since first plate 3 and second plate 4 close through holes 22 at both ends of mixing body 2 in the stacking direction to form one unit, one type of rotation shaft 62 having fixing plate 62*a* and auxiliary plate 62*b* is provided, and thus it is possible to obtain agitation impeller 7 that corresponds to mixing units 1 having different sizes and structures.

Figure 36B:
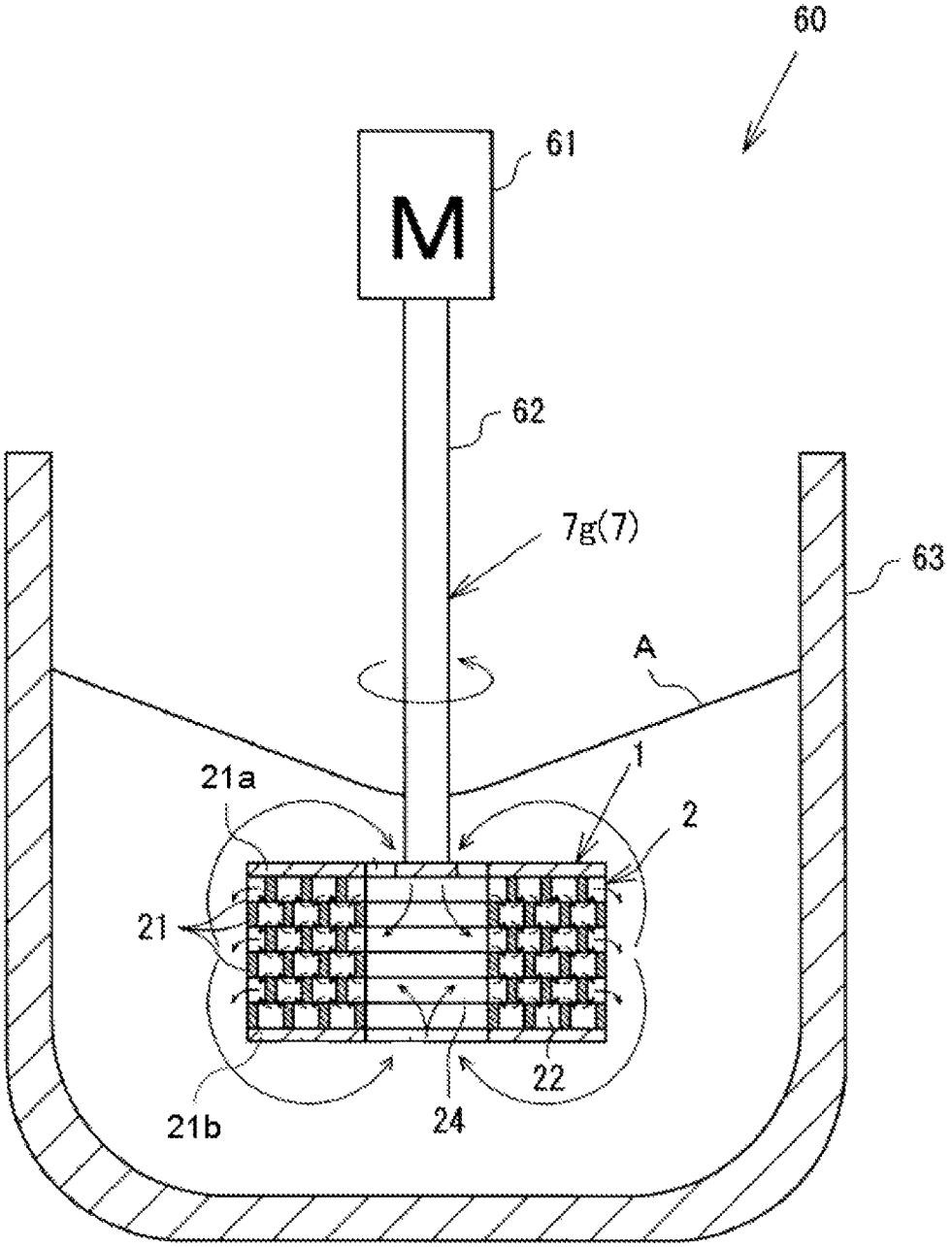
FIG. 36B is a cross-sectional view of an agitation device modified from the agitation device of FIG. 31A as still another modification.

FIG. 36B is a cross-sectional view of an agitation device 60 including an agitation vessel 63 and a modified agitation Impeller 7*g* modified from the agitation device 60 of FIG. 31A as still another modification of the above-described agitation impellers. Impeller 7*g* includes a modified mixing unit 1 having a same structure as that of the mixing unit 1 of FIG. 26C includes an upper attachment part 21*a* having a rotation shaft 62 fitted thereto, mixing body 2, and a lower attachment part 21*b*. Mixing body 2 includes mixing elements 21 having first through holes 22 which are fixed between upper and lower attachment parts 21*a* and 21*b*.

In this modification, the same fluid movements as those of FIG. 31A can be performed without first plates 3 and second plate 4 of FIG. 31A. As described in the mixing unit of FIG. 26C, upper attachment part 21*a* or lower C attachment part 21*a* may be omitted as necessary.

According to foregoing modifications of this twelfth embodiment, there is provided an agitation impeller having a mixing unit or a mixing body including mixing elements that are stacked in a stacking direction and that extend in an extending direction wherein the mixing elements have a plurality of first through holes to form a flow path therein, and the mixing elements are arranged such that part or all of the first through holes in one of the mixing elements communicate with first through holes in the adjacent mixing elements to allow fluid to be passed in the extending direction in which the mixing element extends and to be divided as the fluid passes into the mixing elements.

Figure 36C:
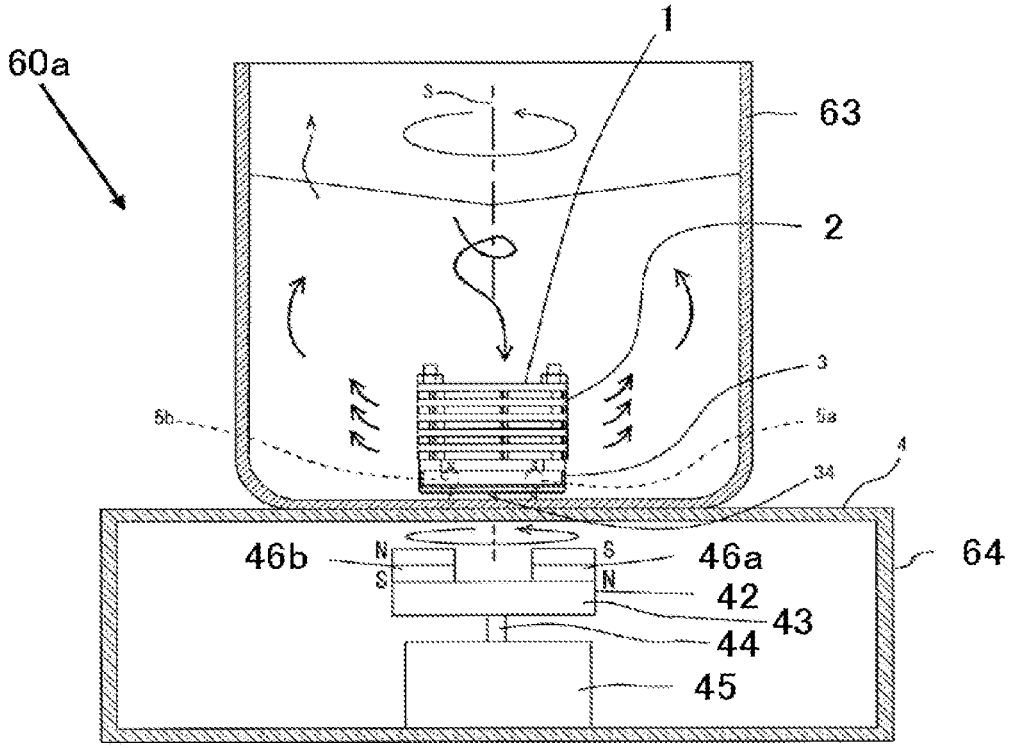
FIG. 36C is a cross-sectional view of an agitation device as still another modification.
Figure 36D:
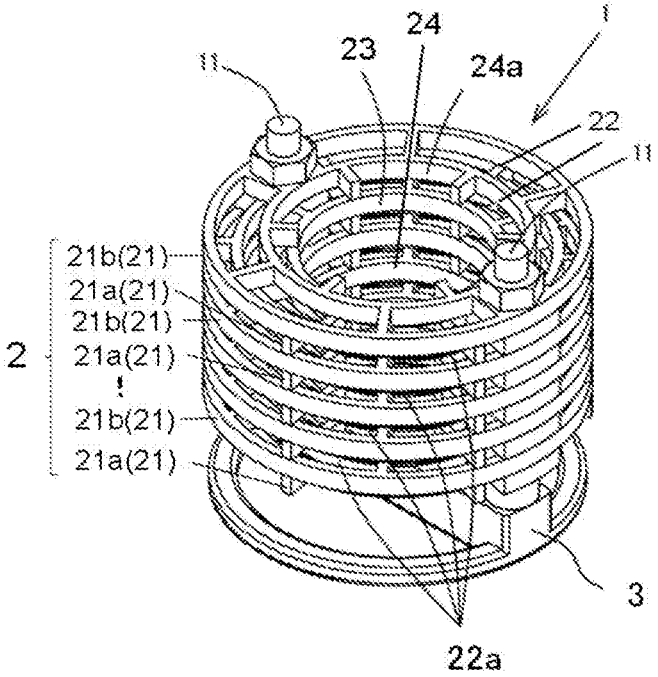
FIG. 36D is a perspective view of a mixing unit employed in the agitation device of FIG. 36C.

FIG. 36C is a cross-sectional view of an agitation device 60*a* including an agitation vessel or beaker 63, a mixing unit 1 shown in FIG. 36D as an agitation impeller put within vessel 63 for a rotatable movement, and a magnetic stirrer 64 supporting vessel 63 as still another modification of the above-described agitation devices.

The mixing unit 1 includes a mixing body 2 having a plurality of mixing elements 21 (21*a* and 21*b*) each having a plurality of first through holes 22 and a second through hole 23, and a magnetic function represented by a pedestal 3 having a magnet or magnetic member to receive rotating magnetic field generated from magnetic stirrer 64. The pedestal 3 is not limited to the configuration of FIG. 36D, and may be of any shape, for example, a disc shape, for receiving an external rotating magnetic field. The plurality of mixing elements 21 are stacked and fixed with bolts 11 to form a hollow portion 24 by communicating second through holes 23 one after another, and first through holes 22 are staggered by two types of mixing elements 21*a* and 21*b* different from each other in the arrangement pattern of the first through holes 22 in the same manner with mixing body 2 as shows in FIG. 30.

As shown in FIG. 36C, the magnetic stirrer 64 includes a rotating magnetic field generator 42 provided with a driving rotor 43 and magnet magnetic member 46*a* and 46*b* each having different magnetic poles, and a motor 45 to rotate driving rotor 43 and magnets 46*a* and 46*b* for rotating magnetic field to be applied to mixing unit 1 for a rotary movement.

As mixing unit 1 is driven to rotate by receiving rotating magnetic field generated from magnetic stirrer 64, fluid A enters into hollow portion 24 through a suction port 24*a* which is an upper opening portion of hollow portion 24, and is mixed by the plurality of first through holes 22 so that the mixed fluid A is discharged from discharge openings 22*a*. The discharged fluid A returns to the suction port 24*a*, and such fluid movements are repeated for agitation as mixing unit 1 rotates.

Thus, according to agitation device of FIGS. 36C, the mixing unit 1 having a magnetic function is driven to rotate by non-contact driving means without any rotation shaft, viz., rotating magnetic field, which can be applied to a stirrer put within a beaker. The mixing unit 1 may be made by 3D printing as a single unit without using bolts 11. Further, the mixing unit 1 may be made of magnetic material as a magnetic function thereof by omitting pedestal (3) having a magnet. The magnetic stirrer 64 may be represented by any magnetic generator, viz., rotating magnet, for generating a rotating magnetic field which is disposed near or in parallel with the mixing unit 1.

According to the agitation device and the mixing unit of FIGS. 36C and 36D, there are provided an agitation impeller having a mixing unit or a mixing body having a magnetic function for receiving an external rotating magnetic field, an agitation device including the agitation impeller and an agitation vessel within which the agitation impeller is disposed, and further a agitation device or system including the agitation device and a rotating magnetic field generator for applying a rotating magnetic field to the mixing unit.

Thirteenth Embodiment

Returning to FIG. 37, there is shown an agitation device 1A including an agitation vessel 63 containing a fluid A and an agitation impeller 2A composed of a mixing unit 20 and a suction pipe 30 which are disposed in the fluid A within agitation vessel 63 in accordance with a thirteenth embodiment of the present invention. For example, agitation device 1A may be used for mixing fluid A containing particles B in a liquid.

Mixing unit 20 is provided with suction ports 20α1 and 20α2 for sucking fluid A and discharge ports 20β for discharging the sucked fluid A. Mixing unit 20 has a substantially cylindrical shape, viz., a similar configuration to that of mixing unit 1 of FIG. 30, and is composed of a mixing body 2 indicated by oblique lines which is stacked by a plurality of mixing elements each having a plurality of first through holes and a second through hole larger than the first through holes to form a hollow portion 24 as shown in FIGS. 30 and 31A, a shaft holder plate 3 serving as a first layer on an upper surface of mixing body 2, and a nozzle holding plate 4 serving as a second layer on a lower surface of the same. Suction ports 20α1 and 20α2 are provided in central portions of both the upper and lower surfaces of mixing body 2, and a large number of discharge ports 20β are provided on an outer peripheral surface of the same. Within mixing unit 20, there are provided a large number of flow paths of fluid A connecting suction ports 20α1 and 20α2 and discharge ports 20β like the arrow also shown in FIG. 31A. Suction pipe 30 of a cylindrical shape as a nozzle for sucking the fluid A is connected to suction port 20α2 on the lower surface of mixing unit 20. Thus, discharge ports 20β are disposed at a position (for example, a position radially outward orthogonal to a rotation axis) that is more outside than each of suction ports 20α1 and 20α2 at upper and lower portions of a hollow portion 24 relative to the rotation axis.

A lower end of a rotation shaft 62 is connected to a center position of shaft holder plate 3. An electric motor 61 capable of arbitrarily controlling the number of revolutions is connected to an upper end of rotation shaft 62, and mixing unit 20 rotates around the rotation axis of rotation shaft 62 to mix the fluid A. The power source for rotating mixing unit 20 is not limited to electric motor 61, but may be arbitrarily selected from those which serve rotational motion.

Figure 37:
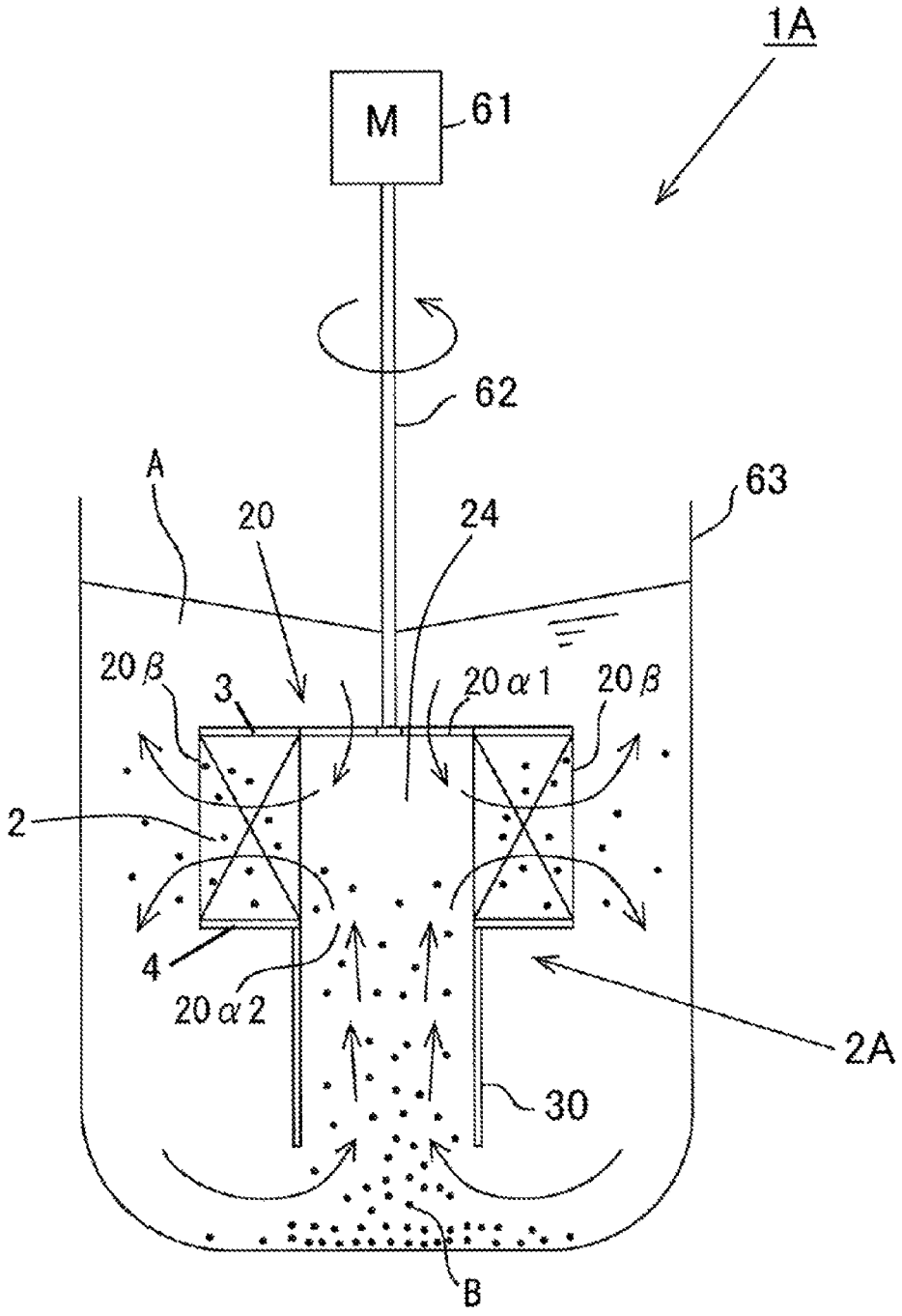
FIG. 37 is a schematic cross-sectional view showing an agitation device including an agitation impeller having a mixing unit and a nozzle in accordance with a thirteenth embodiment of the present invention.
Figure 38:
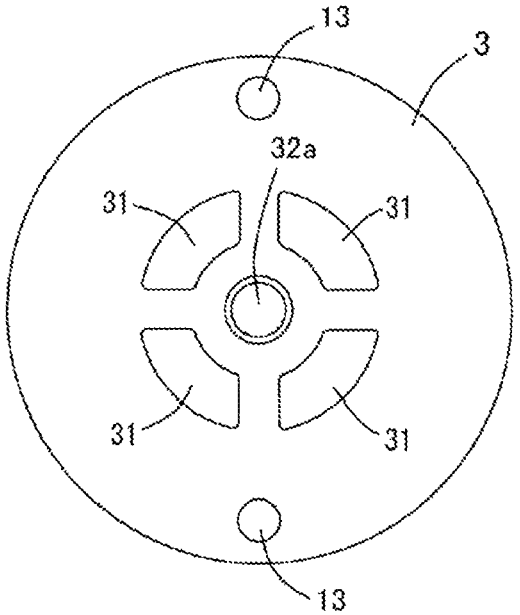
FIG. 38 is a plan view showing a shaft holder plate and a nozzle holding plate attached to the mixing unit of FIG. 37.
Figure 38:
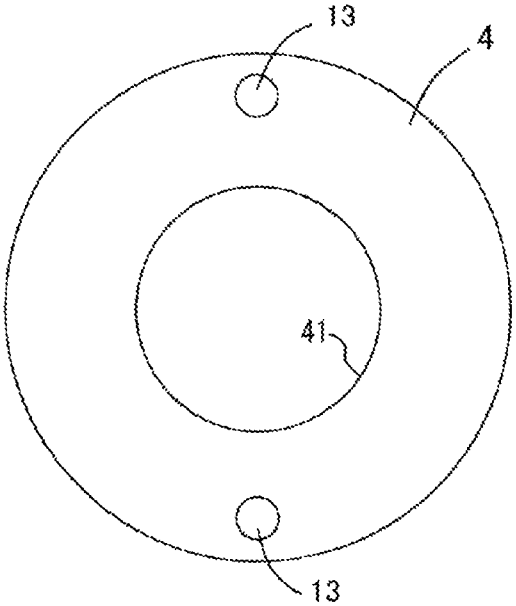

As shown in FIG. 38, shaft holder plate or layer 3 and nozzle holding plate or layer 4 of FIG. 37 are formed by discs having substantially same outside diameters as those of the mixing elements. In FIG. 38, shaft holder plate 3 at its center has a mounting portion 32*a* for rotation shaft 62, and fan-shaped small openings 31 are provided around mounting portion 32*a* to partially expose suction port 20α1 at an upper portion of mixing unit 20. Nozzle holding plate 4 at its center portion has a circular opening 41 for entirely exposing suction port 20α2 at a lower portion of mixing unit 20. In opening 41 of nozzle holding plate 4, suction pipe 30 is disposed so as to extend below mixing unit 20.

As described above, since suction port 20α1 is partially exposed by small opening portions 31 of shaft holder plate 3, the opening area of suction port 20α1 is smaller than suction port 20α2, whereby the inflow of fluid A is restricted in upper suction port 20α1 than lower suction port 20α2. In other words, upper suction port is provided with a limit member for limiting inflow of the fluid larger than the inflow in the lower suction port, and shaft holder plate 3 constitutes the limit member for limiting the inflow of fluid A.

The plurality of mixing elements of mixing body 2, shaft holder plate 3 and nozzle holding plate 4 have bolt holes 13 at two positions in the outer circumferential portion at 180 degrees, and are fixed through bolt holes 13 by a fixing unit of bolts (not shown) and nuts (not shown) in a stacking or vertical direction in a same manner as the structure in FIG. 30. As a result, it is possible to easily form mixing unit 20 in which the plurality of mixing elements are disassemblably integrated. In addition, mixing unit 20 can easily perform the cleaning operation for removing the residuals and foreign matters remaining in each mixing element by configuring the mixing elements to be separable into the individual mixing elements. The configuration for integrating the plurality of mixing elements is not only the bolt and nut structure but also may be an attachable structure that can be disassembled such as a fitting structure of irregularities and the like.

Thus, in this thirteenth embodiment, there is employed a mixing unit including a mixing body having a plurality of mixing elements that are stacked are stacked in a stacking direction and that extend in an extending direction; wherein the mixing elements include a plurality of through holes to form a flow path therein and are arranged such that part or all of the through holes in one of the mixing elements, whose upper surface is in contact with another mixing element and whose lower surface is in contact with another mixing element, communicate with through holes in the adjacent mixing elements to allow fluid to be passed and divided in the extending direction in which the mixing elements extend; and wherein the extending direction is perpendicular to the stacking direction, as also explained in the first embodiment of the present invention.

With the above configuration in FIG. 37, when agitation impeller 2A is rotated by electric motor 61, the fluid A inside the mixing unit 20 vigorously flows out from the discharge port 20β to the outside by the centrifugal force of rotation, whereby large suction force is generated in the upper and lower suction ports 20α1 and 20α2 from the flow path inside mixing unit 20. Then, fluid A outside mixing unit 20 is strongly sucked into mixing unit 20 from suction ports 20α1 and 20α2 of the mixing unit 20. In this case, suction of fluid A at the bottom of agitation vessel 63 is promoted by suction pipe 30 at lower suction port 20α2. Therefore, the particles B sedimented at the bottom of agitation vessel 63 are taken up by suction pipe 30 and sufficiently sucked into mixing unit 20 from lower suction port 20α2. If desired, opening 41 of nozzle holding plate 4 of FIG. 38 and suction pipe 30 may have a small diameter with respect to the diameter of lower suction port 20α2. In this case, it is possible to increase the flow rate of suction of fluid A by suction pipe 30.

In this way, particles B accumulated in the bottom of agitation vessel 63 are taken up through suction pipe 30 and sufficiently sucked into mixing unit 20 from lower suction port 20α2 together with the liquid, and at the same time, fluid A (mainly liquid) at an upper part of agitation impeller 2A is sufficiently sucked into mixing unit 20 from upper suction port 20α1, the fluid A sucked into mixing unit 20 flows through the flow paths inside mixing unit 20 to be highly mixed, and fluid A flows out vigorously from the plurality of discharge ports 20β on the outer peripheral portion of mixing unit 20. Then, the fluid A discharged from discharge ports 20β agitates fluid A in an outer peripheral portion of agitation impeller 2A, so that the entire fluid A vigorously flows in agitation vessel 63. Accordingly, the entire fluid A in agitation vessel 63 can be highly agitated in a relatively short time.

According to this thirteenth embodiment of the present invention, there may be provided a method for agitating a fluid containing particles in a liquid by an agitation impeller rotating around a rotation axis, wherein the agitation impeller is constituted by a mixing body including a plurality of mixing elements that are stacked in a direction of the rotation axis and supported by a rotation shaft connected to an upper part of the agitation impeller, each of the mixing elements has a plurality of first through holes and a second through hole larger than the first through holes, the mixing elements are arranged such that a part or all of the first through holes in one of the mixing elements overlaps the first through hole of adjacent one of the mixing elements and communicate with the first through hole in the adjacent one to allow fluid to be passed and divided in a direction in which the mixing element extends, a discharge port of a fluid is formed by the plurality of first through holes opening to an outer peripheral portion of the agitation impeller, the second through holes communicate in a stacking direction of the stacked mixing elements to form suction ports on an upper face and a lower face of the agitation impeller and a hollow portion to introduce the fluid within the mixing unit, and a holding plate having an opening portion whose diameter is smaller than that of the lower suction port disposed on the lower surface of the agitating impeller, including the step of flowing out the fluid within the mixing unit from the discharge port to an outside of the mixing unit by the rotational motion of the agitating impeller to generate a suction force at the respective suction ports, and sucking the fluid within the hollow portion from the suction port on the lower face while winding the particles so that the fluid containing particles flows into the agitation impeller from the hollow portion.

Several modifications of agitation impeller 2A are available in this thirteenth embodiment. Shaft holder plate 3 of FIG. 38 may be modified to a closed plate without the small openings 31 to close the whole of upper suction ports 20α1 and limit the inflow of fluid A from suction port 20α1 to zero or a preferred limitation as a limit member or plate, whereby the suction flow rate of fluid A from the suction pipe 30 is greatly increased to further increase the amount of particles B taken or rolled up at the bottom of agitation vessel 63.

Suction pipe 30 of FIG. 37 having the same outer diameter over the entire length may be modified to have a lower end portion radially expanding like a trumpet shape to widen the suction area of the particles B at the bottom of agitation vessel 63, whereby the particles B settling on the bottom of agitation vessel 63 can be taken up by the suction pipe 30 to be easily sucked into mixing unit 20.

Figure 39:
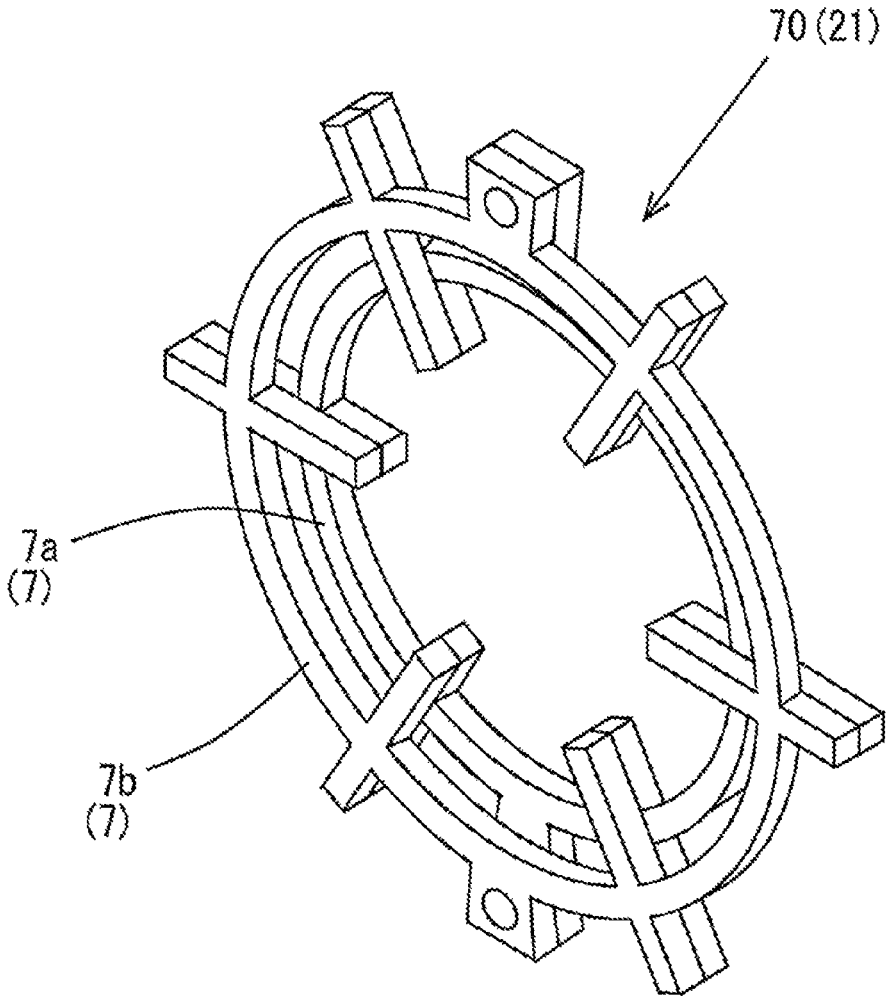
FIG. 39 is a perspective view showing a set of annular assembly constituting a mixing element as a modification of the thirteenth embodiment of the present invention.

Mixing body 2 of FIG. 37 is composed of plurality of mixing elements each formed by a single disc, but, as shown in FIG. 39, may be modified to have one pair of annular assemblies 70 with a pair of circular rings 7*a* and 7*b* having different external diameters (ring 7*a* has a smaller diameter than that of ring 7*b*) where each of the mixing elements is formed by the one pair of annular assemblies 70. Specifically, referring to FIG. 40, each of circular rings 7*a* and 7*b* is composed of one annular partition wall portion 71 and a plurality of linear partition wall portions 72, and linear partition wall portions 72 are arranged at equal intervals along a circumferential direction of annular partition wall portion 71 so as to extend radially, outward or inward.

One unit of mixing element 21 is formed by superimposing two circular rings 7 having different outer diameters of the annular partition wall portion 71 into a set of annular assembly 70. Each mixing element 21 formed by a pair of annular assemblies 70 has a plurality of first through holes 22 aligned in the circumferential direction and a second through hole 23 in the central portion formed by small diameter circular ring 7*a* and large diameter circular ring 7*b* (See the lower diagram in FIG. 40). The pair of annular assemblies 70 are set as one unit of mixing element 21, and a plurality of mixing elements 21 are stacked and fixed by inserting bolts through bolt holes 13 provided at two positions at 180 degrees to be fastened with nuts, whereby mixing unit 20 is formed.

Figure 40:
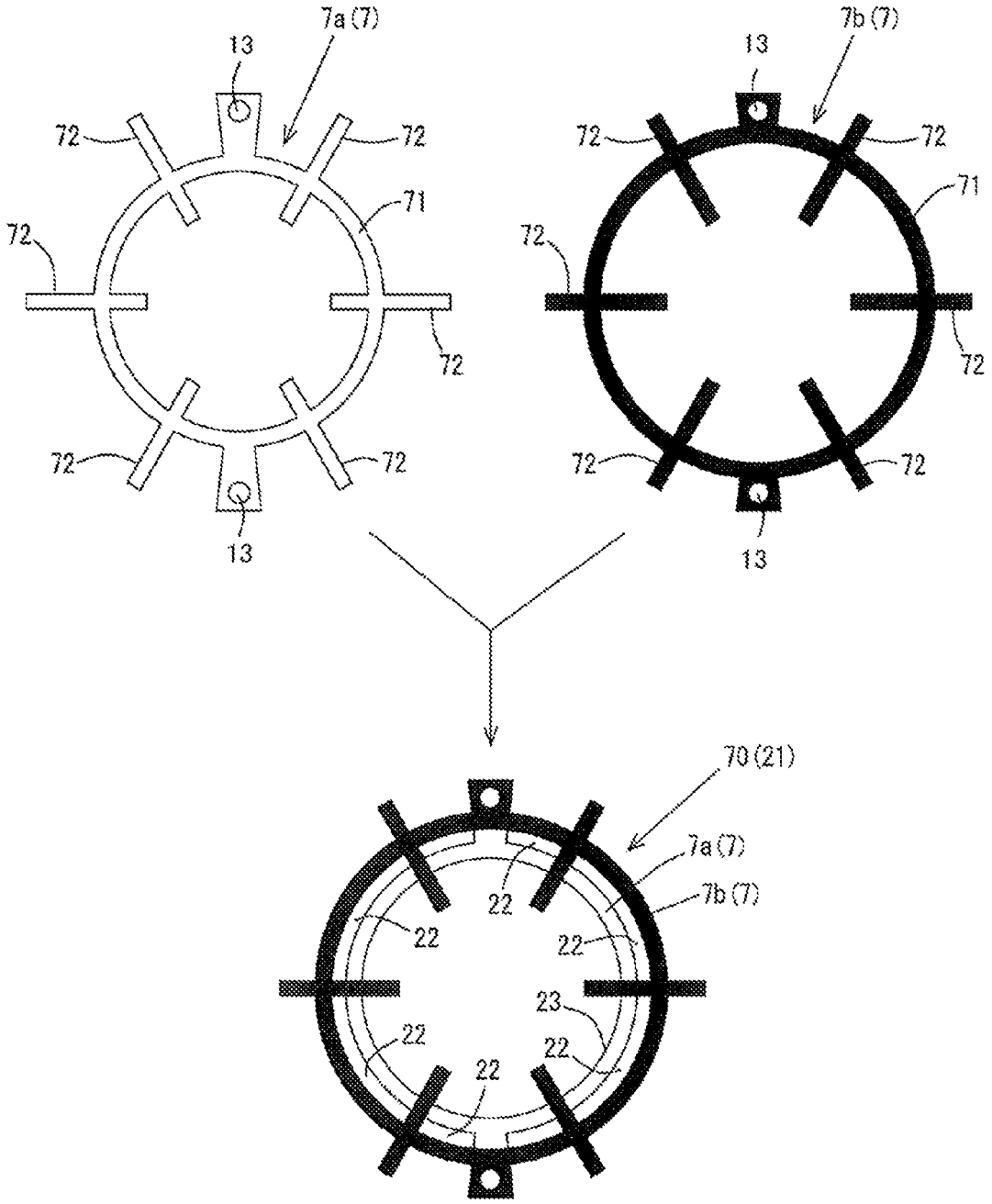
FIG. 40 is a plan view showing a pair of annular members constituting the mixing element of FIG. 39.

According to this modified mixing unit 20 referring to FIG. 40, since there is only one first through hole 22 in the radial direction, the flow resistance of the fluid A flowing in the radial direction (extending direction of mixing element 21) can be reduced. Further, since the stacked linear partition wall portions 72 form blades, there is generated a violent discharge flow toward the outer peripheral portion. Accordingly, the outflow flow rate of the fluid A from discharge port 20β of mixing unit 20 increases, and the suction force at suction ports 20α1 and 20α2 of mixing unit 20 increases so that the inflow flow rate of fluid A from suction ports 20α1 and 20α2 can be increased. Therefore, it is possible to increase the suction amount of the particles B at the bottom of agitation vessel 63 through suction pipe 30. In addition, it becomes possible to increase the flow amount of the fluid A as a whole by agitation impeller 2A. Hence, it is possible to further highly agitate the entire fluid A including particles B and the liquid. In addition, since each of circular rings 7*a* and 7*b* has a simple shape composed of annular partition wall portion 71 and linear partition wall portions 72, it is easy to manufacture and form mixing unit 20 at reduced cost. It is to be noted that mixing element 21 having only one first through hole 22 in the radial direction may be formed not only by annular assembly 70 but also by a single plate material.

As another modification of this embodiment, mixing unit 20 constituted by a stack of mixing elements may be modified to a single member in which there are disposed a tubular hollow portion (24) penetrating in the direction of the rotation axis and lateral through holes radially extending from the hollow portion in the circumferential direction to form fluid flow paths, as seen from mixing units 1 of FIGS. 27A and 27B. The single member may be manufactured by manufacturing with a 3D printer or by forming the hollow portion (24) and the lateral through holes by drilling holes in the material of the mass.

Fourteenth Embodiment

Figure 41:
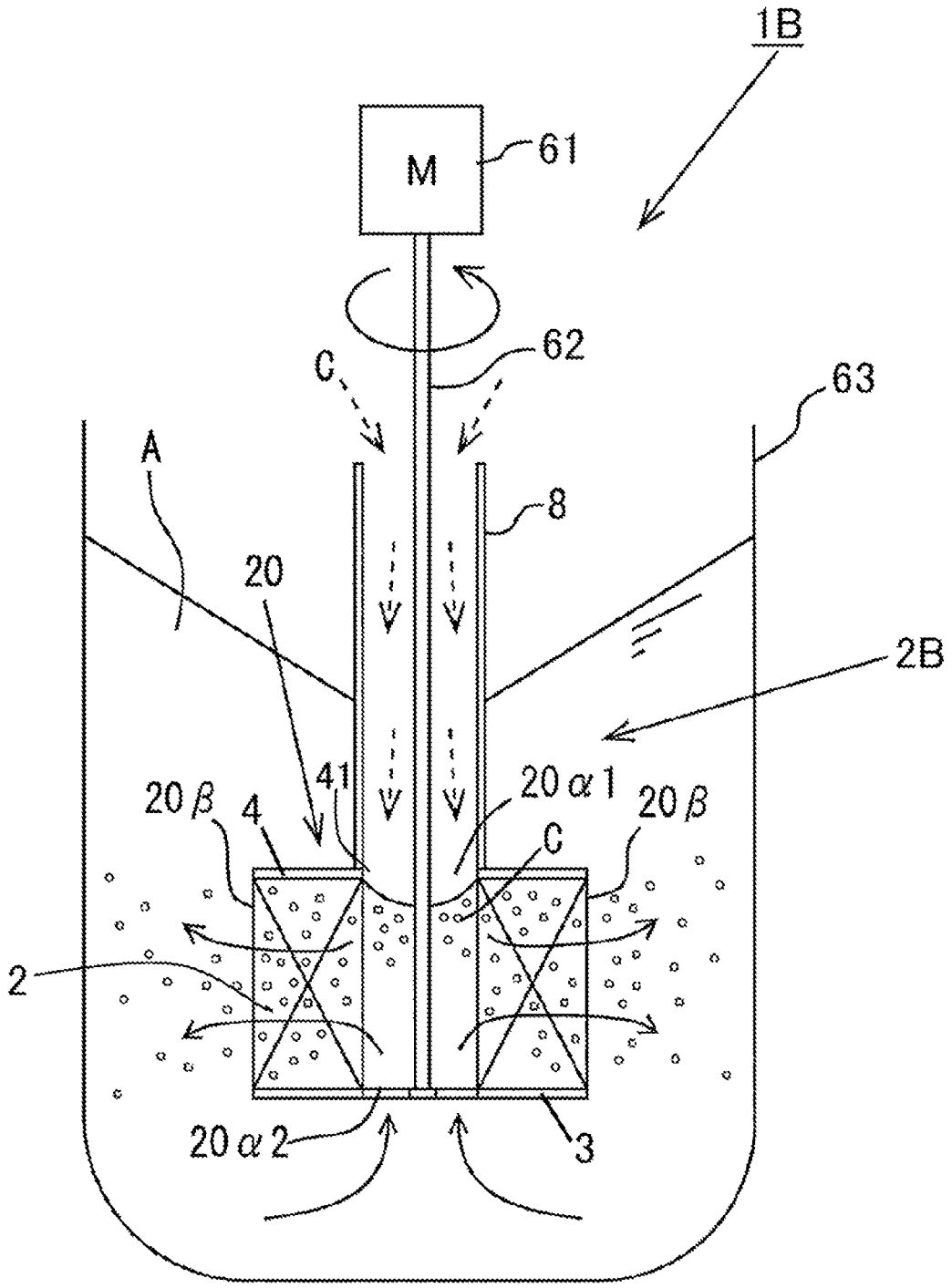
FIG. 41 is a schematic cross-sectional view showing an agitation device having an agitation impeller in accordance with a fourteenth embodiment of the present invention.

Returning to FIG. 41, there is shown an agitation device 1B including a agitation vessel 63 containing a fluid A and an agitation impeller 2B disposed in fluid A in an agitation vessel 63 in accordance with a fourteenth embodiment of the present invention. Agitation device 1B may be used, for example, to disperse gas or air C in the liquid. It should be noted that gas other than air C may be used as the gas.

Agitation impeller 2B includes a cylindrical nozzle for sucking fluid A serves as a gas introduction pipe 8 and is connected to a upper suction port 20α1 on an upper surface of a mixing unit 20. A nozzle holding plate 4 is disposed on an upper surface of a mixing body 2 indicated by oblique lines which is stacked by a plurality of mixing elements as illustrated referring to FIG. 37. Gas introduction pipe 8 surrounds an opening 41 of nozzle holding plate 4, and is arranged to extend upward with respect to mixing unit 20

A rotation shaft 62 is inserted through the inside of gas introducing pipe 8 and a lower end of rotation shaft 62 is connected to a center position of a lower surface of mixing unit 20. That is, a shaft holder plate 3 is disposed on a lower surface of mixing body 2, and the lower end of rotation shaft 62 inserted into gas introduction pipe 8 is connected to attachment portion 32*a* (see FIG. 38) at a center of shaft holder plate 3 from an upper surface side. Other configuration of agitation impeller 2B of this embodiment have the same configuration as that of agitation impeller 2A of the above described thirteenth embodiment.

Similar to those of agitation impeller 1A of the thirteenth embodiment, as agitation impeller 2B is rotated by an electric motor 61, fluid A inside mixing unit 20 is forced outward from discharge ports 20β by a centrifugal force of rotation, and a large suction force is generated from flow paths inside mixing unit 20 to upper and lower suction ports 20α1 and 20α2 at the upper and lower portions of mixing unit 20. In this case, at upper suction port 20α1, air C on the liquid surface can be strongly sucked from gas introduction pipe 8 and sufficiently introduced into mixing unit 20. Since each of first through holes (22) of the uppermost position mixing element (21) is closed by nozzle holding plate 4, a stronger suction force is generated in upper suction port 20α1 and gas introduction pipe 8. Therefore, it is possible to sufficiently introduce air C into the liquid having a higher pressure than the external atmosphere. On the other hand, from lower suction port 20α2, liquid in agitation vessel 63 can be strongly drawn in and sufficiently flow into mixing unit 20.

In the same manner as those of the thirteenth embodiment, while fluid A containing the air C and the liquid flowing into the inside of mixing unit 20 passes through the plurality of first through holes (22) serving as flow paths and flows from the inner circumference toward an outer peripheral portion, fluid A is divided and combined or joined in an extending direction of mixing element (21), and also divided and combined or joined in a stacking direction of mixing elements (21), whereby it is highly mixed. That is, air C flowing into mixing unit 20 is subdivided (microbubbles etc.) by division and highly dispersed in the liquid.

In this way, air C on the liquid surface can be sufficiently drawn into mixing unit 20 from upper suction port 20α1 through gas introduction pipe 8, at the same time, the liquid under agitation impeller 2B is sucked from lower suction port 20α2, the gas-liquid fluid A sucked into mixing unit 20 flows through the flow paths inside mixing unit 20 to be mixed at a high degree, and the fluid A vigorously flows out from the plurality of discharge ports 20β on the outer peripheral portion of mixing unit 20. As a result, it is possible to vigorously flow air C together with the whole liquid A in agitation vessel 63, and air C can be highly dispersed in the liquid in agitation vessel 63. Further, since the introduction of the air C causes generating the suction force in gas introduction pipe 8 by the rotation of agitation impeller 2B, there is no need to separately provide a gas supply means for introducing air C, and no energy consumption due to pneumatic feeding of this gas supply means, and the cost required for agitating can be reduced.

According to this fourteenth embodiment of the present invention, there is provided a method for dispersing a gas in a liquid by an agitation impeller rotating around a rotation axis, wherein the agitation impeller is constituted by a mixing body including a plurality of mixing elements that are stacked in a direction of the rotation axis and supported by a rotation shaft connected to a lower part of the agitation impeller, each of the mixing elements has a plurality of first through holes and a second through hole larger than the first through holes, the mixing elements are arranged such that a part or all of the first through holes in one of the mixing elements overlaps the first through hole of adjacent one of the mixing elements and communicate with the first through hole in the adjacent one to allow fluid to be passed and divided in a direction in which the mixing element extends, a discharge port of a fluid is formed by the plurality of first through holes opening to an outer peripheral portion of the agitation impeller, and the second through holes communicate in a stacking direction of the stacked mixing elements to form suction ports on an upper face and a lower face of the agitation impeller and a hollow portion to introduce the fluid within the mixing unit, including the step of flowing out the fluid within the mixing unit from the discharge port to an outside of the mixing unit by the rotational motion of the agitating impeller to generate suction force at the respective suction ports, and sucking the fluid within the hollow portion from the suction port on the lower face and a gas within the hollow portion from the suction port on the upper face so that the fluid including the liquid and the gas flows into the agitation impeller from the hollow portion.

(First Modification)

Figure 42A:
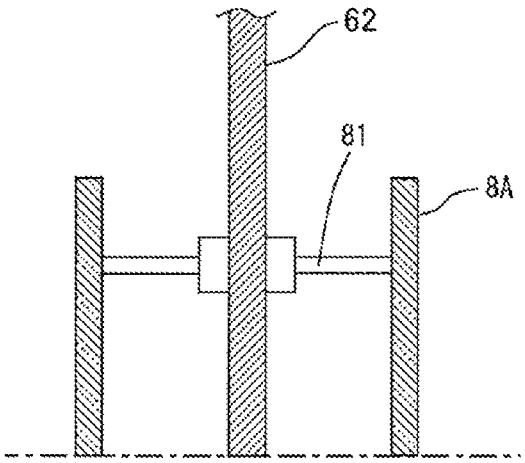
FIG. 42A is a front cross-sectional view of a gas introduction pipe as a first modification of the fourteenth embodiment of the present invention.
Figure 42B:
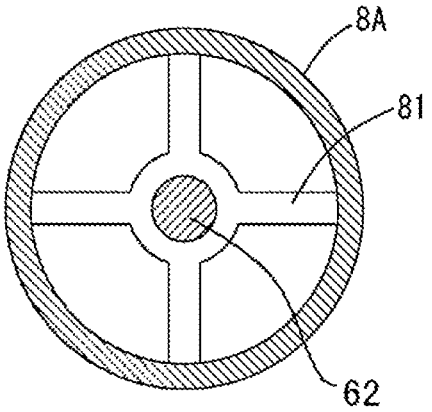
FIG. 42B is a plane cross-sectional view of the gas introduction pipe of FIG. 42A.

Gas introduction pipe 8 at the lower end portion in this fourteenth embodiment is only connected to the upper portion of mixing unit 20, but may be modified to a gas introduction pipe 8A as shown in FIGS. 42A and 42B as a first modification of this embodiment. Gas introduction pipe 8A is supported by a cross-shaped support member 81 disposed on an outer circumference of rotation shaft 62 at an upper part inside the pipe 8A. Thereby, when agitation impeller 2B rotates, gas introduction pipe 8A is prevented from vibrating such that the upper end part draws a circle, and it is possible to maintain the straight attitude on the rotation axis. Hence, air C can be smoothly introduced into mixing unit 20 from the liquid surface. In addition, gas introduction pipe 8A or rotation shaft 62 are prevented from being damaged by vibration of gas introduction pipe 8A coming into contact with rotation shaft 62. The height position at which support member 81 is arranged is desirable to be set above the level of the liquid so as not to mix foreign matter into the liquid by immersion in the liquid in agitation vessel 63 when rotation of agitation impeller 2B is stopped.

(Second Modification)

Figure 43:
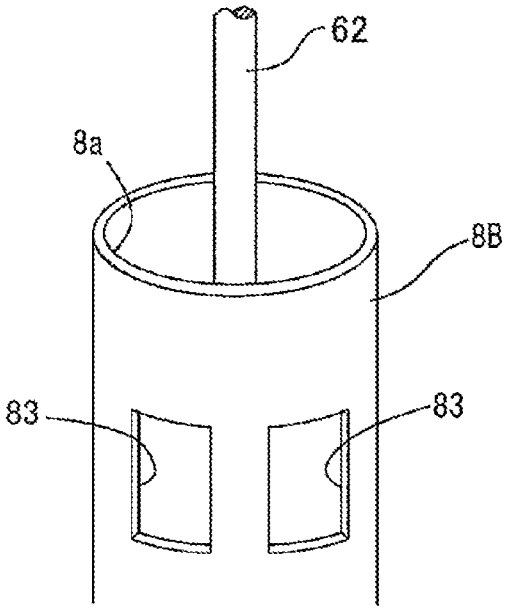
FIG. 43 is a perspective view showing a gas introduction pipe as a second modification of the fourteenth embodiment.

Gas introduction pipe 8 in this fourteenth embodiment introduces the air C only from the opening at the upper end of the pipe, but, as shown in FIG. 43, may be modified to a gas introduction pipe 8B having air holes 83 formed in an upper side wall surface exposing from the liquid level for taking the air as a second modification of this embodiment. As a result, the air C can be taken in from both an upper end opening portion 8*a* of gas introduction pipe 8B and air holes 83, and more air C can be more easily introduced into mixing unit 20. Further, even in the case where the pipe diameter of gas introduction pipe 8B is small or in the case where the support member 81 is disposed in gas introduction pipe 8A as shown in FIG. 42A, it is possible to sufficiently introduce air C into mixing unit 20. In the case where support member 81 of FIG. 42 A is disposed in gas introduction pipe 8B, the position of the air holes 83 provided in gas introduction pipe 8B may be provided on one or both of the upper side and the lower side of support member 81. However, it is preferable to provide it below support member 81, whereby air C can be introduced into gas introduction pipe 8B from air hole 83 without receiving any air resistance by support member 81.

(Third Modification)

Figure 44:
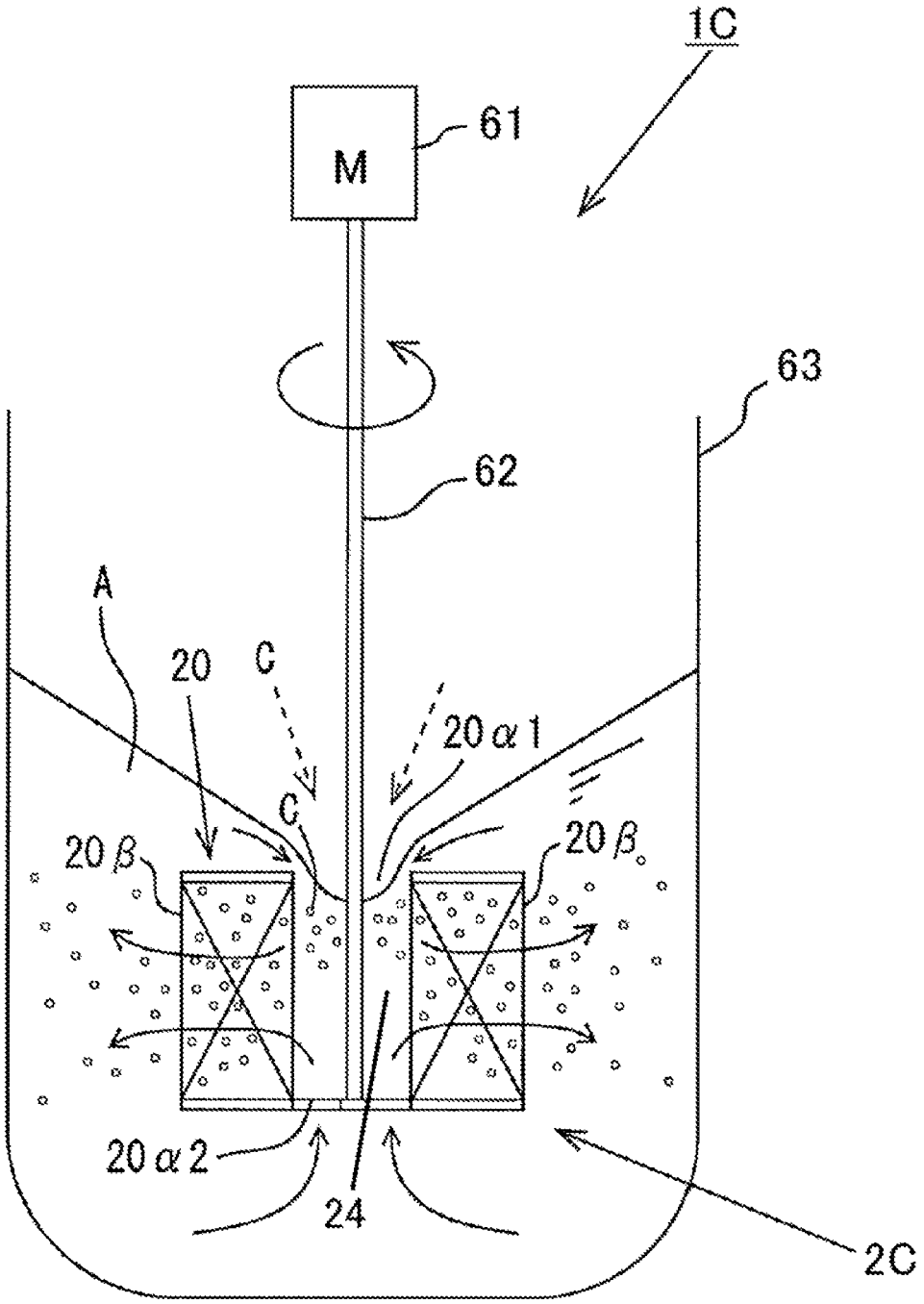
FIG. 44 is a schematic cross-sectional view showing an agitation impeller without a gas introduction pipe as a third modification of the fourteenth embodiment.

Agitation impeller 2B (see FIG. 41) of this fourteenth embodiment have gas introduction pipe 8 disposed at upper suction port 20α1 on the upper surface of mixing unit 20, but may be modified to an agitation impeller 2C having no gas introduction pipe as shown in FIG. 44 (similar to FIG. 32) as third modification of this embodiment. According to a agitation device 1C including agitation impeller 2C, as agitation impeller 2C rotates, a fluid A inside a mixing unit 20 flows out from discharge ports 20β to the outside of mixing unit 20, whereby suction force is generated in each of the upper and lower suction ports 20α1 and 20α2 and fluid A is sucked in a hollow portion 24 from lower suction port 20α2 on the lower surface and also air C is sucked in hollow portion 24 from upper suction port 20α1 on the upper surface, so that fluid A including the liquid and air C flows from hollow portion 24 into agitation impeller 2C. As shown in FIG. 44, when the liquid surface of fluid A becomes in an inverted triangle shape, lowered and recessed in upper suction port 20α1 as the agitation impeller 2C rotates, not only air C but also the liquid above mixing unit 20 are sucked from upper suction port 20α1. Accordingly, the same operation as that of this fourteenth embodiment is exerted, and a large amount of air C can be dispersed in the liquid in an agitation vessel 63.

The above-described agitation impellers of the thirteenth and fourteenth embodiments may be modified to employ other structures in the foregoing embodiments.

For example, agitation impeller 2A of FIG. 37 according to the thirteenth embodiment may be modified to an agitation impeller having a mixing unit 20 provided with plate-shaped blade members at on the outer peripheral portion and/or the inner peripheral portion of mixing unit 20 as may be suggested by blade 15 of FIGS. 28A and 28B.

In the thirteenth embodiment, in the case where the specific gravity of particles B is smaller than the specific gravity of the liquid and easily floats in the upper layer of fluid A, in order to facilitate suction of the floating particles B, a suction pipe 30 may be connected to upper suction port 20α1 on the upper surface side of mixing unit 20 to extended upward of the mixing unit 20. In this case, suction pipe 30 connected to the upper surface side is disposed in fluid A, and the tip part of suction pipe 30 is arranged on an upper layer of fluid A.

Mixing unit 20 according to the fourteenth embodiment may have a configuration in which one unit of the mixing element 21 is formed by one set of annular assembly 70 as described referring to FIGS. 39 and 40.

Fifteenth Embodiment

Figure 45:
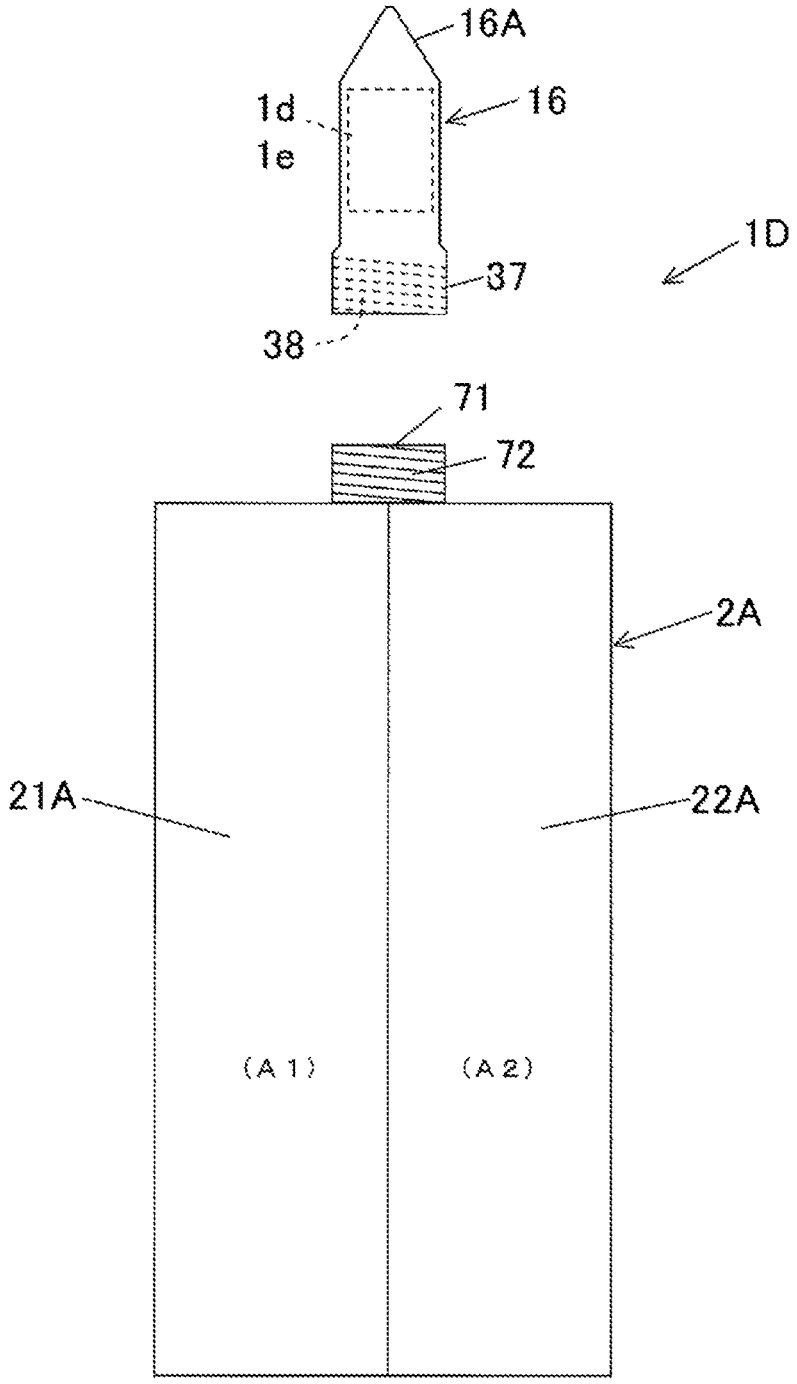
FIG. 45 is an exploded view showing an adhesive dispensing unit having a nozzle in accordance with a fifteenth embodiment of the present invention.

Returning to FIG. 45, there is shown an adhesive dispensing unit 1D including a storage container 2A storing two types of fluids A1 and A2 and a nozzle 16 connected to storage container 2A to mix the two kinds of fluids A1 and A2 and discharge the mixed fluids, which may be provided with a pushing member such as a piston which simultaneously pushes out the two types of fluids A1 and A2 in storage container 2 toward nozzle 16 and a driving member such as a lever for driving the pushing member forward and backward or the like, in accordance with a fifteenth embodiment of the present invention.

Storage container 2A is provided with two storage chambers 21A and 22A for separately partitioning and storing the two kinds of fluids A1 and A2. Two types of fluids A1 and A2 may employ a main agent and a curing agent of a two-component curing type adhesive, but not limited thereto. Volumes of the respective storage chambers 21A and 22B are set so as to be an appropriate mixing ratio of the two kinds of fluids A1 and A2. At a distal end portion of storage container 2A, there is provided an outflow port 71 of a tubular type through which fluids A1 and A2 are extruded from each of storage chambers 21A and 22B. A screw groove 72 is formed on an outer peripheral surface of outflow port 71, and screwedly connected with a base end portion 37 of nozzle 16. Storage container 2A is not limited to storing the two types of fluids, but it may also store two or more kinds of fluids separately partitioned. Storage container 2A may be of a cartridge type that can be attached to and detached from a loading section of the apparatus main body.

Figure 46:
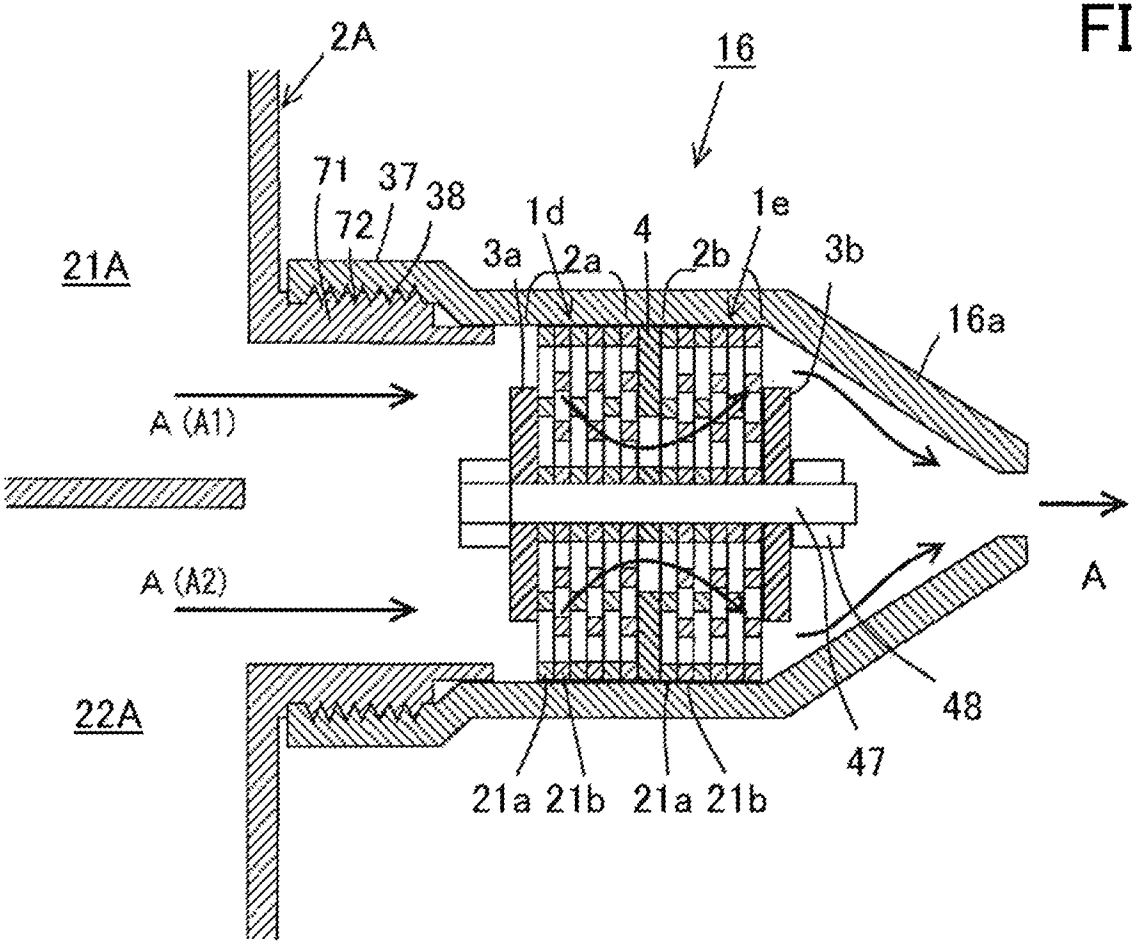
FIG. 46 is a cross sectional view showing an internal configuration of the nozzle of FIG. 45.

As shown in FIG. 46, nozzle 16 includes substantially columnar mixing units 1*d* and 1*e* therewithin, and is formed in a substantially cylindrical shape having a tip portion 16*a* with a tapered shape for discharging a mixed fluid A, that is mixed with two types of fluids A1 and A2 through mixing units 1*d* and 1*e*, to the outside. Outer diameters of mixing units 1*d* and 1*e* are formed to be approximately the same as the inner diameter of the cylindrical portion of nozzle 16 so that substantially all of fluids A1 and A2 supplied into nozzle 16 passes through mixing units 1*d* and 1*e*. A screw groove 38 is formed in an inner peripheral surface of a base end portion 37 nozzle 16, and nozzle 16 is screwed into a screw groove 72 of outflow port 71 of storage container 2A, whereby the nozzle 16 is connected to storage container 2A. If desired, a valve body for preventing backflow of the fluids A1 and A2 from nozzle 16 side into storage container 2A may be disposed at a connection portion between storage container 2A and the nozzle 16.

As mixing units 1*d* and 1*e* are inserted into nozzle 16 and nozzle 16 is connected to storage container 2A so that mixing units 1*d* and 1*e* do not fall, it can be avoided that mixing units 1*d* and 1*e* are dropped from nozzle 16 by outflow port 71 of storage container 2A. The other end face of mixing unit 1*e* is disposed so as to be in contact with a tapered inner peripheral face of a tip end portion 16*a* of nozzle 16, thereby preventing mixing units 1*d* and 1*e* from moving toward tip portion 16*a* side of nozzle 16. Instead of the tapered inner peripheral surface of tip end portion 16*a*, a stepped portion may be provided on the inner peripheral surface of nozzle 16 to prevent the movement of mixing units 1*d* and 1*e* toward tip end portion 16*a* of nozzle 16. Further, the other end face of mixing unit 1*e* may be fixed by disposing a tapered coil spring in nozzle 16.

Mixing units 1*d* and 1*e* are provided with mixing bodies 2*a* and 2*b* in which a plurality of substantially disc-like mixing elements 21*a* and 21*b* are stacked, and the respective first plates or layers 3*a* and 3*b* and a second plate or layer 4 in a substantially disc shape are arranged opposite to each other with mixing bodies 2*a* and 2*b* respectively interposed therebetween. Mixing elements 21*a* and 21*b*, first plates 3*a* and 3*b* and second plate 4 may be made of metal or resin, and are provided with center holes 23, 31 and 41 at the respective center positions penetrating the plate thickness. By inserting a bolt 47 into central holes 23, 31 and 41 and tightening with a nut 48, the plurality of mixing elements 21*a* and 21*b*, first plates 3*a* and 3*b* and second plate 4 are fixed by bolt 47 and nut 48 (fixing unit) in a stacked state in a decomposable manner. Thereby, it is possible to easily form mixing units 1*d* and 1*e* from the plurality of mixing elements 21*a* and 21*b*, and it is easy to perform a cleaning operation such as removal of fluid A (A1 and A2) remaining after decomposing into mixing elements 21*a* and 21*b* from mixing units 1*d* and 1*e*. Thus there is provided an efficient method for assembling an adhesive dispensing unit.

The fixing position of bolt 47 and nut 48 in mixing units 1*d* and 1*e* is not limited to the center position but can be performed at one or more positions at an arbitrary position such as the outer peripheral position. Further, mixing units 1*d* and 1*e* or mixing body 2 may be formed by a single member with a 3D printer device or the like.

Figure 47:
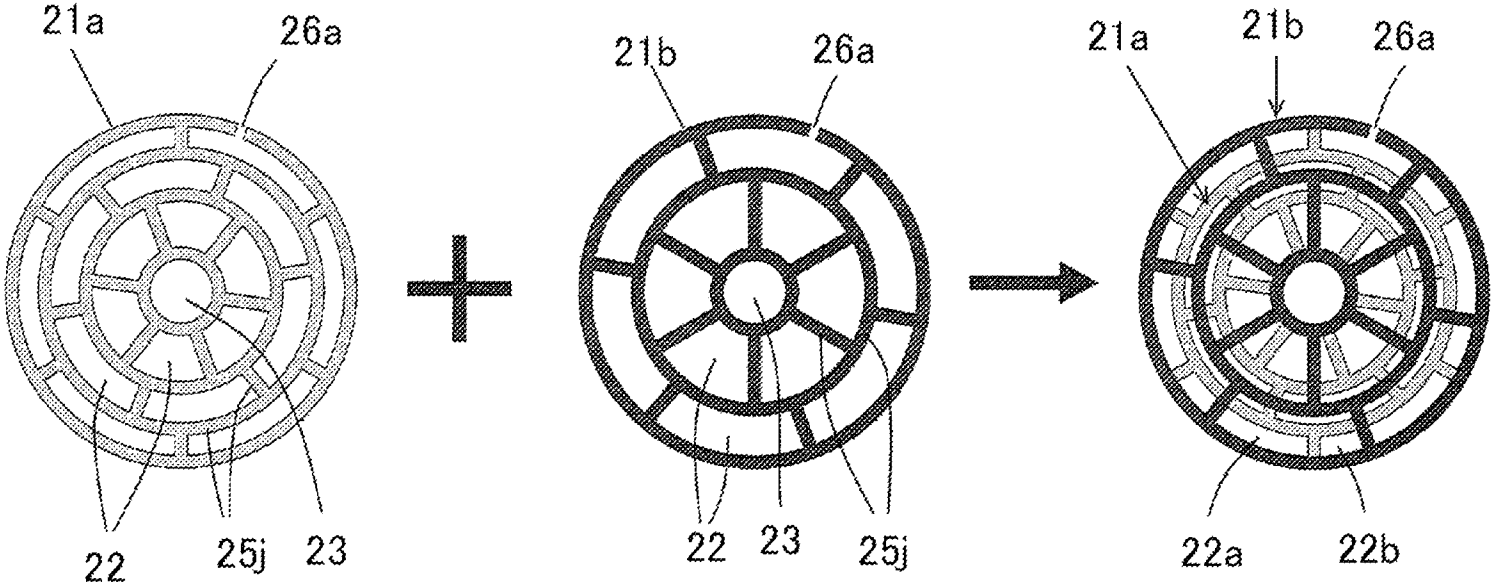
FIG. 47 is a plan view showing a pair of the mixing elements employed in the nozzle of FIG. 46.

As shown in FIG. 47, mixing body 2 is formed by staking two kinds of mixing elements 21*a* and 21*b*. The two kinds of mixing elements 21*a* and 21*b* have a plurality of through holes 22 penetrating in the thickness direction together with a center hole 23 for bolt 47. The plurality of through holes 22 are provided along a surface extending in an extending direction of each of substantially disc-shaped mixing elements 21*a* and 21*b*, and are formed in the same size and shape in the same circumferential direction. Two types of mixing elements 21*a* and 21*b* respectively have different arrangement patterns of through holes 22. Mixing bodies 2*a* and 2*b* are constituted by stacking these two types of mixing elements 21*a* and 21*b* alternately.

The mixing elements 21*a* and 21*b* in mixing bodies 2*a* and 2*b* are arranged such that a part or all of the through holes 22 in one of the mixing elements overlaps with the through hole 22 of adjacent one (21*a*) of the mixing elements so as to partially overlap with each other and communicates with through hole 22 in the adjacent one (21*b*) to allow the two or more kinds of fluids to be passed, divided and joined in a staking direction and an extending direction of the mixing elements 21*a* and 21*b*. In other words, partition walls 25*j* of through holes 22 arranged in a radial direction and a circumferential direction of mixing elements 21*a* and 21*b* are arranged with mutually different positions between adjacent mixing elements 21*a* and 21*b*. Thus, as schematically shown in FIGS. 3A and 3B, the fluid A (A1 and A2) flowing through the inside of the mixing unit 1*d* sequentially passes through holes 22 of adjacent mixing elements 21*a* and 21*b* inside mixing body 2, whereby the fluid A (A1 and A2) is simultaneously divided and joined in the staking direction and the extending direction of mixing elements 21*a* and 21*b*, and fluids A1 and A2 are highly mixed.

Further, in through holes 22 of mixing elements 21*a* and 21*b* stacked in mixing bodies 2*a* and 2*b*, the area of an overlapping portion 22*a* of certain coupled through holes 22 and the area of the other overlapping portion 22*b* adjacent to the portion 22*a* are arranged unevenly in the circumferential direction. As a result, the fluid A (A1 and A2) passing through hole 22 is divided and joined unevenly or non-uniformly in the circumferential direction, and mixing efficiency can be further improved. The areas of the overlapping portions 22*a* and 22*b* of through holes 22 of mixing elements 21*a* and 21*b* in mixing bodies 2*a* and 2*b* may be evenly or uniformly arranged in the circumferential direction.

Figure 48:
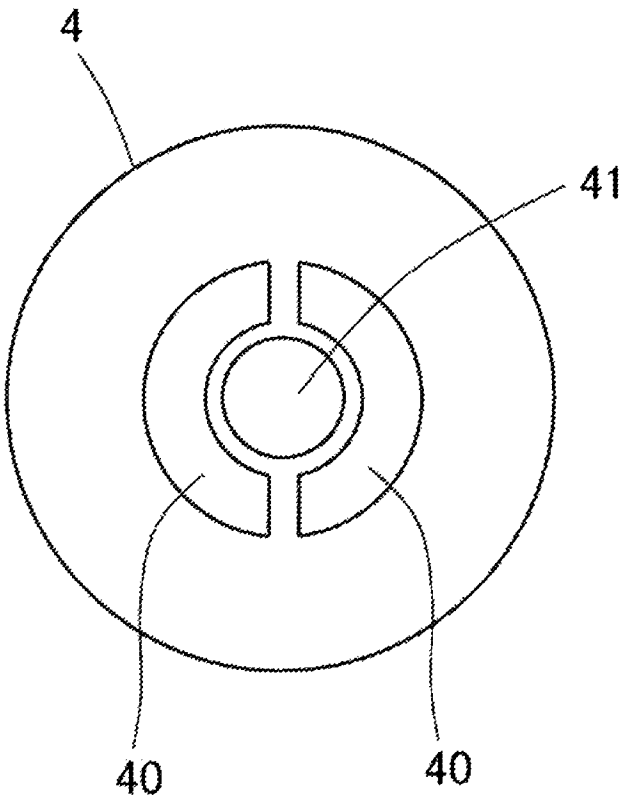
FIG. 48 is a plan view showing a first plate and a second plate employed in the nozzle of FIG. 46.
Figure 48:
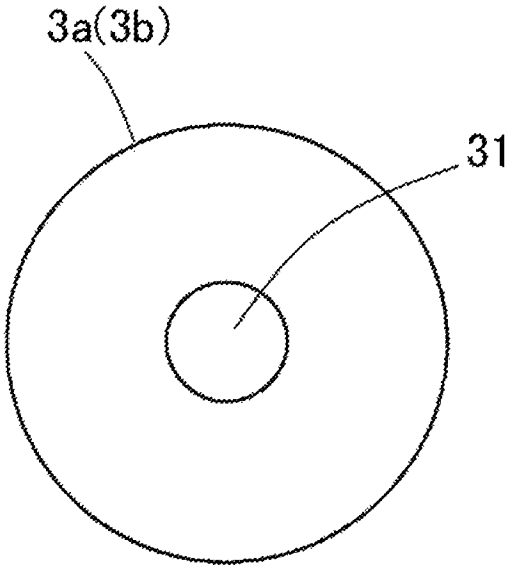

As shown is FIG. 48, first plates 3*a* and 3*b* each has only a center hole 31 for bolt 47, and is a circular plate having no other hole. Second plate 4 has a center hole 41 for bolt 47 and a substantially C-shaped openings 40 for allowing the fluid A (A1 and A2) to pass through in the center portion. The outer diameter to second plate 4 is substantially the same as the outer diameters of mixing elements 21*a* and 21*b*, and the outer diameters of first plates 3*a* and 3*b* are smaller than those of second plate 4 and the mixing elements. Therefore, in mixing units 1*d* and 1*e*, through holes 22 of mixing elements 21*a* and 21*b* are exposed on an outer side of an outer periphery of first plates 3*a* and 3*b* and in openings 40 at the center of second plate 4 as shown in FIG. 46. That is, with respect to mixing units 1*d* and 1*e* in nozzle 16, fluids A1 and A2/ (A) flow in or out from through holes 22 of mixing elements 21*a* and 21*b* exposed to the outside of the outer peripheral portions of first plates 3*a* and 3*b*, and through holes 22 of mixing elements 21*a* and 21*b* exposed in opening portions 40 of second plate 4.

As shown in FIG. 46, there are disposed a pair of mixing units 1*d* and 1*e* in nozzle 16, wherein the respective first plates 3*a* and 3*b* and second plate 4 are arranged to face each other with mixing bodies 2*a* and 2*b* respectively interposed therebetween to connect the pair of mixing units 1*d* and 1*e* in the stacking direction. In the pair of mixing units 1*d* and 1*e*, second plate 4 is disposed in the middle of the stacking direction to be used in common, mixing bodies 2*a* and 2*b* are disposed on both sides of second plate 4, and first plates 3*a* and 3*b* are disposed on outer sides of mixing bodies 2*a* and 2*b*, whereby there is provided a series structure (first plate 3*a*—the mixing body 2*a*—second plate 4—mixing body 2*b*—first plate 3*b*) fixed in the stacking direction by bolt 47 and nut 48.

In the pair of mixing units 1*d* and 1*e*, fluids A1 and A2 in nozzle 16 circulate inside mixing units 1*d* and 1*e* as follows. That is, referring to FIG. 46, fluids A1 and A2 discharged from storage container 2A first flow into a first set of mixing body 2*a* from an outer peripheral side thereof over an outer peripheral portion of first plate 3*a*. Fluids A1 and A2 flowing into mixing body 2*a* from the outer peripheral side thereof flow through mixing body 2*a* while being divided and joined in the stacking direction and the extending direction for mixing to flow toward openings 40 at a center of second plate 4. The fluid A mixed with fluids A1 and A2 flowing through the inside of mixing body 2*a* and flowing to second plate 8 passes through opening 40 and flows into the center of a second set of mixing body 2*b*. The fluid A flowing into mixing body 2*b* from the center side flows through, mixing body 2*b* while being divided and joined in the stacking direction and the extending direction for mixing to flow toward an outer periphery of other first plate 3*b*. The fluid A flowing through the inside of mixing body 2*b* and flowing to first plate 3*b* flows out from the outer periphery of first plate 3*b* to an outside of mixing unit 1*e*. Thus, fluid A inside of the pair of mixing units 1*d* and 1*e* flows through to meander through the outer periphery →center→outer periphery, so that the fluid can be further highly mixed. There is provided a method for mixing fluids and dispensing the mixed fluid with a high mixing effect even if the lengths of the mixing units are shortened.

It is to be noted that mixing units 1*d* and 1*e* disposed in nozzle 16 is not limited to the one pair of mixing unit 1*d* and 1*e* as shown in FIG. 46, but may use two or three pairs of mixing units 1*d* and 1*e* fixed by bolt 47 and nut 48.

In mixing bodies 2*a* and 2*b* of mixing units 2*a* and 2*b*, two types of mixing elements 21*a* and 21*b* are superimposed at predetermined positions in the circumferential direction, and, in order to facilitate this superimposition, respectively provided with notches 26*a* formed at the outer edge portion for specifying the overlapping position of each of mixing elements 21*a* and 21*b*. In a step of forming mixing units 2*a* and 2*b*, a plate-like guide plate (guide member) extending in the stacking direction of mixing bodies 2*a* and 2*b* is fitted to notches 26*a* of all mixing elements 21*a* and 21*b*, and mixing units 2*a* and 2*b* are formed by aligning all notches 26*a* in a row and overlapping mixing elements 21*a* and 21*b* each other. Thereby, it is possible to easily superimpose the two types of mixing elements at predetermined positions in a circumferential direction. It should be noted that mixing elements 21*a* and 21*b* may not be provided with notches 26*a* and the two mixing elements 21*a* and 21*b* may be superimposed at predetermined positions in the circumferential direction without using the guide plate.

As described above, according to adhesive dispensing unit 1D of this fifteenth embodiment, since mixing bodies 2*a* and 2*b* in mixing units 1*d* and 1*e* are formed by stacking the plurality of plate-shaped mixing elements 21*a* and 21*b*, the lengths in the stacking direction of mixing bodies 2*a* and 2*b* can be shortened. First plates 3*a* and 3*b* and second plate 4 disposed on both end faces of mixing bodies 2*a* and 2*b* are also plate-shaped, so that mixing units 1*d* and 1*e* having mixing bodies 2*a* and 2*b* as main parts can shorten the lengths in the stacking direction of mixing elements 21*a* and 21*b*. The plates 3*a*, 3*b* and 4 may be layers made of any materials such as metals, ceramics, resins or the like. In addition, fluid A (A1 and A2) in mixing units 1*d* and 1*e* flows so as to be divided and joined in the staking direction and the extending direction of mixing elements 21*a* and 21*b*, whereby the fluid is highly mixed even if mixing units 1*d* and 1*e* are short. For example, it is possible to sufficiently mix main agent and curing agent as the two kinds of fluids A1 and A2 and obtain mixed fluid A as a two-component curing type adhesive having a proper adhesive strength so as to be dispensed from tip portion 16*a* of nozzle 16. Therefore, even when mixing units 1*d* and 1*e* are short, the mixing effect of the fluid A (A1 and A2) is high, and nozzle 16 in which mixing units 1*d* and 1*e* are disposed can be shortened. As a result, since nozzle 16 is short, it is easy to position nozzle 16 on the material to be dispensed, and the coating operation can be easily performed. In addition, it is possible to reduce the amount of fluid remaining in nozzle 16 to be discarded after application and use, thereby preventing unnecessary use of the fluid A. Furthermore, since the adhesive dispensing unit 1D can be made compact by reducing its length size, handling of the adhesive dispensing unit 1D becomes easy, and the storage location is not widened.

Figure 49:
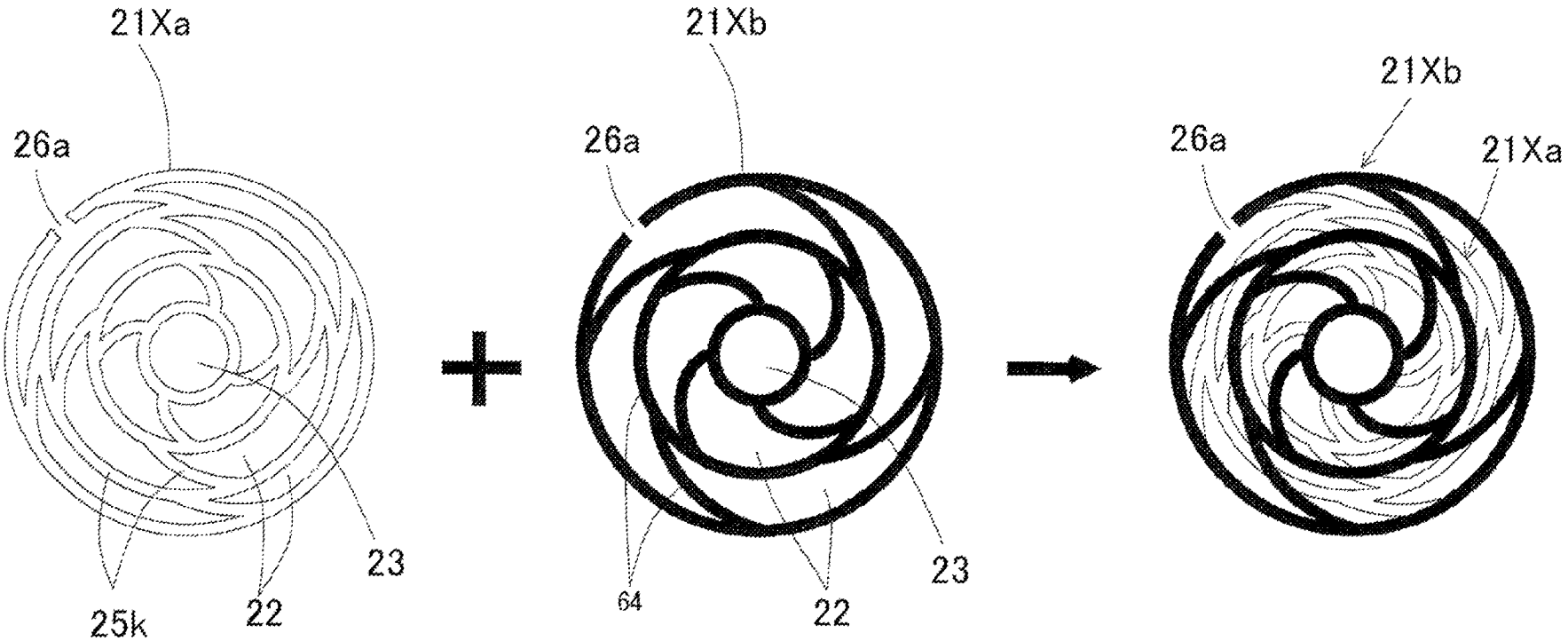
FIG. 49 is a plan view showing involute type mixing elements employed in the nozzle of FIG. 46 as a modification of fifteenth embodiment of the present invention.

Returning to FIG. 49, there are shown a pair of mixing elements 21Xa and 21Xb which may be employed in mixing bodies 2*a* and 2*b* of FIG. 46 as a modification of this embodiment. Partition wails 25*k* extending in a radial direction between through holes 22 of mixing elements 21Xa and 21Xb are formed in a curved shape that curves toward one circumferential side of the mixing elements, viz., with a configuration (involute type) extending in an involute curve shape. The configuration of partition walls 25*k* may be partition walls extending in the radial direction which are continuous from the center to the outer periphery and curve toward one circumferential side in a circumferential direction as shown in FIG. 14. The two types of involute type mixing elements 21Xa and 21Xb have respectively different arrangement patterns of through holes 22. In mixing bodies 2*a* and 2*b*, two types of involute type mixing elements 21Xa and 21Xb are alternately stacked and arranged such that a part or the whole of through hole 22 in one mixing element (21Xa) partially overlap with through hole 22 of the adjacent mixing element (21Xb) by shifting its position to communicably communicate the fluid with the through hole 22 of the adjacent mixing element (21Xb) so as to allow fluid A to flow therethrough and be divided and joined in the stacking direction and the extending direction of the mixing elements 21Xa and 21Xb. Mixing elements 21Xa and 21Xb are provided with notches 26*a* for alignment for stacking.

Figure 50A:
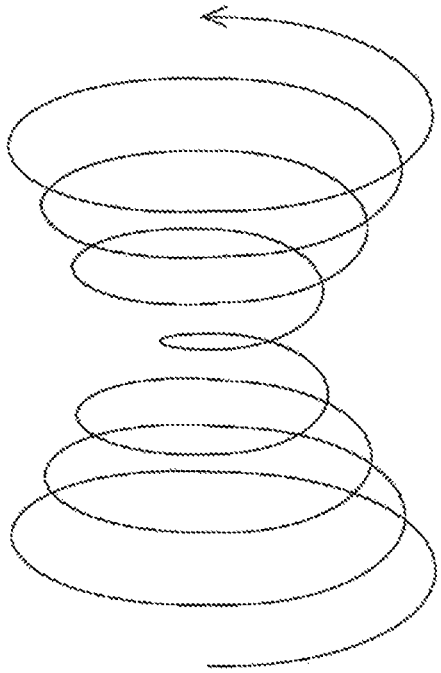
FIGS. 50A and 50B each is a conceptual diagram showing a fluid flow state in a mixing unit composed of the involute type mixing elements employed in the nozzle of FIG. 49.
Figure 50B:
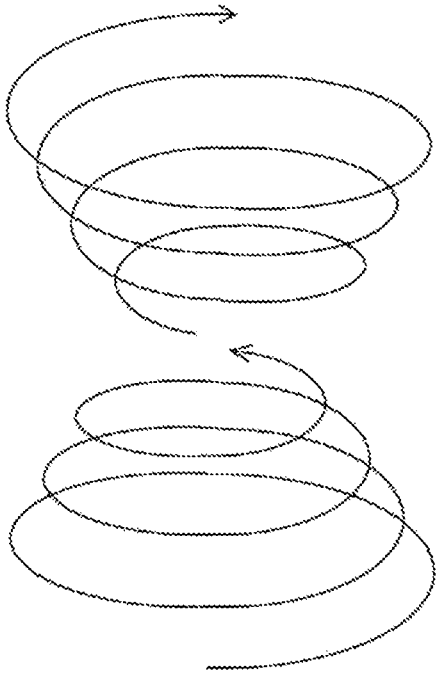

In mixing units 1*d* and 1*e* using such involute type mixing elements 21Xa and 21Xb, as conceptually shown in FIGS. 50A and 50B, fluid A inside the mixing units 1*d* and 1*e* rotates and flows in a spiral shape allowing fluid A so as to be highly mixed. In case that one pair of mixing units 1*d* and 1*e* are disposed in a same helical rotation direction and connected in nozzle 16 as shown in FIG. 46, a helical rotation direction of fluid A flowing within mixing bodies 2*a* and 2*b* becomes a same direction of rotation as shown in FIG. 50A, that is, the two or more kinds of fluids rotate in the same direction as a whole. In case that mixing units 1*d* and 1*e* are disposed in a opposite helical rotation direction, a helical rotation direction of fluid A flowing within mixing bodies 2*a* and 2*b* becomes a reverse direction of rotation between the pair of adjacent mixing bodies 2*a* and 2*b* as shown in FIG. 50B, that is, the two or more kinds of fluids rotate in an opposite direction after rotating in one direction in a circumferential direction of the mixing elements. It should be noted that it is also possible to connect two or more pairs of mixing units 1*d* and 1*e* to provide arbitrarily combined spiral rotation directions of fluid A.

According to this fifteenth embodiment of the present invention, there is provided a method for discharging a fluid by the adhesive dispensing unit, including the steps of: accommodating two or more kinds of fluids in the storage container; simultaneously supplying the two or more types of fluids from the storage container into the nozzle; mixing the two or more kinds of fluids with a mixing unit within the nozzle;

and discharging a mixed fluid obtained by mixing the two or more fluids from the nozzle, wherein in the mixing step, the two or more kinds of fluids are passed through the through holes of the adjacent mixing elements in the mixing unit to be divided and joined in the stacking direction and the extending direction of the mixing elements so as to rotate in the same direction in the circumferential direction of the mixing elements as a whole.

Further, there is provided a method for discharging a fluid by the adhesive dispensing unit, including the steps of: separately storing a main agent and a curing agent as two or more kinds of fluids in the storage container; simultaneously supplying the main agent and the curing agent from the storage container into the nozzle; mixing the main agent and the curing agent with the mixing unit within the nozzle; and discharging a mixed fluid obtained by mixing the main agent and the curing agent from the nozzle, wherein in the mixing step, the main agent and the curing agent are passed through the through holes of the adjacent mixing elements in the mixing unit to be divided and joined in the stacking direction and the extending direction of the mixing elements.

In this embodiment, there is employed a mixing unit including a mixing body having a plurality of mixing elements that are stacked are stacked in a stacking direction and that extend in an extending direction; wherein the mixing elements include a plurality of through holes to form a flow path therein and are arranged such that part or all of the through holes in one of the mixing elements, whose upper surface is in contact with another mixing element and whose lower surface is in contact with another mixing element, communicate with through holes in the adjacent mixing elements to allow fluid to be passed and divided in the extending direction in which the mixing elements extend; and wherein the extending direction is perpendicular to the stacking direction. It should be noted that mixing units in the foregoing embodiments other than this embodiment may be employed.

While the invention has been described with respect to a limited number of embodiments, those skilled in the art, having benefit of this disclosure, will appreciate that other embodiments can be devised which do not depart from the scope of the invention as disclosed herein. Accordingly, the scope of the present invention is indicated not by the embodiments described above but by the scope of claims, and includes meaning equivalent to the scope of claims and all modifications and variations within the scope.

What is claimed is:

1. A mixing unit comprising:

a mixing body including a plurality of mixing elements that are stacked in a stacking direction and that extend in an extending direction;

wherein the mixing elements include a plurality of through holes to form a flow path therein and are arranged such that part or all of the through holes in one of the mixing elements, whose upper surface is in contact with another mixing element and whose lower surface is in contact with another mixing element, communicate with through holes in the adjacent mixing elements to allow fluid to be passed and divided in the extending direction in which the mixing elements extend; and wherein the extending direction is perpendicular to the stacking direction.

2. The mixing unit according to claim 1, further comprising a magnet or a magnetic member for receiving a rotating magnetic field for rotating the mixing body of the mixing unit.

3. The mixing unit according to claim 2, wherein the mixing body is fixed to a member having the magnet or the magnetic member.

4. A mixing method for mixing a fluid in a vessel, comprising the steps of;

disposing the mixing unit according to claim 2 at a bottom portion in the vessel, rotating the mixing body of the mixing unit by the magnet or magnetic member receiving a rotating magnetic field to stir the fluid.

5. An agitation impeller including the mixing unit according to claim 1, wherein one of through holes of each of the mixing elements constitutes a hollow portion by stacking the mixing elements, wherein the mixing unit is connected to a rotation shaft and provided with a suction port and a discharge port for a fluid, wherein the flow path is connected with the suction port and the discharge port through the hollow portion within the mixing unit, wherein the suction port is disposed at a position on a rotation axis of the rotation shaft or at a position close to the rotation axis, and wherein the discharge port is disposed at a position more outside than the suction port relative to the rotation axis.

6. An agitation impeller including the mixing unit according to claim 1, wherein each of the mixing elements is composed of a pair of circular rings to form the through holes.

7. An adhesive dispensing unit including the mixing unit according to claim 1 comprising:

a storage container in which two or more kinds of fluids are stored; and a nozzle for dispensing a mixed fluid of the two or more kinds of fluids supplied from the storage container;

wherein the mixing unit is disposed to mix the two or more kinds of fluids supplied from the storage container disposed in the nozzle.

8. The adhesive dispensing according to claim 7, wherein the mixing elements are arranged to allow the two or more kinds of fluids to be passed, divided and joined in the staking and extending directions of the mixing elements.

9. The adhesive dispensing unit according to claim 7, wherein, a partition wall between the through holes of the mixing elements in the mixing unit is formed in a curved shape that curves toward one circumferential side of the mixing element.

10. A method for dispensing a fluid by the adhesive dispensing unit according to claim 7, the method comprising:

accommodating two or more kinds of fluids in the storage container;

simultaneously supplying the two or more types of fluids from the storage container into the nozzle;

mixing the two or more kinds of fluids with a mixing unit within the nozzle; and dispensing a mixed fluid obtained by mixing the two or more fluids from the nozzle.

11. The method according to claim 10, wherein, in the mixing step, the two or more kinds of fluids rotate in the same direction as a whole or in an opposite direction after rotating in one direction in a circumferential direction of the mixing elements.

12. The method according to claim 10:

wherein the two or more kinds of fluids are a main agent and a curing agent;

wherein, in the accommodating step, the main agent and the curing agent are separately stored in the storage container;

wherein, in the simultaneously supplying step, the main agent and the curing agent are simultaneously supplied into the nozzle from the storage container;

wherein, in the mixing step, the main agent and the curing agent are mixed by the mixing unit within the nozzle, and;

wherein, in the dispensing step, the adhesive generated by mixing the main agent and the curing agent is dispensed from the nozzle; and wherein, in the mixing step, the main agent and the curing agent pass through the through hole of the adjacent mixing element in the mixing unit, thereby mixing the main agent and the curing agent while dividing and joining the main agent and the curing agent in the extending and stacking directions of the mixing element.

13. A method for assembling the adhesive dispensing unit according to claim 7, the method comprising:

forming the mixing unit; and inserting and arranging the mixing unit into the nozzle, wherein the step of forming the mixing unit further includes a step of forming mixing body by aligning and stacking each of the plurality of mixing elements at a predetermined position in a circumferential direction to form a mixing body, a step of arranging a first layer and a second layer opposite to each other with the mixing body interposed therebetween, and a step of fixing the mixing body, the first layer and the second layer by being penetrated with a fixing unit in the stacking direction.

14. An agitation impeller comprising:

a mixing unit connected to a rotation shaft provided with a suction port and a discharge port for a fluid, wherein a flow path connecting the suction port and the discharge port is provided within the mixing unit, wherein the suction port is disposed at a position on a rotation axis of the rotation shaft or at a position close to the rotation axis, and wherein the discharge port is disposed at a position more outside than the suction port relative to the rotation axis, and a nozzle for sucking the fluid is disposed at the suction port.

15. The agitation impeller according to claim 14, wherein the flow path within the mixing unit is formed so as to divide the fluid in a plurality of directions within the mixing unit.

16. The agitation impeller according to claim 14, wherein the suction port includes a pair of suction ports disposed at upper and lower portions of the mixing unit, and the suction port at one portion is provided with a limit member for limiting inflow of the fluid larger than inflow in the suction port at other portion.

17. An agitation device, comprising:

the agitation impeller according to claim 14; and an agitation vessel, wherein the agitation impeller according is disposed in a fluid within the agitation vessel.

18. A method for agitating a fluid by the agitation impeller of claim 14, the method comprising:

flowing out the fluid within the mixing unit from the discharge port to outside of the mixing unit by a centrifugal force of rotation of the agitation impeller to generate a suction force at the suction port, and sucking the fluid outside the mixing unit from the suction port to flow the fluid into the mixing unit.

19. The method according to claim 18 for agitating a fluid containing particles in a liquid, wherein the nozzle is disposed at the suction port at a lower part of the mixing unit as a suction pipe, further comprising a step of sucking the fluid through the suction pipe while rolling the particles from the suction port of the lower part of the mixing unit.

20. The method according to claim 18 for dispersing a gas in a liquid, wherein the nozzle is disposed at the suction port at an upper part of the mixing unit as a gas introduction pipe, further comprising a step of sucking the gas from the suction port at the top of the mixing unit through the gas introduction pipe.

* * * * *